US010245873B2

(12) United States Patent
Kenjo

(10) Patent No.: US 10,245,873 B2
(45) Date of Patent: Apr. 2, 2019

(54) BINDING MECHANISM CARTRIDGE, BINDING DEVICE BODY AND SHEET PROCESSING APPARATUS

(71) Applicant: MAX CO., LTD., Tokyo (JP)

(72) Inventor: Tatsuya Kenjo, Tokyo (JP)

(73) Assignee: MAX CO., LTD., Tokyo (JP)

( * ) Notice: Subject to any disclaimer, the term of this patent is extended or adjusted under 35 U.S.C. 154(b) by 447 days.

(21) Appl. No.: 14/970,622

(22) Filed: Dec. 16, 2015

(65) Prior Publication Data

US 2016/0185149 A1 Jun. 30, 2016

(30) Foreign Application Priority Data

Dec. 26, 2014 (JP) ..... 2014-265478

(51) Int. Cl.
*B42B 5/00* (2006.01)
*B65H 37/04* (2006.01)
*G03G 15/00* (2006.01)

(52) U.S. Cl.
CPC ..... *B42B 5/00* (2013.01); *B65H 37/04* (2013.01); *G03G 15/6544* (2013.01);
(Continued)

(58) Field of Classification Search
CPC ..... B65H 37/04; B42B 5/00; B42B 5/123
(Continued)

(56) References Cited

U.S. PATENT DOCUMENTS 1,065,904 A * 6/1913 Bump ..... B31D 1/023 493/351
1,324,103 A * 12/1919 Cone ..... B31F 5/027 281/21.1
(Continued)

FOREIGN PATENT DOCUMENTS

JP 2000-318918 A 11/2000
JP 2004-358977 A 12/2004
(Continued)

OTHER PUBLICATIONS

Japanese Office Action dated Sep. 4, 2018 that issued in corresponding Japanese patent application No. 2014-265478 attached.

*Primary Examiner* — Robert F Long
(74) *Attorney, Agent, or Firm* — Drinker Biddle & Reath LLP

(57) ABSTRACT

A binding mechanism cartridge is detachably held by a binding device body instead of a staple cartridge which is detachable into the binding device body. The binding mechanism cartridge includes a body portion, an upward-and-downward moving portion and a base portion. The body portion is detachably held by the binding device body. The upward-and-downward moving portion is on the body portion to move close to or away from one surface of a bundle of sheets by moving upward and downward by interlocking with a drive mechanism of the binding device body. The base portion is on the body portion to face the upward-and-downward moving portion and supports the other surface of the bundle of sheets. The upward-and-downward moving portion includes a binding mechanism which is partially in pressure contact with the one surface according to a movement of the upward-and-downward moving portion to binds the bundle of sheets.

7 Claims, 25 Drawing Sheets

(52) U.S. Cl.
CPC ..... *B65H 2301/43828* (2013.01); *B65H 2402/10* (2013.01); *B65H 2402/32* (2013.01); *B65H 2402/40* (2013.01); *B65H 2404/62* (2013.01); *B65H 2408/122* (2013.01); *B65H 2601/324* (2013.01); *B65H 2601/326* (2013.01); *B65H 2601/422* (2013.01); *B65H 2801/27* (2013.01); *G03G 2215/00822* (2013.01)

(58) Field of Classification Search
USPC ..... 227/107–156
See application file for complete search history.

(56) References Cited

U.S. PATENT DOCUMENTS 3,577,575 A * 5/1971 Taniguchi ..... B31F 5/027 29/564
4,770,334 A * 9/1988 Hoshi ..... B27F 7/21 227/120
5,024,643 A * 6/1991 Kastner ..... B31F 5/027 493/351
5,447,402 A * 9/1995 Kobayashi ..... B31F 5/027 412/33
5,921,066 A * 7/1999 Olsson ..... B65D 75/08 493/351
7,036,706 B2 * 5/2006 Mochizuki ..... B27F 7/38 227/120
9,475,332 B2 * 10/2016 Aoi ..... B26D 1/0006
2010/0213240 A1 * 8/2010 Kostrzewski ..... A61B 17/072 227/180.1
2011/0068147 A1 * 3/2011 Racenet ..... A61B 17/072 227/180.1
2012/0267841 A1 10/2012 Wang et al.
2013/0043637 A1 * 2/2013 Awano ..... B42B 5/08 270/58.08
2013/0214472 A1 8/2013 Suzuki
2014/0153992 A1 6/2014 Serizawa
2015/0210503 A1 * 7/2015 Osada ..... B65H 37/04 270/1.01
2017/0065015 A1 * 3/2017 Luciani ..... B27F 7/19

FOREIGN PATENT DOCUMENTS

JP 2009-214296 A 9/2009
JP 2014-015273 A 1/2014

* cited by examiner

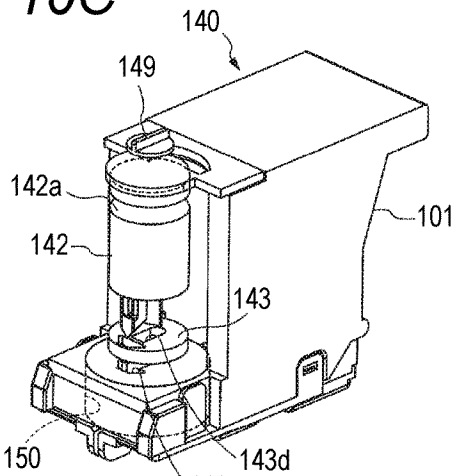
FIG. 10A
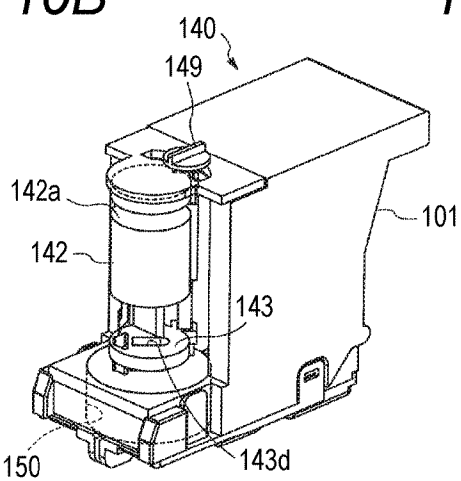
FIG. 10B
FIG. 10C
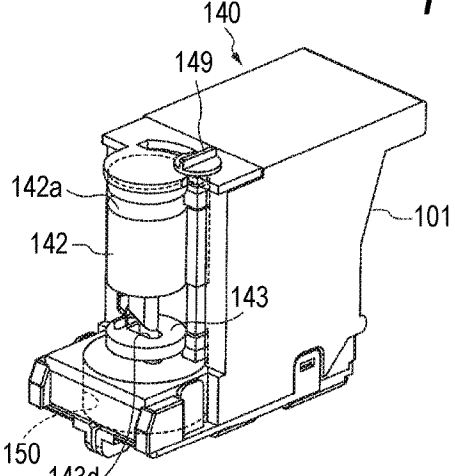
FIG. 10D
FIG. 10E
FIG. 10F

FIG. 25A (NUMBER OF SHEETS)

| BINDING METHOD / BASIS WEIGHT | STAPLE | CLIP | PAPER NEEDLE | CONCAVE-CONVEX BINDING | HALF-BLANK BINDING | STITCHING |
|---|---|---|---|---|---|---|
| 40 ~ 59 $g/m^2$ | 50 | 10 | 15 | 5 | 5 | 5 |
| 60 ~ 79 $g/m^2$ | 50 | 10 | 12 | 4 | 3 | 5 |
| 80 ~ 99 $g/m^2$ | 40 | 9 | 10 | 3 | 2 | 4 |
| 100 ~ 119 $g/m^2$ | 35 | 8 | 8 | 2 | – | 4 |
| 120 ~ 139 $g/m^2$ | 35 | 7 | 6 | – | – | 3 |
| 140 ~ 159 $g/m^2$ | 20 | 6 | 4 | – | – | 2 |
| 160 ~ 179 $g/m^2$ | 15 | 5 | – | – | – | – |
| 180 ~ 199 $g/m^2$ | 10 | 4 | – | – | – | – |
| 200 ~ 219 $g/m^2$ | – | 3 | – | – | – | – |
| 220 ~ 239 $g/m^2$ | – | 2 | – | – | – | – |
| 240 ~ 300 $g/m^2$ | – | – | – | – | – | – |

FIG. 25B ($80g/m^2$)

| BINDING METHOD / NUMBER OF SHEETS BOUND | STAPLE | CLIP | PAPER NEEDLE | CONCAVE-CONVEX BINDING | HALF-BLANK BINDING | STITCHING |
|---|---|---|---|---|---|---|
| 2 ~ 10 SHEETS | A | A | B | C | B | B |
| 11 ~ 20 SHEETS | A | – | C | – | – | – |
| 21 ~ 30 SHEETS | B | – | – | – | – | – |
| 31 ~ 40 SHEETS | B | – | – | – | – | – |
| 41 ~ 50 SHEETS | C | – | – | – | – | – |

A: 50% POWER B: 75% POWER C: 100% POWER

BINDING MECHANISM CARTRIDGE, BINDING DEVICE BODY AND SHEET PROCESSING APPARATUS

CROSS-REFERENCE TO RELATED APPLICATION

This application is based on and claims priority under 35 USC119 from Japanese Patent Application No. 2014-265478 filed on Dec. 26, 2014.

TECHNICAL FIELD

The present invention relates to a binding mechanism cartridge, a binding device body and a sheet processing apparatus, and more particularly, to a binding mechanism cartridge that can be attached to and detached from a binding device body in which a staple cartridge or a stapler drive mechanism is detachably held, a binding device body that detachably holds the binding mechanism cartridge, and a sheet processing apparatus on which the binding device body is mounted.

BACKGROUND

In the related art, a binding device body (electric stapler) is known which electrically performs a sheet bundle binding process by causing a staple having a C shape to penetrate a bundle of paper sheets stacked (hereinafter, referred to as a bundle of sheets) (for example, see JP-A-2004-358977). The binding device body is often installed in a sheet processing apparatus such as a business copier. A user can bind a bundle of sheets subjected to printing by driving the binding device body.

Recently, a method of binding a bundle of sheets without using a staple has been known. For example, a stitching method of binding a bundle of sheets by making a U-shaped cut into the bundle of sheets and folding and guiding a U-shaped tip to another cut, a half-blank binding method of binding a bundle of sheets by making a U-shaped cut into the bundle of sheets and lifting a U-shaped tip toward a sheet surface or bending a lifted tip toward the sheet surface, a concave-convex binding method of binding a bundle of sheets by biting the bundle of sheets with metal teeth engaging with each other in a concave-convex shape from both sides to deform a part of the bundle of sheets in the concave-convex shape, a paper needle binding method of binding a bundle of sheets using a paper needle instead of a staple, and a clip binding method of binding a stacking end face of a bundle of sheets from a side using a clip are generally known as such a binding method.

Today, a sheet processing apparatus is also known which includes binding mechanism units for performing a binding process using a staple, a binding process using the stitching method, a binding process using the half-blank binding method, a binding process using the concave-convex binding method, a binding process using the paper needle binding method, and the like so as to bind a bundle of sheets using the above-mentioned other binding methods as well as to bind a bundle of sheets using a staple (for example, see JP-A-2000-318918).

SUMMARY

However, when a sheet processing apparatus such as a business copier is provided with the binding mechanism units using different binding methods, an increase in size of the sheet processing apparatus may be caused and a product cost may increase due to an increase in the number of components or the like.

When a binding angle of a staple with respect to a bundle of sheets varies in binding the bundle of sheets using a staple, a binding force of the bundle of sheets does not much vary. However, when a bundle of sheets is bound without using a staple, the binding force of the bundle of sheets may much vary depending on a difference in the binding angle with respect to the bundle of sheets.

For example, in a bundle of sheets which has been subjected to a binding process using the stitching method, a binding process using the half-blank binding method, or the like, when a cutting direction of a U-shaped tip in a U-shaped cut is parallel to a sheet turning direction in the bundle of sheets, binding parts of the bundle of sheets are likely to be scattered to weaken the binding force of the bundle of sheets. On the other hand, when the cutting direction of a U-shaped tip in a U-shaped cut is perpendicular to the sheet turning direction in the bundle of sheets, binding parts of the bundle of sheets are not likely to be scattered to maintain the binding force of the bundle of sheets relatively strong.

When a bundle of sheets is bound using a staple, a width of a staple is relatively small and thus a possibility that a binding position of the staple on the bundle of sheets will affect visibility of a sheet surface, a printable space of a sheet surface, or the like is low. However, when a bundle of sheets is bound without using a staple, the size of a binding part in a sheet surface becomes larger than that when a staple is used. Accordingly, the possibility that a binding position on the bundle of sheets will affect visibility of a sheet surface, a printable space of a sheet surface, or the like is high and thus convenience is likely to be damaged largely.

For example, in a bundle of sheets which has been subjected to a binding process using the stitching method, a binding process using the half-blank binding method, or the like, when a U-shaped cut is formed close to the center of a sheet surface and away from an end of the bundle of sheets, a printable space on the sheet surface is narrowed and visibility of the sheet surface and convenience is likely to be damaged largely. On the other hand, when a U-shaped cut is formed close to an end of a bundle of sheets, visibility of a sheet surface is likely to be secured but a binding force of the bundle of sheets is likely to be weakened due to a binding hole formed in an end portion of the bundle of sheets by the cut.

In this way, in case of a binding mechanism unit not using a staple, a binding force and convenience much depend on a binding position and a binding angle of a binding part with respect to a bundle of sheets. Accordingly, regarding a binding mechanism unit not using a staple, there is high demand for fine adjustment of a binding position and a binding angle.

However, when a sheet processing apparatus is provided with plural binding mechanism units having different binding methods, it is difficult to finely adjust a binding position or a binding angle of a binding part for each binding mechanism unit. For example, each binding mechanism unit is mounted inside a sheet processing apparatus such as a business copier. Accordingly, a method of adjusting a binding position or a binding angle of each binding mechanism unit using an operation panel of the sheet processing apparatus has a problem in that an internal structure and internal mechanisms are complicated.

Even when a configuration of adjusting a binding position and a binding angle using the operation panel is embodied, each binding mechanism unit is mounted inside the sheet processing apparatus and thus a user cannot visually check the adjusted position or the adjusted angle. Accordingly, it is not possible to sensibly determine whether an adjusted position and an adjusted angle set using the operation panel or the like are the same a position and an angle desired by the user. Therefore, even when a method of adjusting a position and an angle using the operation panel or the like is embodied by improving the internal structure of the sheet processing apparatus, an adjusted position and an adjusted angle set using the operation panel or the like are often different from a position and an angle desired by the user and there is a problem in that it is difficult to perform fine adjustment.

The present invention is made in consideration of the above-mentioned problems and a first object thereof is to provide a binding mechanism cartridge, a binding device body, and a sheet processing apparatus which can bind a bundle of sheets using various binding methods without causing an increase in size of the sheet processing apparatus, an increase in the number of components, or the like.

A second object of the present invention is to provide a binding mechanism cartridge, a binding device body, and a sheet processing apparatus which can sensibly and finely adjust a binding position and a binding angle using a visual sense in a binding mechanism unit capable of performing a binding process without using a staple.

In order to achieve the above-mentioned objects, according to an aspect of the present invention, a binding mechanism cartridge is attached to and detached from a binding device body instead of a staple cartridge. The staple cartridge is also detachably held by the binding device body. The binding mechanism cartridge includes a body portion, an upward-and-downward moving portion, and a base portion. The body portion is detachably held by the binding device body at a storage position of the staple cartridge. The upward-and-downward moving portion is arranged on the body portion so as to be movable upward and downward and moves close to or away from one surface of a bundle of sheets to be bound by moving upward and downward by interlocking with a drive mechanism of the binding device body. The base portion is arranged on the body portion so as to face the upward-and-downward moving portion and supports the other surface of the bundle of sheets. The upward-and-downward moving portion includes a binding mechanism. At least a part of the binding mechanism is in pressure contact with the one surface of the bundle of sheets according to a movement of the upward-and-downward moving portion. The binding mechanism binds the bundle of sheets without using a staple.

In the binding mechanism cartridge according to the present invention, the body portion is detachably held at the storage position of the staple cartridge, the body portion is provided with the upward-and-downward moving portion and the base portion, and the upward-and-downward moving portion is provided with the binding mechanism of which at least a part comes in pressure contact with one surface of the bundle of sheets and binds the bundle of sheets without using a staple. By constituting the binding mechanism cartridge in this way, the binding mechanism that binds a bundle of sheets without using a staple can be simply attached to the binding device body which a staple cartridge can be attached to and detached from. Accordingly, the binding mechanism that binds a bundle of sheets without using a staple can be easily and newly added to the binding device body without adding improvement or the like to the drive mechanism or the like of the binding device body itself. A new binding mechanism can be simply added by setting the binding mechanism cartridge according to the present invention in the binding device body.

For example, a binding mechanism using a stitching method, a binding mechanism using a half-blank binding method, and a binding mechanism using a concave-convex binding method are known as the binding mechanism not using a staple. Accordingly, by preparing for a binding mechanism cartridge for each of plural binding mechanisms using different binding methods, the binding mechanisms using various binding methods can be simply selected and added by replacing the binding mechanism cartridge.

In comparison with a case in which plural binding mechanisms performing a binding process without using a staple are arranged in a sheet processing apparatus in which the binding device body is installed, it is possible to easily achieve a decrease in size of the sheet processing apparatus, a decrease in the number of components, and the like and thus to suppress an increase in size of the apparatus or an increase in cost.

The binding function of binding a bundle of sheets without using a staple is embodied by operations of the upward-and-downward moving portion, the base portion, and the binding mechanism. Accordingly, when a problem occurs in any of the upward-and-downward moving portion, the base portion, and the binding mechanism, the binding function can be simply recovered by replacing the binding mechanism cartridge itself. When a problem occurs in the binding mechanism not using a staple, it is not necessary to repair the binding device body or the like. Accordingly, it is possible to rapidly mount and recover a binding function not using a staple at a low cost.

In the binding mechanism cartridge according to the present invention, the upward-and-downward moving portion which is provided with the binding mechanism is arranged to be movable upward and downward with respect to the body portion and moves close to and away from a bundle of sheets by interlocking with the driving of the binding device body. In this way, since the upward-and-downward moving portion and the binding mechanism can be caused to move close to and away from a bundle of sheets using the drive mechanism of the binding device body, it is not necessary to provide the binding mechanism cartridge itself with a drive mechanism (for example, a motor) for driving the upward-and-downward moving portion and the binding mechanism. Accordingly, it is possible to simplify the structure of the binding mechanism cartridge and to achieve a decrease in cost of the binding mechanism cartridge.

In the binding mechanism cartridge, the drive mechanism of the binding device body may be a mechanism which interposes the bundle of sheets in the binding device body.

In the binding mechanism cartridge, the drive mechanism of the binding device body may be a clinching mechanism which is arranged in the binding device body and which bends legs of a staple.

In the binding mechanism cartridge, the drive mechanism of the binding device body may be a stapler drive mechanism which includes a plate and a driver. The plate shapes a staple in a C shape and is movable upward and downward. The driver hammers the staple formed in the C shape into the bundle of sheets and is movable upward and downward.

In the binding mechanism cartridge according to the present invention, the upward-and-downward moving portion and the binding mechanism can be caused to move close to and away from a bundle of sheets using any of the mechanism interposing the bundle of sheets in the binding device body, the clinching mechanism, and the stapler drive mechanism. Accordingly, it is not necessary to provide the binding mechanism cartridge itself with a drive mechanism (for example, a motor) for driving the upward-and-downward moving portion and the binding mechanism. As a result, it is possible to simplify the structure of the binding mechanism cartridge and to achieve a decrease in cost of the binding mechanism cartridge.

The mechanism interposing the bundle of sheets, the clinching mechanism, and the stapler drive mechanism are mechanisms which are generally installed in the binding device body. Accordingly, a drive mechanism for driving the binding mechanism cartridge does not need to be installed in the binding device body and the binding process using the binding mechanism cartridge can be performed using the drive mechanism which has been installed in advance.

According to another aspect of the present invention, a binding mechanism cartridge is attached to and detached from a binding device body instead of a stapler drive mechanism. The stapler drive mechanism includes a plate which shapes a staple in a C shape and which is movable upward and downward and a driver which hammers the staple formed in the C shape into the bundle of sheets and which is movable upward and downward. The binding mechanism cartridge includes a body portion, an upward-and-downward moving portion and a base portion. The body portion is detachably held by the binding device body at a storage position of the stapler drive mechanism. The upward-and-downward moving portion is arranged on the body portion so as to be movable upward and downward and moves close to or away from one surface of the bundle of sheets to be bound by moving upward and downward by interlocking with an upward-and-downward drive mechanism of the binding device body. The upward-and-downward drive mechanism moves the plate or the driver upward and downward. The base portion is arranged on the body portion so as to face the upward-and-downward moving portion and supports the other surface of the bundle of sheets. The upward-and-downward moving portion includes a binding mechanism. At least a part of the binding mechanism is in pressure contact with the one surface of the bundle of sheets according to a movement of the upward-and-downward moving portion. The binding mechanism binds the bundle of sheets without using a staple.

In the binding mechanism cartridge according to the present invention, the binding mechanism that binds a bundle of sheets without using a staple can be simply attached to the binding device body which a stapler driving mechanism can be attached to and detached from. Accordingly, by using the upward-and-downward moving mechanism of the binding device body which is installed to cause the plate or the driver to move upward and downward relative to the binding device body which the stapler drive mechanism can be attached to and detached from, the binding mechanism that binds a bundle of sheets without using a staple can be easily and newly added to the binding device body without adding improvement or the like to the drive mechanism or the like of the binding device body itself. A new binding mechanism can be simply added by setting the binding mechanism cartridge according to the present invention in the binding device body which can the stapler drive mechanism can be attached to and detached from.

In the binding mechanism cartridge according to the present invention, by preparing for a binding mechanism cartridge for each of plural binding mechanisms using different binding methods, the binding mechanisms using various binding methods can be simply selected and added by replacing the binding mechanism cartridge.

In comparison with a case in which plural binding mechanisms performing a binding process without using a staple are arranged in a sheet processing apparatus in which the binding device body is installed, it is possible to easily achieve a decrease in size of the sheet processing apparatus, a decrease in the number of components, and the like and thus to suppress an increase in size of the apparatus or an increase in cost.

In the binding mechanism cartridge according to the present invention, when a problem occurs in a binding function, the binding function can be simply recovered by replacing the binding mechanism cartridge itself. When a problem occurs in the binding mechanism not using a staple, it is not necessary to repair the binding device body or the like. Accordingly, it is possible to rapidly mount and recover a binding function not using a staple at a low cost.

In the binding mechanism cartridge according to the present invention, since the upward-and-downward moving portion and the binding mechanism can be caused to move close to and away from a bundle of sheets using the upward-and-downward moving mechanism of the binding device body, it is not necessary to provide the binding mechanism cartridge itself with a drive mechanism (for example, a motor) for driving the upward-and-downward moving portion and the binding mechanism. Accordingly, it is possible to simplify the structure of the binding mechanism cartridge and to achieve a decrease in cost of the binding mechanism cartridge.

In the binding mechanism cartridge, the body portion may include a longitudinal slide mechanism and a longitudinal slide regulating mechanism. The longitudinal slide mechanism adjusts a pressure contact position with the bundle of sheets in the binding mechanism in a state where the binding mechanism cartridge is detached from the binding device body, by causing the upward-and-downward moving portion and the base portion to slide so as to move close to and away from an edge of the bundle of sheets in a horizontal direction in which the bundle of sheets is guided to the base portion. The longitudinal slide regulating mechanism regulates sliding movements of the upward-and-downward moving portion and the base portion after the pressure contact position of the binding mechanism is adjusted by the longitudinal slide mechanism.

In the binding mechanism cartridge, the body portion may include a lateral slide mechanism and a lateral slide regulating mechanism. The lateral slide mechanism adjusts a pressure contact position with the bundle of sheets in the binding mechanism in a state where the binding mechanism cartridge is detached from the binding device body, by causing the upward-and-downward moving portion and the base portion to slide along an edge of the bundle of sheets in a horizontal direction in which the bundle of sheets is guided to the base portion. The lateral slide regulating mechanism regulates sliding movements of the upward-and-downward moving portion and the base portion after the pressure contact position of the binding mechanism is adjusted by the lateral slide mechanism.

The binding mechanism cartridge according to the present invention is provided with the longitudinal slide mechanism and the lateral slide mechanism that adjust a pressure contact position with the bundle of sheets in the binding mechanism in a state in which the binding mechanism cartridge is detached from the binding device body by causing the upward-and-downward moving portion and the base portion to slide so as to move close to and away from an edge of a bundle of sheets or along the edge of the bundle of sheets in a horizontal direction in which the bundle of sheets is guided, and the longitudinal slide regulating mechanism and the lateral slide regulating mechanism that regulate the sliding after the position of the binding mechanism is adjusted by the lateral slide mechanism.

In a bundle of sheets which has been subjected to a binding process using a binding mechanism not using a staple, for example, in a bundle of sheets which has been subjected to a binding process using the stitching method, a binding process using the half-blank binding method, or the like, when a binding hole due to a U-shaped cut or the like is formed close to the center of a sheet surface and away from an end of the bundle of sheets, a printable space on the sheet surface is narrowed and visibility of the sheet surface and convenience is likely to be damaged largely. On the other hand, when a binding hole due to a U-shaped cut is formed close to an end of a bundle of sheets, visibility of a sheet surface is likely to be secured but a binding force of the bundle of sheets is likely to be weakened due to the binding hole formed in an end portion of the bundle of sheets. Accordingly, in the binding process using the binding mechanism not using a staple, the binding force and convenience greatly depend on the binding position of the binding part (the position of the binding hole) on the bundle of the sheets.

Since the binding mechanism cartridge according to the present invention is provided with the longitudinal slide mechanism and the lateral slide mechanism that can adjust the pressure contact position in the binding mechanism in a state in which the slide mechanisms are detached from the binding device body, a user can easily adjust the pressure contact position of the binding mechanism while visually checking the pressure contact position. Accordingly, since the user can finely adjust the binding position by performing an operation, it is possible to set and adjust a binding hole to a binding position at which the user's desire for a binding force of a binding part, convenience, and the like is reflected.

In the binding mechanism cartridge, the body portion may include an angle adjusting mechanism and a rotation regulating mechanism. The angle adjusting mechanism adjusts an angle of the binding mechanism at a pressure contact position with the bundle of sheets in a state where the binding mechanism cartridge is detached from the binding device body, by causing the upward-and-downward moving portion and the base portion to rotate with respect to the bundle of sheets which is guided to the base portion. The rotation regulating mechanism regulates rotations of the upward-and-downward moving portion and the base portion after the angle of the binding mechanism is adjusted by the angle adjusting mechanism.

The binding mechanism cartridge according to the present invention is provided with the angle adjusting mechanism that adjusts an angle of the binding mechanism at a pressure contact position with the bundle of sheets in a state in which the binding mechanism cartridge is detached from the binding device body by causing the upward-and-downward moving portion and the base portion to rotate relative to the bundle of sheets which is guided to the base portion and the rotation regulating mechanism that regulates rotating of the upward-and-downward moving portion and the base portion after the angle of the binding mechanism is adjusted by the angle adjusting mechanism.

In a bundle of sheets which has been subjected to a binding process using a binding mechanism not using a staple, for example, in a bundle of sheets which has been subjected to a binding process using the stitching method, a binding process using the half-blank binding method, or the like, when a cutting direction of a U-shaped tip in a U-shaped cut is parallel to a sheet turning direction in the bundle of sheets, binding parts of the bundle of sheets are likely to be scattered to weaken the binding force of the bundle of sheets. On the other hand, when the cutting direction of a U-shaped tip in a U-shaped cut is perpendicular to the sheet turning direction in the bundle of sheets, binding parts of the bundle of sheets are not likely to be scattered to maintain the binding force of the bundle of sheets relatively strong. Accordingly, when the process of binding a bundle of sheets is performed without using a staple, the binding force of the bundle of sheets is likely to greatly vary depending on the difference in the binding angle about the bundle of sheets.

Since the binding mechanism cartridge according to the present invention is provided with the angle adjusting mechanism that adjusts the angle of the pressure contact position in the binding mechanism in a state in which the binding mechanism cartridge is detached from the binding device body, a user can easily adjust the angle of the pressure contact position in the binding mechanism while visually checking the pressure contact position. Accordingly, since the user can finely adjust the angle of the binding mechanism by performing an operation, it is possible to set and adjust a binding hole to a binding angle at which the user's desire for a binding force of a binding part and the like is reflected.

In the binding mechanism cartridge, the body portion may include two or more combinations of first, second and third combinations. The first combination includes a longitudinal slide mechanism and a longitudinal slide regulating mechanism. The longitudinal slide mechanism adjusts a pressure contact position with the bundle of sheets in the binding mechanism in a state where the binding mechanism cartridge is detached from the binding device body, by causing the upward-and-downward moving portion and the base portion to slide so as to move close to and away from an edge of the bundle of sheets in a horizontal direction in which the bundle of sheets is guided to the base portion. The longitudinal slide regulating mechanism regulates sliding movements of the upward-and-downward moving portion and the base portion after the pressure contact position of the binding mechanism is adjusted by the longitudinal slide mechanism. The second combination includes a lateral slide mechanism and a lateral slide regulating mechanism. The lateral slide mechanism adjusts a pressure contact position with the bundle of sheets in the binding mechanism in a state where the binding mechanism cartridge is detached from the binding device body, by causing the upward-and-downward moving portion and the base portion to slide along an edge of the bundle of sheets in a horizontal direction in which the bundle of sheets is guided to the base portion. The lateral slide regulating mechanism regulates sliding movements of the upward-and-downward moving portion and the base portion after the pressure contact position of the binding mechanism is adjusted by the lateral slide mechanism. The third combination includes an angle adjusting mechanism and a rotation regulating mechanism. The angle adjusting mechanism adjusts an angle of the binding mechanism at a pressure contact position with the bundle of sheets in a state where the binding mechanism cartridge is detached from the binding device body, by causing the upward-and-downward moving portion and the base portion to rotate with respect to the bundle of sheets which is guided to the base portion. The rotation regulating mechanism regulates rotations of the upward-and-downward moving portion and the base portion after the angle of the binding mechanism is adjusted by the angle adjusting mechanism.

As described above, even when two or more combinations of the combination including the longitudinal slide mechanism and the longitudinal slide regulating mechanism, the second combination including the lateral slide mechanism and the lateral slide regulating mechanism, and the third combination including the angle adjusting mechanism and the rotation regulating mechanism are provided, a user can easily adjust the pressure contact position of the binding mechanism or can easily adjust the angle of the pressure contact position in the binding mechanism while visually checking the pressure contact position in a state in which the binding mechanism cartridge according to the present invention is detached from the binding device body. Accordingly, since the user can finely adjust the binding position or the binding angle by performing an operation, it is possible to set and adjust a binding hole to a binding position and a binding angle at which the user's desire for a binding force of a binding part, convenience, and the like is reflected.

A binding device body according to the present invention detachably holds the above-mentioned binding mechanism cartridge. A sheet processing apparatus according to the present invention includes the above-mentioned binding device body.

Since the binding device body and the sheet processing apparatus according to the present invention include the above-mentioned binding mechanism cartridge, it is possible to exhibit the effects specified to the above-mentioned binding mechanism cartridge.

In the binding mechanism cartridge according to the present invention, the body portion is detachably held at the storage position of the staple cartridge, the body portion is provided with the upward-and-downward moving portion and the base portion, and the upward-and-downward moving portion is provided with the binding mechanism of which at least a part comes in pressure contact with one surface of the bundle of sheets and binds the bundle of sheets without using a staple. By constituting the binding mechanism cartridge in this way, the binding mechanism that binds a bundle of sheets without using a staple can be simply attached to the binding device body which a staple cartridge can be attached to and detached from. Accordingly, the binding mechanism that binds a bundle of sheets without using a staple can be easily and newly added to the binding device body without adding improvement or the like to the drive mechanism or the like of the binding device body itself. A new binding mechanism can be simply added by setting the binding mechanism cartridge according to the present invention in the binding device body.

For example, a binding mechanism using a stitching method, a binding mechanism using a half-blank binding method, and a binding mechanism using a concave-convex binding method are known as the binding mechanism not using a staple. Accordingly, by preparing for a binding mechanism cartridge for each of plural binding mechanisms using different binding methods, the binding mechanisms using various binding methods can be simply selected and added by replacing the binding mechanism cartridge.

In comparison with a case in which plural binding mechanisms performing a binding process without using a staple are arranged in a sheet processing apparatus in which the binding device body is installed, it is possible to easily achieve a decrease in size of the sheet processing apparatus, a decrease in the number of components, and the like and thus to suppress an increase in size of the apparatus or an increase in cost.

The binding function of binding a bundle of sheets without using a staple is embodied by operations of the upward-and-downward moving portion, the base portion, and the binding mechanism. Accordingly, when a problem occurs in any of the upward-and-downward moving portion, the base portion, and the binding mechanism, the binding function can be simply recovered by replacing the binding mechanism cartridge itself. When a problem occurs in the binding mechanism not using a staple, it is not necessary to repair the binding device body or the like. Accordingly, it is possible to rapidly mount and recover a binding function not using a staple at a low cost.

In the binding mechanism cartridge according to the present invention, the upward-and-downward moving portion which is provided with the binding mechanism is arranged to be movable upward and downward with respect to the body portion and moves close to and away from a bundle of sheets by interlocking with the driving of the binding device body. In this way, since the upward-and-downward moving portion and the binding mechanism can be caused to move close to and away from a bundle of sheets using the drive mechanism of the binding device body, it is not necessary to provide the binding mechanism cartridge itself with a drive mechanism (for example, a motor) for driving the upward-and-downward moving portion and the binding mechanism. Accordingly, it is possible to simplify the structure of the binding mechanism cartridge and to achieve a decrease in cost of the binding mechanism cartridge.

BRIEF DESCRIPTION OF THE DRAWINGS

FIGS. 10A to 10F are diagrams illustrating a state in which an angle is adjusted to 0 degrees by the angle adjusting mechanism in the binding mechanism cartridge illustrated in FIGS. 9A and 9B, a state in which the angle is adjusted to 45 degrees, and a state in which the angle is adjusted to 90 degrees.

FIGS. 25A and 25B are tables showing relationships when a controller of a sheet processing apparatus determines or changes the number of sheets to be bound or sets an amount of power supplied to a motor based on a difference in type of the binding mechanism cartridge.

DETAILED DESCRIPTION

Hereinafter, an example of a binding mechanism cartridge according to the present invention will be described in detail with reference to the accompanying drawings.

First Embodiment

Figure 1B:
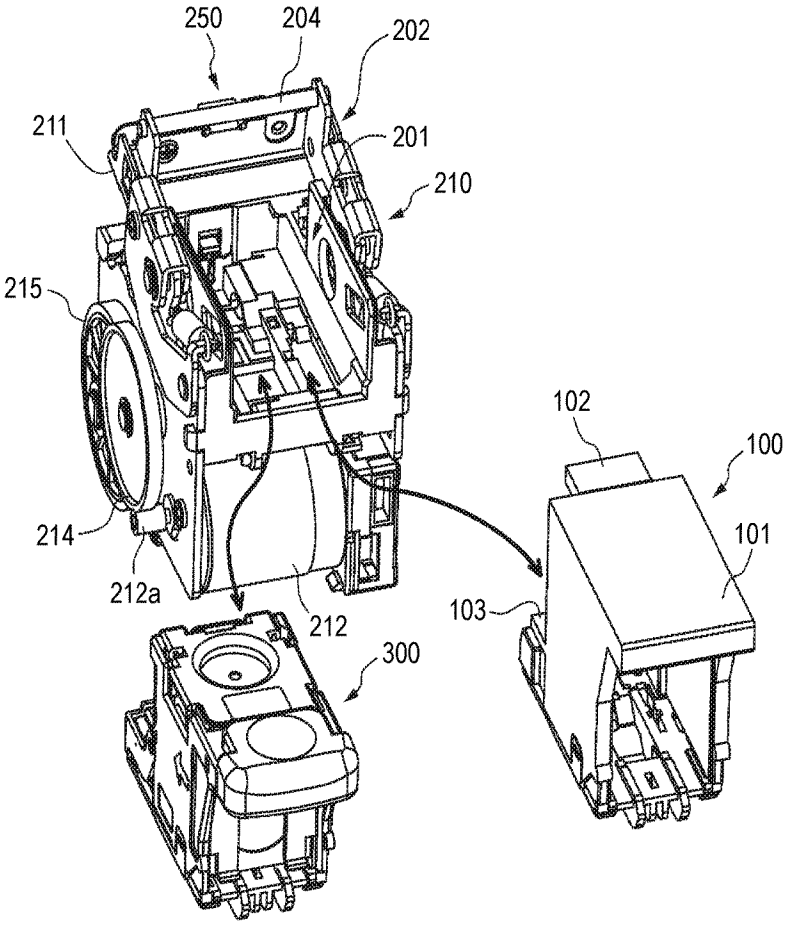
FIGS. 1A and 1B are diagrams illustrating a binding mechanism cartridge, a binding device body, and a staple cartridge according to a first embodiment of the present invention.
Figure 1A:
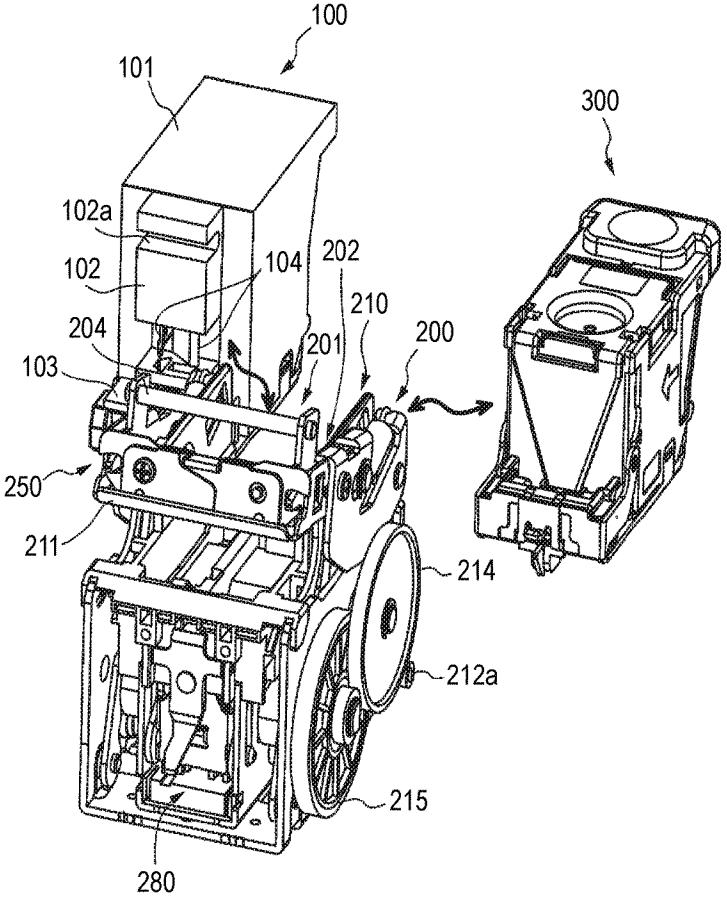

FIGS. 1A and 1B are perspective views illustrating a binding mechanism cartridge, a binding device body, and a stapler cartridge according to a first embodiment of the present invention. The binding device body 200 is generally installed in a sheet processing apparatus 10 (see FIGS. 24A to 24F) such as a business copier.

Binding Device

The binding device body 200 includes a motor 212, various gears 214 and 215 that are rotationally driven by interlocking with the motor 212, a stapler drive mechanism 280 that causes a plate and a driver to move upward and downward, a table moving mechanism 210 that causes a table portion 211 to move upward and downward by interlocking with the upward-and-downward movement of the plate and the driver by the stapler drive mechanism 280, and a clinching mechanism 250 that bends legs of a staple passing through a bundle of paper to the sheet surface of the bundle of sheets. The stapler drive mechanism 280, the table moving mechanism 210, and the clinching mechanism 250 correspond to the drive mechanism in the claims.

The structures of the drive mechanisms 210, 250, and 280 in the binding device body 200 and detailed drive methods thereof are disclosed in JP-A-2004-358977). Accordingly, in first to fourth embodiments, the drive mechanisms which are required for describing the operations of a binding mechanism cartridge will be described in brief.

A storage portion 201 is formed in the upper part of the binding device body 200. A storage space in which any one of a staple cartridge 300 and a binding mechanism cartridge 100 is detachably stored in the binding device body 200 is secured in the storage portion 201. The storage space is a space of which a rear-top surface and a central-top surface are opened as illustrated in FIG. 1B. By slidably inserting the staple cartridge 300 or the binding mechanism cartridge 100 into the storage space forward from the rear side, the staple cartridge 300 or the binding mechanism cartridge 100 can be stored in the storage portion 201.

Figure 2A:
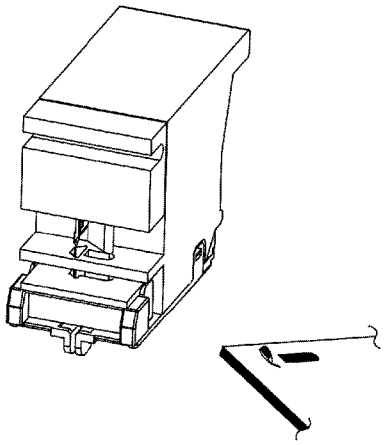
FIGS. 2A to 2E are perspective views of various types of binding mechanism cartridges and diagrams illustrating a binding state of a bundle of sheets subjected to a binding process.
Figure 2B:
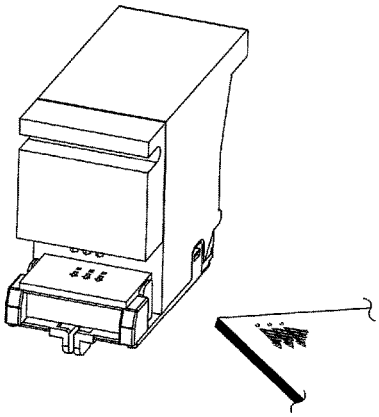
Figure 2C:
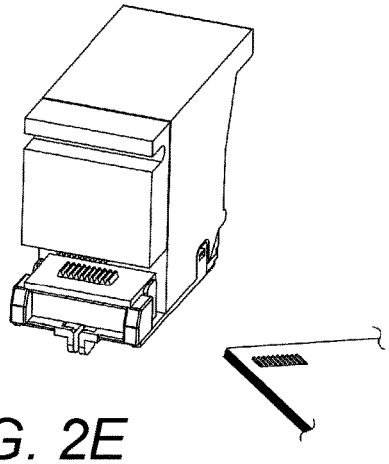
Figure 2D:
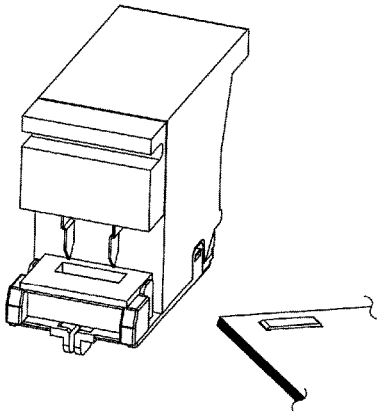
Figure 2E:
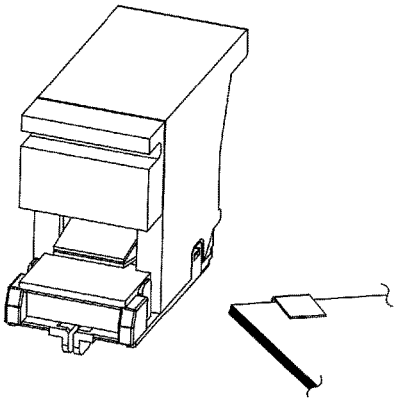

Plural types of binding mechanism cartridges 100 to be detachably stored in the binding device body 200 are prepared depending on methods of binding a bundle of sheets. For example, a binding mechanism cartridge performing a binding process using a stitching method as illustrated in FIG. 2A, a binding mechanism cartridge performing a binding process using a half-blank binding method as illustrated in FIG. 2B, a binding mechanism cartridge performing a binding process using a concave-convex binding method as illustrated in FIG. 2C, a binding mechanism cartridge performing a binding process using a paper needle binding method as illustrated in FIG. 2D, and a binding mechanism cartridge performing a binding process using a clip binding method using a clip as illustrated in FIG. 2E are prepared. In the first to fourth embodiments, a binding mechanism cartridge performing a binding process using a stitching method will be described as an example.

Figure 3A:
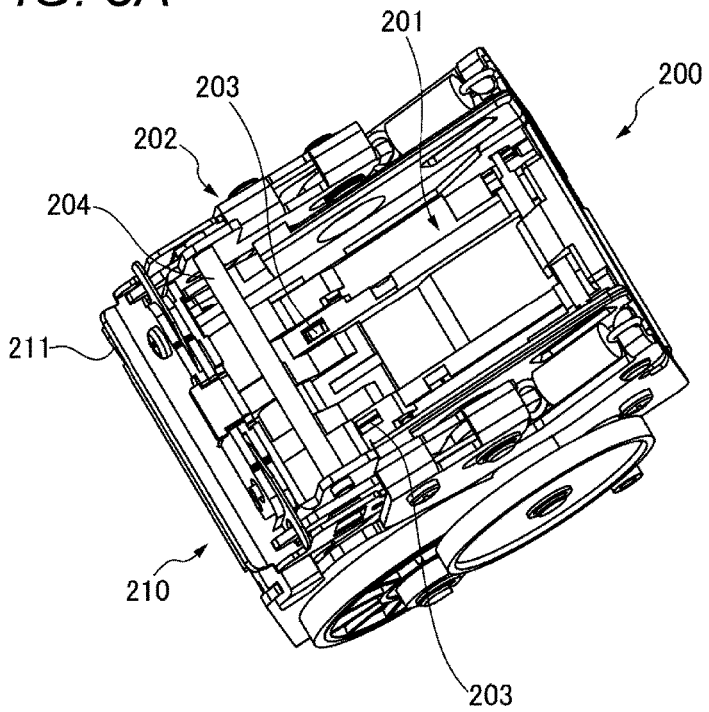
FIGS. 3A to 3C are diagrams illustrating rear surfaces of the binding device body, the staple cartridge, and the binding mechanism cartridge.
Figure 3B:
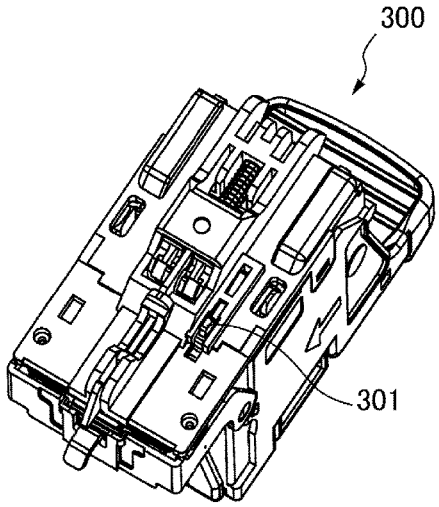
Figure 3C:
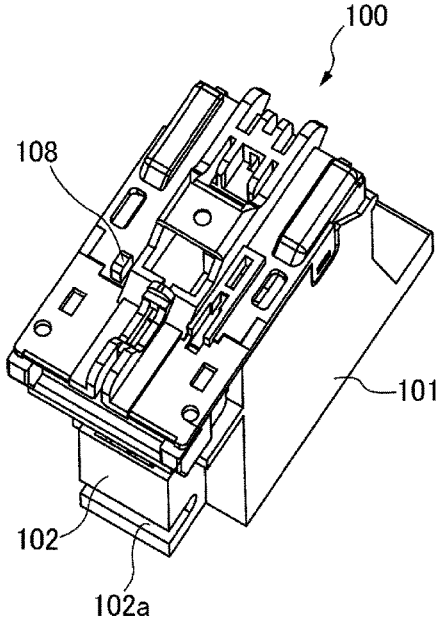

As illustrated in FIG. 3A, the bottom surface of the storage portion 201 is provided with a sensor 203 for identifying the type of the staple cartridge 300 or the binding mechanism cartridge 100 stored in the storage portion 201. As illustrated in FIGS. 3B and 3C, the bottom surface of the staple cartridge 300 and the bottom surface of the binding mechanism cartridge 100 are provided with protrusions 301 and 108. The protrusions are arranged at different positions depending on the types of the staple cartridge 300 and the binding mechanism cartridge 100.

The binding device body 200 determines the type of the stored cartridge by determining the position of the protrusion 301 or 108 using the sensor 203 in a state in which the staple cartridge 300 or the binding mechanism cartridge 100 is stored. The sensor 203 for detecting the positions of the protrusions 301 and 108 may have a structure for detecting the presence of the protrusion 301 or 108 using an optical sensor or may have a structure in which recesses corresponding to the positions of the protrusions 301 and 108 are formed on the bottom surface of the storage portion 201 and the position of the recess into which the protrusion 301 or 108 is inserted is detected using the sensor 203.

In front of the top portion of the binding device body 200, a C-shaped arm portion 202 which has a C shape when viewed from the upside and which can cause the front portion thereof to swing vertically is provided. When the C-shaped arm portion 202 swings, the front end of the C-shaped arm portion 202 moves close to or away from a bundle of sheets. The front end of the C-shaped arm portion 202 moving close to the bundle of sheets serves as a table portion 211 of the table moving mechanism 210. The front end of the C-shaped arm portion 202 can be provided with a clincher 270 (see FIGS. 14A to 14F) that bends legs of a staple protruding from the table portion 211 in a state in which the front end is located close to the bundle of sheets.

The C-shaped arm portion 202 is provided with a connecting shaft 204 bridging both right and left arm pieces. When the C-shaped arm portion 202 swings vertically, the connecting shaft 204 also moves upward and downward.

The clinching mechanism 250 having the clincher 270 installed therein will be described in the second embodiment. In the first to fourth embodiments, for the purpose of convenience of explanation, the direction in which the binding mechanism cartridge 100 slides into and slides from the storage portion 201 of the binding device body 200 is defined as a longitudinal direction, the width direction of the binding device body 200 is defined as a lateral direction, and the upward and downward movement direction of the table portion 211 is defined as a vertical direction.

Table Moving Mechanism

The table moving mechanism 210 in the binding device body 200 will be described below. The table moving mechanism 210 serves as a mechanism for interposing a bundle of sheets by causing the C-shaped arm portion 202 serving as the table portion 211 to move upward and downward as described above. The table moving mechanism 210 including the connecting shaft 204 may correspond to the upward-and-downward drive mechanism in the claims. The binding mechanism cartridge is driven by a movement of the table moving mechanism 210.

Figure 4A:
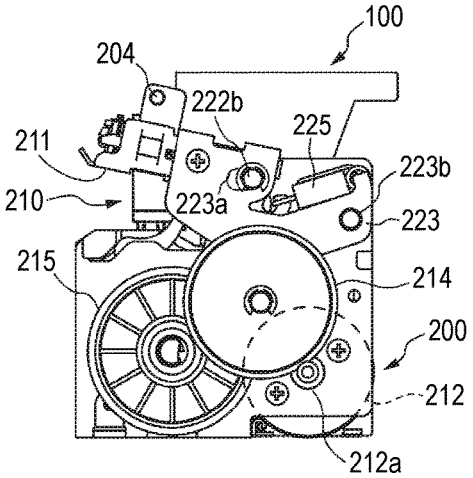
FIGS. 4A to 4D are diagrams schematically illustrating configurations of a motor and various gears of the binding device body according to the first embodiment.
Figure 4B:
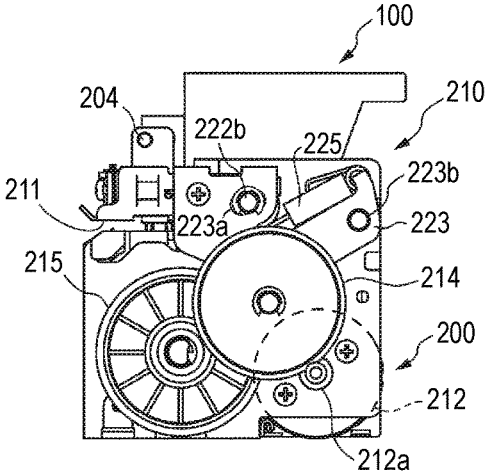

FIGS. 4A and 4B are diagrams schematically illustrating configurations of the motor 212 and various gears 214 and 215 in the binding device body 200. FIG. 4A illustrates a state in which the table portion 211 moves upward and FIG. 4B illustrates a state in which the table portion 211 moves downward by driving of the motor 212.

The binding device body 200 is provided with the motor 212 which is driven under the control of the sheet processing apparatus 10. An output shaft 212*a* of the motor 212 engages with a reduction gear 214 and the reduction gear 214 rotates with the driving of the motor 212. A drive shaft of the reduction gear 214 is provided with a small-diameter gear not illustrated and the small-diameter gear engages with a drive gear 215. Accordingly, when the reduction gear 214 rotates by interlocking with the motor 212, the small-diameter gear rotates by interlocking with the reduction ear 214 and thus the drive gear 215 rotates.

Figure 4C:
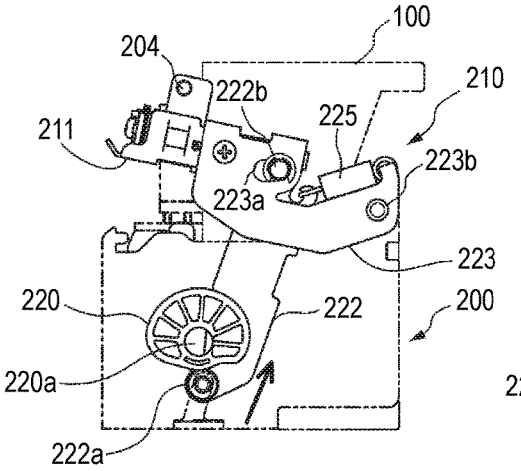
Figure 4D:
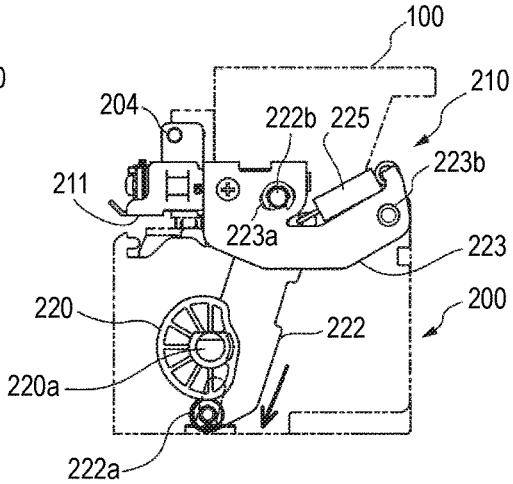
Figure 5B:
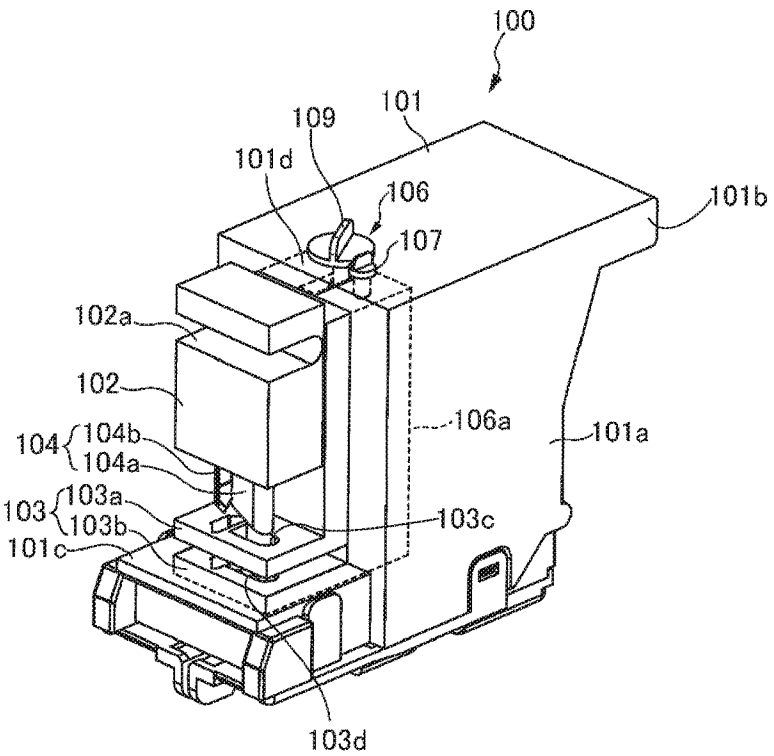
FIGS. 5A and 5B are perspective views illustrating the binding mechanism cartridge including a longitudinal slide mechanism unit.
Figure 5A:
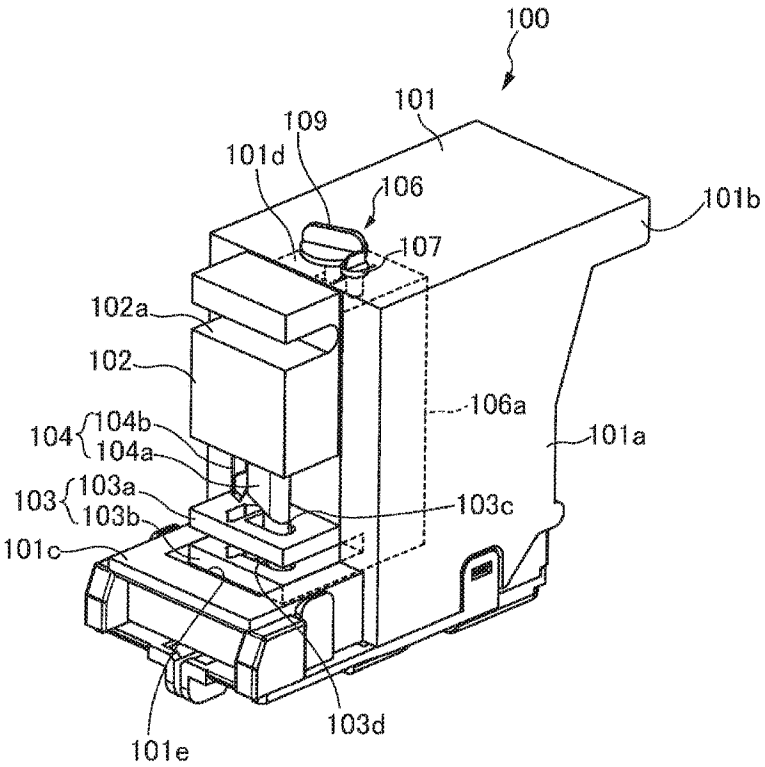

FIGS. 4C and 4D are diagrams schematically illustrating configurations of the table moving mechanisms in the binding device body 200. FIG. 4C illustrates a state in which the table portion 211 moves upward and FIG. 4D illustrates a state in which the table portion 211 moves downward by driving of the motor 212.

The table moving mechanism 210 includes a table drive cam 220, a first table link 222, a second table link 223, and a thickness adjusting spring 225. The table drive cam 220 is formed of a different-diameter disc having a substantially elliptical shape and a rotation shaft 220*a* is installed at a position biased close to the outside from the center of the different-diameter disc. The rotation shaft 220*a* is configured to rotate with the rotation of the drive gear 215. The first table link 222 is configured to reciprocate in a substantially vertical direction indicated by an arrow and to come in contact with the outer circumference of the table drive cam 220 via a roller 222*a* of a protrusion shaft formed at a lower end. A protrusion shaft 222*b* is formed at an upper end of the first table link 222 and the protrusion shaft 222*b* is inserted into a long hole 223*a* formed at the substantially central position of the second table link 223 to engage therewith.

The second table link 223 serves as a part of one side in the C-shaped arm portion 202. The second table link 223 is pivotally supported by the drive shaft 223*b* at a rear end thereof and can cause a front end thereof to swing about the drive shaft 223*b*. One end of the thickness adjusting spring 225 is connected to a position close to the top of the rear end of the second table link 223. The other end of the thickness adjusting spring 225 is connected to the upper end of the first table link 222 and the first table link 222 is elastically supported obliquely upward to the rear side by the thickness adjusting spring 225.

As described above, the first table link 222 is configured to reciprocate in the substantially vertical direction indicated by the arrow and the upper end of the first table link 222 is elastically supported obliquely upward to the rear side by the thickness adjusting spring 225. Accordingly, the first table link 222 moves upward and downward depending on the contact state between the table drive cam 220 and the roller 222*a*. On the other hand, the upper end of the first table link 222 engages with the second table link 223 at the substantially central position thereof by inserting the protrusion shaft 222*b* into the long hole 223*a*. Accordingly, depending on the contact state between the table drive cam 220 and the roller 222*a*, the front end of the second table link 223 is pushed upward when the first table link 222 moves upward, and the front end of the second table link 223 is pushed down when the first table link 222 moves downward.

Here, the second table link 223 serves as a part of one side arm of the C-shaped arm portion 202. Accordingly, when the front end of the second table link 223 is pushed down to move downward, the table portion 211 of the binding device body 200 is pushed down to move downward as illustrated in FIGS. 4B and 4D. When the front end of the second table link 223 is pushed up to move upward, the table portion 211 of the binding device body 200 is pushed up to move upward as illustrated in FIGS. 4A and 4C. In this way, since the first table link 222 moves vertically by interlocking with the table drive cam 220 and the front end of the second table link 223 moves vertically by interlocking with the first table link 222, the table portion 211 moves upward and downward.

Binding Mechanism Cartridge Including Longitudinal Slide Mechanism

FIGS. 5A and 5B and FIGS. 6A to 6F are diagrams illustrating an example of the binding mechanism cartridge performing a binding process using a stitching method. FIG. 5A and FIGS. 6A, 6C, and 6E illustrate a state in which a binding edge of the binding mechanism cartridge is located on the rear side, and FIG. 5B and FIGS. 6B, 6D, and 6F illustrate a state in which the binding edge of the binding mechanism cartridge is located on the front side.

The binding mechanism cartridge 100 according to the first embodiment has a configuration for causing a binding edge for stitching to slide in the longitudinal direction. The binding mechanism cartridge 100 includes a body portion 101, an upward-and-downward moving portion 102, a base portion 103, a binding portion (binding edge) 104, a longitudinal slide mechanism unit 106, and a binding position fixing screw 107.

The body portion 101 approximately includes a base 101*a* having a substantially rectangular parallelepiped shape, a gripping portion 101*b* protruding rearward from the rear top portion, and a base support portion 101*c* protruding forward from the front bottom. The outer width of the base portion 101*a* is set to a size corresponding to the inner width of the storage portion 201 in the binding device body 200, and the body portion 101 is held by the storage portion 201 when the base 101*a* is inserted into the storage portion 201. When a user grips the grip portion 101*b* and pulls the body portion 101 in the state in which the body portion 101 is held by the storage portion 201, the binding mechanism cartridge 100 can be simply detached from the binding device body 200.

The base support portion 101*c* is arranged to support the base portion 103 from the bottom side. When the body portion 101 is stored in the storage portion 201, the base support portion 101*c* is arranged at a position above the installation positions of the plate and the driver which are caused to move upward and downward by the stapler drive mechanism 280 and at a position below the table portion 211 which is driven to move upward and downward by the table moving mechanism 210.

The front surface of the body portion 101 is provided with the longitudinal slide mechanism unit 106. The longitudinal slide mechanism unit 106 includes a longitudinal slide body portion 106*a* having a box shape, and the base portion 103 is integrally formed in the front bottom of the longitudinal slide body portion 106*a*. As illustrated in FIGS. 6C and 6D, in the base 101*a* of the body portion 101, a storage space 101*s* which can store the rear part of the longitudinal slide body portion 106*a* so as to be slidable in the longitudinal direction is formed. An adjustment hole through which a binding position adjusting screw 109 is rotatably inserted is formed to penetrate a ceiling surface 101*d* of the body portion 101 (a ceiling surface of the storage space).

Figure 6A:
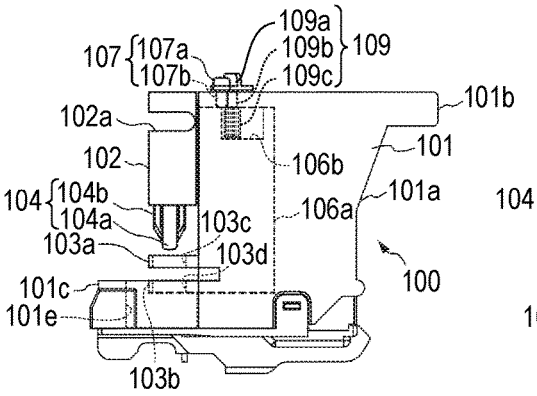
FIGS. 6A to 6F are diagrams illustrating a state in which the longitudinal slide mechanism slides forward in the binding mechanism cartridge illustrated in FIGS. 5A and 5B and a state in which the longitudinal slide mechanism slides backward.
Figure 6B:
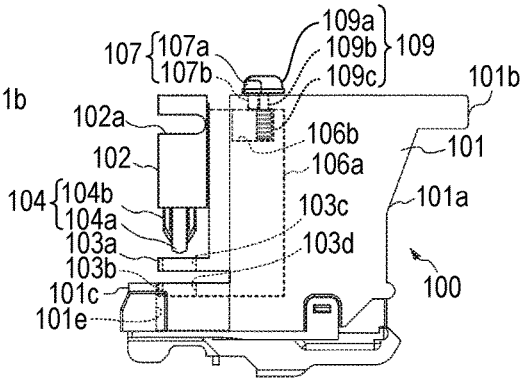
Figure 6C:
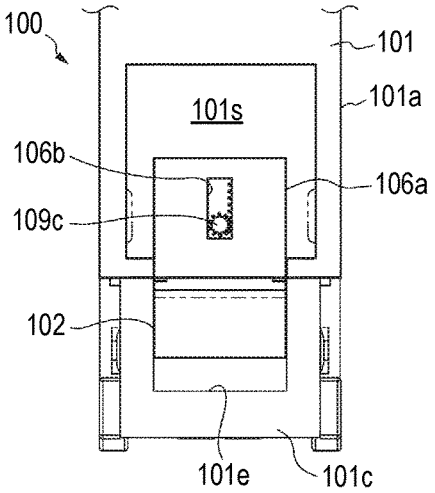
Figure 6D:
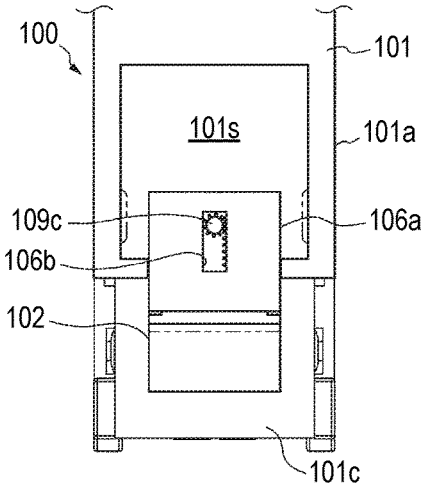
Figure 6E:
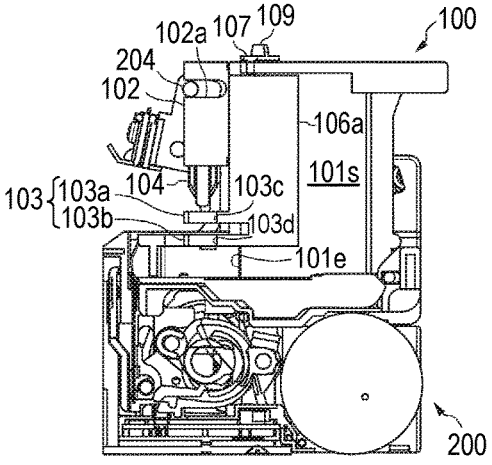
Figure 6F:
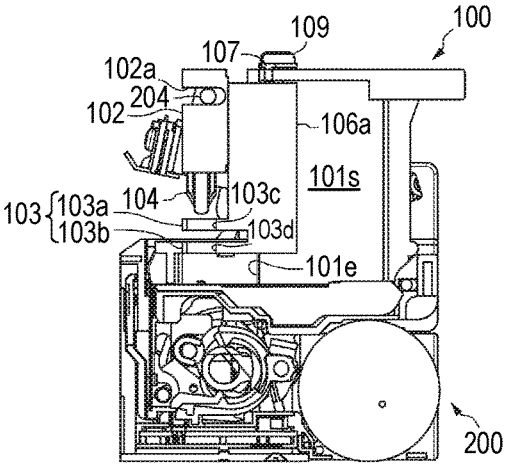
Figure 7B:
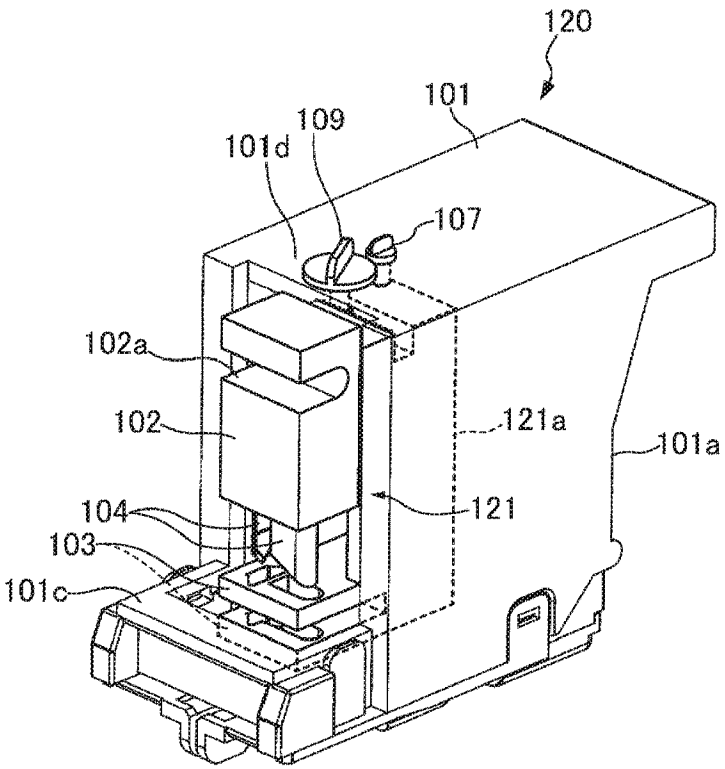
FIGS. 7A and 7B are perspective views illustrating the binding mechanism cartridge including a lateral slide mechanism unit.
Figure 7A:
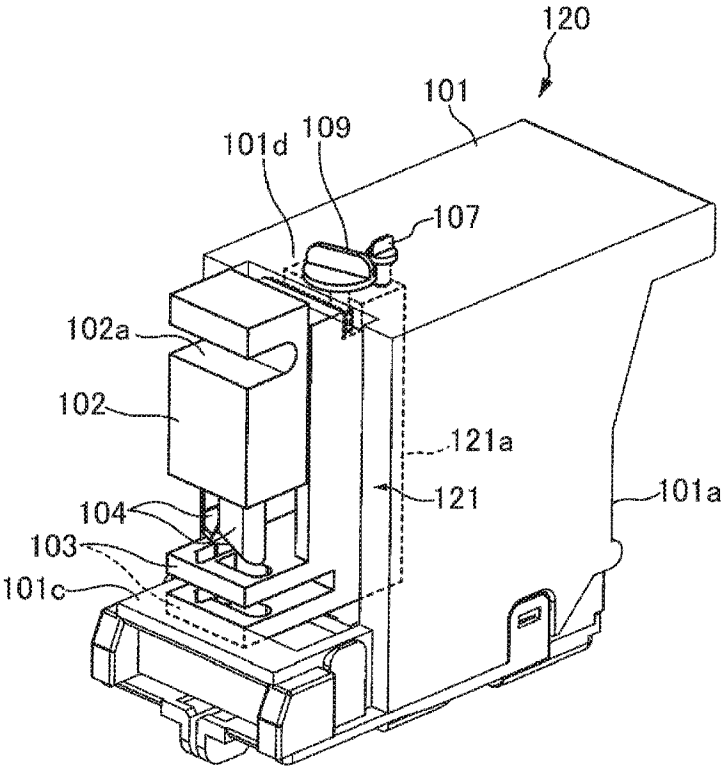

As illustrated in FIGS. 6A and 6B, the binding position adjusting screw 109 includes a head 109*a* having a grip formed thereon, a neck 109*b* having a height corresponding to the depth in the adjustment hole (the volume of the hole), and a tip 109*c* extending downward from the neck and having a pinion gear formed on the outer circumference thereof, which are integrally formed with each other.

A recessed portion 106*b* is formed on the top surface of the longitudinal slide body portion 106*a* facing the opening of the adjustment hole in a state in which the longitudinal slide body portion 106*a* is stored in the storage space 101*s*. A rack engaging with the pinion gear of the binding position adjusting screw 109 is formed on the side surface of the recessed portion 106*b*. The lateral width of the recessed portion 106*b* is set to a size in which the tip 109*c* of the binding position adjusting screw 109 engaging with the rack can be stored and rotated. The longitudinal size of the recessed portion 106*b* is set to a size corresponding to a sliding distance of the longitudinal slide body portion 106*a*.

The binding position adjusting screw 109 is attached to the base 101*a* of the body portion 101 such that the neck 109*b* is located at the adjustment hole in a state in which the longitudinal slide body portion 106*a* is stored in the storage space 101*s*. By attaching the binding position adjusting screw 109 in this way, a user can hold the grip and freely rotate the binding position adjusting screw 109 rightward and leftward. By causing the user to rotate the grip to rotate the binding position adjusting screw 109, the rack engaging with the pinion gear of the tip 109*c* is extruded in the longitudinal direction. Accordingly, the longitudinal slide body portion 106*a* can be caused to slide in the longitudinal direction so as to move close to and away from an edge of a bundle of sheets with the rotational operation of the grip.

A fixing hole into which the binding position fixing screw 107 is screwed is formed in the vicinity of the adjustment hole on the ceiling surface 101*d* of the storage space 101*s*. The binding position fixing screw 107 includes a head 107*a* having a grip formed therein and a screw portion 107*b* which is screwed to a screw groove in the fixing hole. By causing a user to rotate the grip to rotate the binding position fixing screw 107, the tip of the screw portion 107*b* can be brought into contact with the top surface of the longitudinal slide body portion 106*a* or can be retreated from the contact state. In this way, since the longitudinal sliding of the longitudinal slide body portion 106*a* can be regulated by the binding position fixing screw 107 and the fixing hole, a longitudinal slide regulating unit is constituted by the binding position fixing screw 107 and the fixing hole.

By retreating the tip of the screw portion 107*b* of the binding position fixing screw 107 from the contact with the longitudinal slide body portion 106*a*, the regulation by the longitudinal slide regulating unit is released. By causing the user to rotate the binding position adjusting screw 109 in the state in which the regulation is released, it is possible to adjust the sliding distance in the longitudinal direction of the longitudinal slide body portion 106*a*. After the sliding distance in the longitudinal direction of the longitudinal slide body portion 106*a* is adjusted, the user rotates the binding position fixing screw 107 to bring the tip of the screw portion 107*b* into contact with the top surface of the longitudinal slide body portion 106*a*, thereby performing the regulation by the longitudinal slide regulating unit. By regulating the sliding of the longitudinal slide body portion 106*a* using the longitudinal slide regulating unit, it is possible to fix the sliding position of the longitudinal slide body portion 106*a*.

The base portion 103 includes two plate-like members 103*a* and 103*b* which are installed to be horizontal. The two plate-like members 103*a* and 103*b* are installed in the front lower part of the longitudinal slide body portion 106*a*. A bundle of sheets to be bound is inserted between the two plate-like members 103 and 103*b*. When a bundle of sheets is inserted between the two plate-like members 103*a* and 103*b*, the bundle of sheets is supported from the bottom surface by the lower plate-like member 103*b* of the base portion 103.

Openings 103*c* and 103*d* for allowing the binding portion (binding edge) 104 to move upward and downward are formed in the upper and lower plate-like members 103*a* and 103*b*, respectively. A recessed portion 101*e* having a depth in which the tip of the binding edge 104 passing through the opening 103*d* of the lower plate-like member 103*b* can be stored and a length in the longitudinal direction corresponding to the sliding distance of the longitudinal slide body portion 106*a* is formed in the base support portion 101*c* located below the base portion 103. Accordingly, even when the base portion 103 moves in the longitudinal direction with the sliding of the longitudinal slide body portion 106*a*, a space having a depth in which the tip of the binding edge 104 can be stored is secured below the base portion 103 by the recessed portion 101*e*.

The upward-and-downward moving portion 102 has a substantially box shape and is arranged on the front side of the longitudinal slide body portion 106*a* so as to be movable upward and downward. More specifically, the upward-and-downward moving portion 102 is attached to the longitudinal slide body portion 106*a* so as to be movable upward and downward by a slide mechanism such as a rail not illustrated. The slide mechanism is provided with an elastic support member such as a spring and the upward-and-downward moving portion 102 is maintained in a state in which the upward-and-downward moving portion is elastically supported to be located on the front top of the longitudinal slide body portion 106*a* by the elastic support member.

A drive connecting portion 102*a* engaging with the connecting shaft 204 formed in the C-shaped arm portion 202 is formed in the upper part of the upward-and-downward moving portion 102. The drive connecting portion 102*a* is a concave groove formed in a lateral tube shape and has a C shape in a side view. When the binding mechanism cartridge 100 is stored in the storage portion 201 of the binding device body 200, the connecting shaft 204 passes through the front opening of the concave groove and is guided into the drive connecting portion 102*a*. The drive connecting portion 102*a* is formed by the concave groove having a C shape in a side view. Accordingly, when the connecting shaft 204 is guided into the drive connecting portion 102*a*, the top surface or the bottom surface of the drive connecting portion 102*a* (the concave groove) can come in contact with the connecting shaft 204. Accordingly, when the connecting shaft moves upward and downward in the vertical direction in a state in which the connecting shaft engages with the drive connecting portion 102*a*, the upward-and-downward moving portion 102 also moves upward and downward in the vertical direction.

The binding portion 104 is formed on the bottom surface of the upward-and-downward moving portion 102. The binding portion 104 approximately includes two binding edges of a cutting edge 104*a* and a drawing edge 104*b* for stitching. The cutting edge 104*a* and the drawing edge 104*b* are attached to the bottom surface of the upward-and-downward moving portion 102 such that the edges face the downside. The cutting edge 104*a* serves to pass through a bundle of sheets to cut a part of the bundle of sheets in a U shape and to bend a sheet piece cut out in the U shape to the drawing edge 104*b* side. On the other hand, the drawing edge 104*b* serves to make an I-shaped cut at a position in the vicinity of a base (a part in which the U-shaped sheet piece is not cut) of the sheet piece cut in the U shape and to hook the tip part (tongue part) of the U-shaped sheet piece bent to the drawing edge 104*b* by the cutting edge 104*a* to the edge tip. The drawing edge 104*b* also serves to guide the tip of the sheet piece hooked on the edge tip to the I-shaped cut and to draw the tip of the sheet piece from the rear surface to the front surface of the bundle of sheets.

Operation of Binding Mechanism Cartridge

When the binding mechanism cartridge 100 is attached to the binding device body 200, the binding device body 200 determines the type of the binding mechanism cartridge 100 based on the protrusion 108 formed on the bottom surface of the binding mechanism cartridge 100 and transmits the determination result to the controller (CPU) of the sheet processing apparatus 10 in which the binding device body 200 is installed. In the sheet processing apparatus 10, when it is detected that a bundle of sheets is inserted into the base portion 103 (more specifically, between two plate-like members 103*a* and 103*b* in the base portion 103) of the binding mechanism cartridge 100, the rotational driving of the motor 212 of the binding device body 200 is controlled.

When the motor 212 is rotationally driven, the table drive cam 220 rotates with the rotational driving of the motor 212, and the first table link 222 moves substantially downward via the roller 222*a* coming in contact with the outer circumference of the table drive cam 220. When the first table link 222 moves substantially downward, the second table link 223 engaging with the first table link 222 performs an operation of pushing down the front end with the drive shaft 223*b* as a rotation shaft based on the transmitted type of the binding mechanism cartridge 100. The second table link 223 serves as a part of one side arm of the C-shaped arm portion 202. Accordingly, when the front end of the second table link 223 is pushed down, as illustrated in FIGS. 4B and 4D, the connecting shaft 204 of the C-shaped arm portion 202 is pushed and the upward-and-downward moving portion 102 of the binding mechanism cartridge 100 is pushed down to move downward via the drive connecting portion 102*a* engaging with the connecting shaft 204.

When upward-and-downward moving portion 102 moves downward, the cutting edge 104*a* and the drawing edge 104*b* installed on the bottom surface of the upward-and-downward moving portion 102 also move downward to the bundle of sheets interposed between the two plate-like members 103*a* and 103*b* of the base portion 103. The openings 103*c* and 103*d* for causing the cutting edge 104*a* and the drawing edge 104*b* to move upward and downward are formed in the two plate-like members 103*a* and 103*b*. Accordingly, when the upward-and-downward moving portion 102 moves downward, the cutting edge 104*a* and the drawing edge 104*b* passes through the bundle of sheets via the openings 103*c* and 103*d*, and the bottom surface of the upward-and-downward moving portion 102 comes in contact with the top surface of the upper plate-like member 103*a*. In this way, by causing the cutting edge 104*a* and the drawing edge 104*b* to penetrate the bundle of sheets, the bundle of sheets is cut out in a U shape, the I-shaped cut is formed, and the tip of the U-shaped paper piece bent by the cutting edge 104*a* is hooked on the edge tip of the drawing edge 104*b*.

Thereafter, the table drive cam 220 rotates with the rotational driving of the motor 212 and the front end of the second table link 223 is pushed up with the upward movement of the first table link 222. In this way, since the front end of the second table link 223 is pushed up, the upward-and-downward moving portion 102 is also pushed up move upward as illustrated in FIGS. 4A and 4C. When the upward-and-downward moving portion 102 moves upward, the cutting edge 104*a* and the drawing edge 104*b* are drawn out of the bundle of sheets, the tip of the U-shaped sheet piece is drawn from the rear side to the front side in the I-shaped cut, and the bundle of sheets is bound by the Y-shaped sheet piece. Accordingly, it is possible to bind a bundle of sheets using stitching without using a staple by employing the binding mechanism cartridge 100 provided with the cutting edge 104*a* and the drawing edge 104*b*.

As described above, in the binding mechanism cartridge 100 according to the first embodiment, the body portion 101 is detachably held in the storage portion 201 of the binding device body 200, the upward-and-downward moving portion 102 and the base portion 103 are formed in the body portion 101, and the binding portion 104 for binding a bundle of sheets without using a staple is formed in the upward-and-downward moving portion 102. By constructing the binding mechanism cartridge 100 in this way, a binding mechanism that binds a bundle of sheets without using a staple can be simply attached to the binding device body 200 which the staple cartridge 300 can be attached to and detached from. Accordingly, a binding mechanism that binds a bundle of sheets without using a staple can be easily and newly added to the binding device body 200 that performs a binding process using a staple without adding improvement or the like to the drive mechanism or the like (the stapler drive mechanism 280, the table moving mechanism 210, and the clinching mechanism) of the binding device body 200. Various types of binding mechanisms such as the binding mechanism using the stitching method, a binding mechanism using a half-blank binding method, and a binding mechanism using a concave-convex binding method can be simply added by setting the binding mechanism cartridge 100 according to the first embodiment in the binding device body 200.

A binding mechanism that binds a bundle of sheets without using a staple can be simply added by attachment and detachment of the binding mechanism cartridge 100. Accordingly, in comparison with a case in which plural types of binding mechanisms which are different depending on the binding mechanisms are arranged in the sheet processing apparatus 10, it is possible to easily achieve a decrease in size of the sheet processing apparatus 10, a decrease in the number of components, and the like and thus to suppress an increase in size of the apparatus or an increase in cost.

The binding function not using a staple is embodied by operations of the upward-and-downward moving portion 102, the base portion 103, and the binding portion (the binding edge) 104 in the binding mechanism cartridge 100. Accordingly, when a problem occurs in any of the upward-and-downward moving portion 102, the base portion 103, and the binding portion 104, the binding function can be simply recovered by replacing the binding mechanism cartridge 100 itself. When a problem occurs in the binding mechanism not using a staple, it is not necessary to repair the binding device body 200 or the like. Accordingly, it is possible to rapidly recover a binding function not using a staple at a low cost.

In the binding mechanism cartridge 100 according to the first embodiment, the upward-and-downward moving portion 102 which is provided with the binding portion 104 is arranged to be movable upward and downward so as to move close to and away from a bundle of sheets by interlocking with the table moving mechanism 210 of the binding device body 200. In this way, since the upward-and-downward moving portion 102 and the binding portion 104 can be caused to move upward and downward using the table moving mechanism 210 of the binding device body 200, it is not necessary to provide the binding mechanism cartridge 100 itself with a motor for driving the upward-and-downward moving portion 102 and the binding portion 104. Accordingly, it is possible to simplify the structure of the binding mechanism cartridge 100 and to achieve a decrease in cost of the binding mechanism cartridge 100.

In the binding mechanism cartridge 100 according to the first embodiment, the sliding distance in the longitudinal direction of the upward-and-downward moving portion 102 and the base portion 103 can be adjusted by the longitudinal slide mechanism unit 106. Accordingly, by causing a user to rotate the grip of the binding position adjusting screw 109 to adjust the position of the binding edge of the binding portion 104 in the longitudinal direction in a state in which the binding mechanism cartridge 100 is detached from the binding device body 200, the user can easily adjust a position at which the binding edge penetrates the bundle of sheets while visually checking the position.

In a bundle of sheets which has been subjected to a binding process using a binding mechanism not using a staple, for example, in a bundle of sheets which has been subjected to a binding process using the stitching method, a binding process using the half-blank binding method, or the like, when a U-shaped cut is formed close to the center of a sheet surface and away from an end of the bundle of sheets, a printable space on the sheet surface is narrowed and visibility of the sheet surface and convenience is likely to be damaged largely. On the other hand, when a U-shaped cut is formed close to an end of a bundle of sheets, visibility of a sheet surface is likely to be secured but a binding force of the bundle of sheets is likely to be weakened due to the binding hole formed in an end portion of the bundle of sheets by the cutting. Accordingly, in the binding process using the binding method not using a staple, the binding force and convenience greatly depend on the binding position of the binding part on the bundle of the sheets.

In the binding mechanism cartridge 100 according to the first embodiment, by causing a user to rotate the grip of the binding position adjusting screw 109 to adjust the position of the binding edge of the binding portion 104 in the longitudinal direction, the user can easily adjust the sliding distance while visually checking the position penetrated by the binding edge. Accordingly, since the user can finely adjust the binding position by performing an operation, it is possible to set and adjust the position of the bundle of sheets penetrated by the binding edge to a binding position at which the user's desire for a binding force of a binding part, convenience, and the like is reflected.

While the binding mechanism cartridge 100 including the longitudinal slide mechanism unit 106 has been described above, the slide mechanism unit of the binding mechanism cartridge 100 according to this embodiment is not limited to the longitudinal slide mechanism.

Binding Mechanism Cartridge Including Lateral Slide Mechanism

FIGS. 7A and 7B and FIGS. 8A to 8F are diagrams schematically illustrating a configuration of a binding mechanism cartridge including a lateral slide mechanism that causes a binding edge to slide in the lateral direction. FIG. 7A and FIGS. 8A, 8C, and 8E illustrate a state in which the binding edge of the binding mechanism cartridge is located on the left side, and FIG. 7B and FIGS. 8B, 8D, and 8F illustrate a state in which the binding edge of the binding mechanism cartridge is located on the right side. The binding portions using various binding methods can be formed in the binding mechanism cartridge including the lateral slide mechanism, but FIGS. 7A and 7B and FIGS. 8A to 8F illustrate the binding mechanism cartridge including a binding mechanism using a stitching method as an example.

A binding mechanism cartridge 120 includes a body portion 101, an upward-and-downward moving portion 102, a base portion 103, a binding portion 104, a lateral slide mechanism unit 121, and a lateral slide regulating unit. The body portion 101, the upward-and-downward moving portion 102, the base portion 103, and the binding portion 104 have the same configurations as those in the binding mechanism cartridge 100 including the longitudinal slide mechanism unit 106, thus the same reference numerals will be used, and description thereof will not be repeated herein. The same fixing screw as the binding position fixing screw 107 is used for the lateral slide regulating unit. Accordingly, description of the binding position fixing screw 107 in the longitudinal slide regulating unit will not be repeated herein.

Figure 8A:
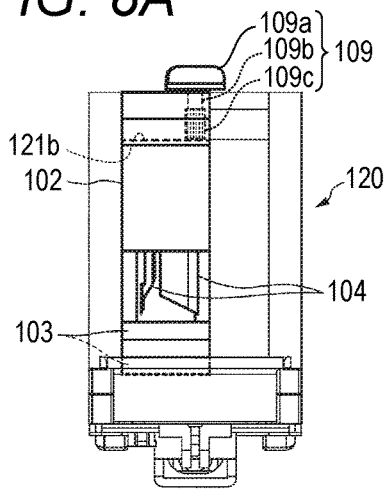
FIGS. 8A to 8F are diagrams illustrating a state in which the lateral slide mechanism slides forward in the binding mechanism cartridge illustrated in FIGS. 5A and 5B and a state in which the lateral slide mechanism slides backward.
Figure 8B:
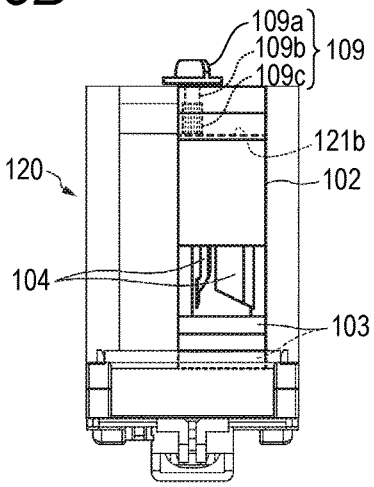
Figure 8C:
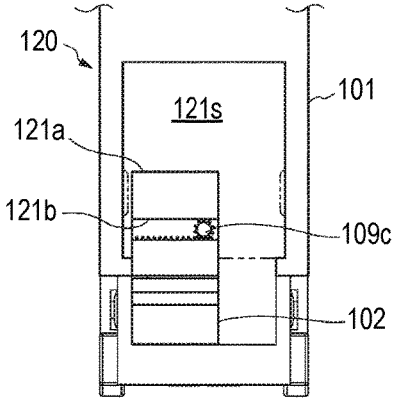
Figure 8D:
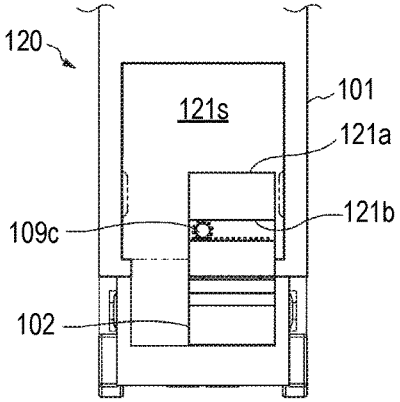
Figure 8E:
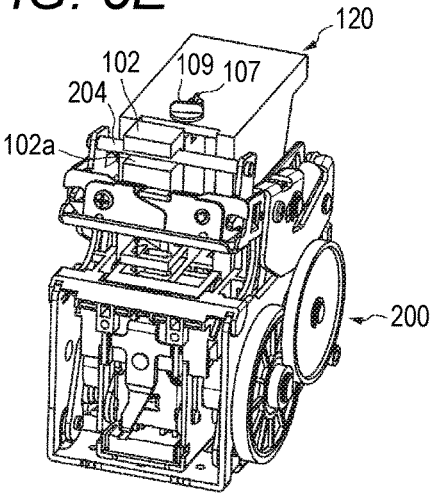
Figure 8F:
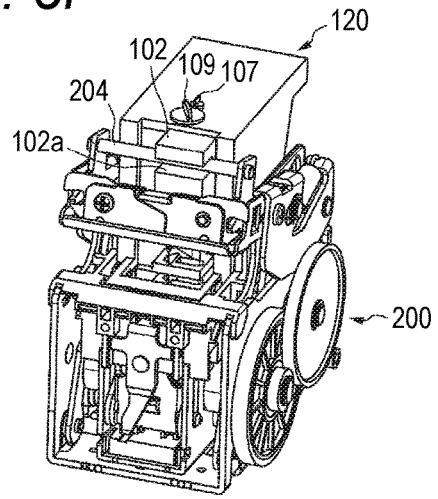

The front surface of the body portion 101 is provided with the lateral slide mechanism unit 121. The lateral slide mechanism unit 121 includes a lateral slide body portion 121*a* having a box shape, and the base portion 103 is integrally formed in the front bottom of the lateral slide body portion 121*a*. As illustrated in FIGS. 8C and 8D, in the base 101*a* of the body portion 101, a storage space 121*s* which can store the rear part of the lateral slide body portion 121*a* is formed. The width in the lateral direction of the storage space 121*s* is set to be longer than the width of the lateral slide body portion 121*a*, and the lateral slide body portion 121*a* can move in the lateral direction in a state in which the rear part of the lateral slide body portion 121*a* is stored in the storage space 121*s*. An adjustment hole is formed to vertically penetrate the ceiling surface 101*d* of the storage space 121*s* in the body portion 101, and the same binding position adjusting screw 109 as the adjustment screw used in the longitudinal slide mechanism unit 106 is rotatably attached to the adjustment hole.

A recessed portion 121*b* is formed on the top surface of the lateral slide body portion 121*a* facing the opening of the adjustment hole in a state in which the lateral slide body portion 121*a* is stored in the storage space 121*s*. A rack engaging with the pinion gear of the binding position adjusting screw 109 is formed on the front surface of the recessed portion 121*b*. The width in the longitudinal direction of the recessed portion 121*b* is set to a size in which the tip 109*c* of the binding position adjusting screw 109 engaging with the rack can be stored and rotated. The size in the lateral direction of the recessed portion 121*b* is set to a size corresponding to a sliding distance of the lateral slide body portion 121*a*.

By causing a user to hold the grip of the binding position adjusting screw 109 and to rotate the binding position adjusting screw 109 rightward and leftward, the rack engaging with the pinion gear of the tip 109*c* of the binding position adjusting screw 109 is extruded in the lateral direction. Accordingly, the lateral slide body portion 121*a* can be caused to slide in the lateral direction along an edge of a bundle of sheets with the rotational operation of the grip.

A fixing hole into which the binding position fixing screw 107 is screwed is formed in the vicinity of the adjustment hole on the ceiling surface 101*d* of the storage space 121*s*. The regulation by the lateral slide regulating unit is released by causing a user to rotate the grip of the head 107*a* to rotate the binding position fixing screw 107 and to bring the tip of the screw portion 107*b* into contact with the top surface of the lateral slide body portion 121*a*. By rotating the binding position fixing screw 107 to retreat the tip of the screw portion 107*b* from the contact with the lateral slide body portion 121*a*, the regulation by the lateral slide regulating unit is released.

By providing the binding mechanism cartridge 120 with the lateral slide mechanism unit 121 and the lateral slide regulating unit in this way, it is possible to adjust the sliding distance in the longitudinal direction of the upward-and-downward moving portion 102 and the base portion 103. Accordingly, by causing a user to rotate the grip of the binding position adjusting screw 109 to adjust the position of the binding edge of the binding portion 104 in the lateral direction in a state in which the binding mechanism cartridge 120 is detached from the binding device body 200, the user can easily adjust a position at which the binding edge penetrates the bundle of sheets while visually checking the position.

In the binding mechanism cartridge 120 including the lateral slide mechanism unit 121, by causing a user to rotate the grip of the binding position adjusting screw 109 to adjust the position of the binding edge of the binding portion 104 in the lateral direction, the user can easily adjust the sliding distance while visually checking the position penetrated by the binding edge. Accordingly, it is possible to finely adjust the binding position based on a user's sense. As a result, it is possible to set and adjust the position of the bundle of sheets penetrated by the binding edge to a binding position at which the user's desire for a binding force of a binding part, convenience, and the like is reflected.

Binding Mechanism Cartridge Including Angle Adjusting Mechanism

The binding mechanism cartridge according to the first embodiment is not limited to the cartridge provided with the longitudinal slide mechanism unit 106 or the lateral slide mechanism unit 121. The binding mechanism cartridge may include an angle adjusting mechanism that can adjust an angle of a binding edge as well as the longitudinal or lateral slide mechanism.

Figure 9B:
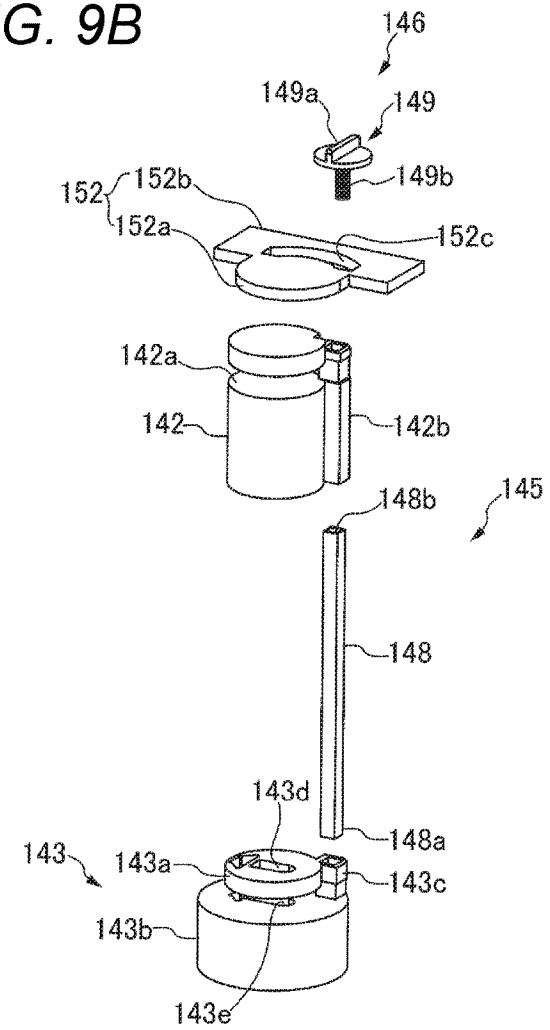
FIGS. 9A and 9B are diagrams illustrating the binding mechanism cartridge including an angle adjusting mechanism and the angle adjusting mechanism.
Figure 9A:
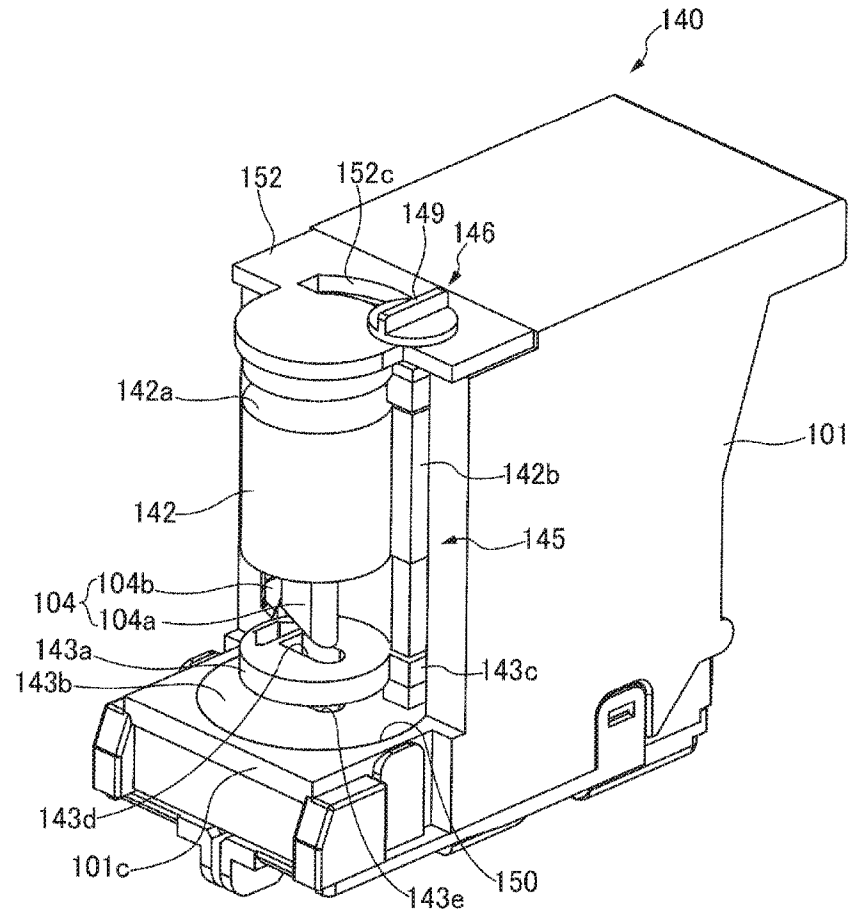

FIG. 9A is a perspective view schematically illustrating a binding mechanism cartridge including an angle adjusting mechanism and FIG. 9B is a decomposed perspective view illustrating an angle adjusting mechanism unit and a rotation regulating unit. FIGS. 10B and 10E are diagrams illustrating a state in which the angle of the binding portion is rotated by 45 degrees relative to the binding mechanism cartridge and the binding device body illustrated in FIGS. 10A and 10D, and FIGS. 10C and 10F are diagrams illustrating a state in which the angle of the binding portion is rotated by 90 degrees relative to the binding mechanism cartridge and the binding device body illustrated in FIGS. 10A and 10D. The binding portions using various binding methods can be formed in the binding mechanism cartridge including the angle adjusting mechanism, but FIGS. 9A and 9B and FIGS. 10A to 10F illustrate a binding mechanism cartridge 140 including a binding portion 104 for stitching as an example.

As illustrated in FIG. 9A, the binding mechanism cartridge 140 includes a body portion 101, a binding portion 104, an angle adjusting mechanism unit 145, and a rotation regulating unit 146. Here, the body portion 101 and the binding portion 104 have the same functions as those in the binding mechanism cartridge 100 or 120 including the longitudinal slide mechanism unit 106 or the lateral slide mechanism unit 121 and description thereof will not be repeated herein.

As illustrated in FIG. 9B, the angle adjusting mechanism unit 145 of the binding mechanism cartridge 140 approximately includes a base portion 143, an upward-and-downward moving portion 142, a slider shaft 148, a binding position fixing screw 149, and a pressing plate 152. The slider shaft 148, the binding position fixing screw 149, and the pressing plate 152 also correspond to the rotation regulating unit 146.

The base portion 143 includes a lower base portion 143*b* having a cylindrical pillar shape and a disc plate portion 143*a* formed to be horizontal so as to form a constant gap from the top surface of the lower base portion 143*b*. The disc plate portion 143*a* is attached to the lower base portion 143*b* via a slider bearing portion 143*c* formed at an end of the top surface of the lower base portion 143*b*.

In the binding mechanism cartridge 140, the front surface of the body portion 101 is cut in a semi-cylindrical shape in the vertical direction and a cylindrical recessed portion 150 corresponding to the cylindrical shape is formed in the base support portion 101*c* formed to protrude forward in the front lower part of the body portion 101. The diameter of the horizontal circle in the cylindrical recessed portion 150 and the diameter of the horizontal circle in the cut semi-cylindrical portion are set to be slightly larger than the diameter of the horizontal circle in the cylindrical shape of the lower base portion 143*b*. Accordingly, the lower base portion 143*b* can be stored in the cylindrical recessed portion 150 of the base support portion 101*c*.

The depth of the cylindrical recessed portion 150 is designed such that the top surface of the base support portion 101*c* (the top surface of the peripheral portion of the cylindrical recessed portion 150) is flush with the top surface of the lower base portion 143*b*. When a bundle of sheets is inserted toward the flush plane (the top surface of the base support portion 101*c* and the top surface of the lower base portion 143*b*) from the horizontal direction, the bundle of sheets is supported from the bottom surface by the base support portion 101*c* and the lower base portion 143*b*.

The base portion 143 can rotate in a state in which the lower base portion 143*b* is stored in the cylindrical recessed portion 150. Since the lower base portion 143*b* having a cylindrical shape is stored in the cylindrical recessed portion 150, the base portion can rotate along the side wall of the cylindrical recessed portion 150. In order to smooth this rotation, a rotary plate or the like for causing the lower base portion 143*b* to rotate may be installed on the bottom surface of the cylindrical recessed portion 150. By installing the rotary plate or the like, the lower base portion 143*b* can smoothly rotate without occurrence of a catch or the like.

An opening 143*d* for causing the binding edge of the binding portion 104 to move upward and downward is formed in the disc plate portion 143*a* of the base portion 143. A recessed space 143*e* having a depth in which the tip of the binding portion 104 passing through the opening 143*d* of the disc plate portion 143*a* is stored is also formed in the lower base portion 143*b*. As illustrated in FIG. 9B, the lower base portion 143*b* has a cylindrical shape and has a certain thickness. Accordingly, in the binding mechanism cartridge 140 including the angle adjusting mechanism unit 145, the recessed space 143*e* capable of storing the tip of the binding portion 104 is formed in the lower base portion 143*b*, not in the base support portion 101*c*.

A rectangular recessed portion is formed in the slider bearing portion 143*c* of the lower base portion 143*b* so as to receive the tip of the slider shaft 148. The slider shaft 148 is a rod-like member having a rectangular cross-section, and a lower end 148*a* thereof is inserted into the slider bearing portion 143*c*. A screw hole 148*b* which is screwed to a screw leg 149*b* of the binding position fixing screw 149 is formed on the top end face of the slider shaft 148.

The upward-and-downward moving portion 142 has a cylindrical shape having the same diameter as the disc plate portion 143*a*, and a narrow neck portion 142*a* covering a circumference is formed in the upper part of the outer circumference of the upward-and-downward moving portion 142. The narrow neck portion 142*a* serves as a drive connecting portion in the binding mechanism cartridge 140 including the angle adjusting mechanism unit 145. As illustrated in FIGS. 10D, 10E, and 10F, by causing the connecting shaft 204 arranged in the C-shaped arm portion 202 to engage with the narrow neck portion 142*a*, the upward-and-downward movement of the upward-and-downward moving portion 142 is performed. A rectangular tubular member 142*b* is fixed and installed on the outer circumferential surface of the upward-and-downward moving portion 142 in the vertical direction. By causing the slider shaft 148 to pass through the hollow portion of the tubular member 142*b*, the upward-and-downward moving portion 142 is guided to move upward and downward by the slider shaft 148. The binding portion 104 including a cutting edge 104*a* and a drawing edge 104*b* is formed on the bottom surface of the upward-and-downward moving portion 142 so as to face the base portion 143.

The upward-and-downward moving portion 142 is elastically supported upward by a spring member or the like not illustrated. Accordingly, the upward-and-downward moving portion 142 is maintained at an upper position of the slider shaft 148 in a state in which the slider shaft 148 penetrates the tubular member 142*b*. Since the upward-and-downward moving portion 142 is maintained at this position, the connecting shaft 204 engages with the narrow neck portion 142*a* of the upward-and-downward moving portion 142 even without adjusting the vertical position of the upward-and-downward moving portion 142 when the binding mechanism cartridge 140 is attached to the binding device body 200.

The pressing plate 152 is constituted by one plate including a semicircular portion 152*a* covering about a half of the top surface of the upward-and-downward moving portion 142 and a rectangular portion 152*b* covering the other half of the top surface of the upward-and-downward moving portion 142 and covering an open part of the top of the cut semi-cylindrical portion on the front side of the body portion 101. A stepped portion into which the pressing plate 152 is inserted is formed in the front top of the body portion 101, and the top surface of the body portion 101 is flush with the top surface of the pressing plate 152 by inserting the pressing plate 152. When the pressing plate 152 is inserted into the body portion 101, the pressing plate 152 is fixed to the body portion 101 so as not to be easily detached therefrom.

An arc-like guide hole 152*c* is formed in the pressing plate 152. The guide hole 152*c* is formed along the positions at which the top end of the slider shaft 148 moves when the base portion 143 rotates in a state in which the slider shaft 148 is attached to the base portion 143. The binding position fixing screw 149 is a screw member in which a grip is formed in a head 149*a* thereof, and can screw the screw leg 149*b* to screw hole 148*b* in the top end of the slider shaft 148 via the guide hole 152*c* from the top side of the pressing plate 152. Here, the width of the top end of the slider shaft 148 is larger than the hole diameter (the hole width) of the guide hole 152*c*. Accordingly, the screw leg 149*b* of the binding position fixing screw 149 can pass through the guide hole 152*c*, but the slider shaft 148 cannot pass the guide hole 152*c*.

In the binding mechanism cartridge 140 including the angle adjusting mechanism unit 145, the angle can be adjusted with the upward-and-downward moving portion 142, the base portion 143, and the binding portion 104 as a unified body by attaching the angle adjusting mechanism unit 145 to the body portion 101. When the angle adjusting mechanism unit 145 is attached to the body portion 101, first, the base portion 143 is installed in the cylindrical recessed portion 150 of the base support portion 101*c* in a state in which the bottom end 148*a* of the slider shaft 148 is inserted into the slider bearing portion 143*c* of the base portion 143, the slider shaft 148 is caused to pass through the tubular member 142*b* of the upward-and-downward moving portion 142, the pressing plate 152 is then fixed and installed in the body portion 101, and finally the screw leg 149*b* of the binding position fixing screw 149 is screwed to the screw hole 148*b* of the slider shaft 148 via the guide hole 152*c*.

By fastening the binding position fixing screw 149 in this way, the pressing plate 152 is interposed between the binding position fixing screw 149 and the slider shaft 148. By interposing the pressing plate 152 in this way, the slider shaft 148 and the binding position fixing screw 149 cannot move along the guide hole 152*c* and thus the angle of the upward-and-downward moving portion 142 of which the position is adjusted via the tubular member 142*b* by the slider shaft 148 and the base portion 143 of which the position is adjusted via the slider bearing portion 143*c* is fixed. By interposing the pressing plate 152 between the binding position fixing screw 149 and the slider shaft 148, the angle adjustment cannot be performed and the rotation of the upward-and-downward moving portion 142 is regulated. Accordingly, the slider shaft 148, the binding position fixing screw 149, and the pressing plate 152 serve as the rotation regulating unit 146.

On the other hand, by causing a user to rotate the grip to loosen the fastening of the binding position fixing screw 149 and the slider shaft 148, the interposing of the pressing plate 152 is released and the slider shaft 148 and the binding position fixing screw 149 can move along the guide hole 152*c*. Accordingly, by causing the binding position fixing screw 149 to move along the guide hole 152*c*, it is possible to change the angle of the upward-and-downward moving portion 142, the base portion 143, and the binding portion 104.

In this way, after the binding position fixing screw 149 moves in the state in which the fastening is loosened and the binding angle of the binding portion 104 is adjusted, the binding position fixing screw 149 is fastened to fix the binding portion of the binding portion 104. Thereafter, by storing the binding mechanism cartridge 140 in the storage portion 201 of the binding device body 200, the connecting shaft 204 of the C-shaped arm portion 202 is inserted into the narrow neck portion 142*a* of the upward-and-downward moving portion 142 to engage with the drive connecting portion as illustrated in FIGS. 10D, 10E, and 10F. By causing the connecting shaft 204 to move upward and downward with the movement of the table moving mechanism 210 of the binding device body 200, the upward-and-downward moving portion 142 engaging with the connecting shaft 204 moves upward and downward and a cut is made in the bundle of sheets by the binding edges 104*a* and 104*b*, whereby the binding process using the stitching method is performed.

According to the binding mechanism cartridge 140 including the angle adjusting mechanism unit 145, the upward-and-downward moving portion 142 and the binding edges 104*a* and 104*b* are installed to be exposed from the front part of the body portion 101. Accordingly, when the angle adjustment is performed along the guide hole 152*c*, the angle of the binding edges 104*a* and 104*b* can be visually checked.

For example, in a bundle of sheets which has been subjected to a binding process using the stitching method, a binding process using the half-blank binding method, or the like, when a cutting direction of a U-shaped tip in a U-shaped cut is parallel to a sheet turning direction in the bundle of sheets, binding parts of the bundle of sheets are likely to be scattered to weaken the binding force of the bundle of sheets. On the other hand, when the cutting direction of a U-shaped tip in a U-shaped cut is perpendicular to the sheet turning direction in the bundle of sheets, binding parts of the bundle of sheets are not likely to be scattered to maintain the binding force of the bundle of sheets relatively strong. Accordingly, when the process of binding a bundle of sheets is performed without using a staple, the binding force of the bundle of sheets is likely to greatly vary depending on the difference in the binding angle about the bundle of sheets.

Accordingly, by providing the binding mechanism cartridge 140 with the angle adjusting mechanism 145, a user can easily adjust the binding angle while visually checking the binding angle. Accordingly, it is possible to set and adjust the angle of the position of the bundle of sheets penetrated by the binding edges 104*a* and 104*b* to an angle at which the user's desire for a binding force of a binding part and the like is reflected.

Regarding the binding mechanism cartridge that performs a binding process using the table moving mechanism 210 of the binding device body 200, three types of binding mechanism cartridges of the binding mechanism cartridge 100 including the longitudinal slide mechanism unit 106, the binding mechanism cartridge 120 including the lateral slide mechanism unit 121, and the binding mechanism cartridge 140 including the angle adjusting mechanism unit 145 have been described above. However, the binding mechanism cartridge in which the position adjustment or the like of the binding portion 104 is performed is not limited to the binding mechanism cartridge including any one of the longitudinal slide mechanism unit 106, the lateral slide mechanism unit 121, and the angle adjusting mechanism unit 145.

For example, two or all of the longitudinal slide mechanism unit 106, the lateral slide mechanism unit 121, and the angle adjusting mechanism unit 145 may be provided in the binding mechanism cartridge. For example, by providing the binding mechanism cartridge with the longitudinal slide mechanism unit 106 and the lateral slide mechanism unit 121, the binding edge can be caused to move in the longitudinal direction and the lateral direction to adjust the position. By providing the binding mechanism cartridge with the longitudinal slide mechanism unit 106 and the angle adjusting mechanism unit 145, the position of the binding edge can be caused to move in the longitudinal direction and the angle of the binding edge can also be adjusted. By providing the binding mechanism cartridge with the lateral slide mechanism unit 121 and the angle adjusting mechanism unit 145, the position of the binding edge can be caused to move in the lateral direction and the angle of the binding edge can also be adjusted. By providing the binding mechanism cartridge with the longitudinal slide mechanism unit 106, the lateral slide mechanism unit 121, and the angle adjusting mechanism unit 145, the position of the binding edge can be cause to move in the longitudinal direction and the lateral direction and the angle of the binding bridge can also be adjusted.

Binding Mechanism Cartridge not Including Longitudinal Slide Mechanism Unit, Lateral Slide Mechanism Unit, or Angle Adjusting Unit The binding mechanism cartridge is not limited to the binding mechanism cartridge including the longitudinal or lateral slide mechanism or the angle adjusting mechanism, but may not include the slide mechanism units 106 and 121 and the angle adjusting mechanism unit 145.

Figure 11B:
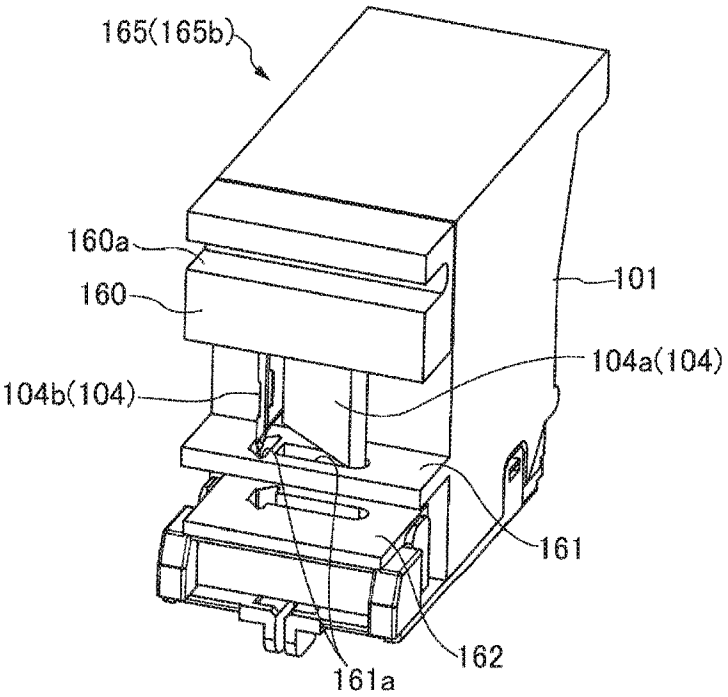
FIGS. 11A and 11B are perspective views illustrating a binding mechanism cartridge not including the longitudinal slide mechanism, the lateral slide mechanism, and the angle adjusting mechanism.
Figure 11A:
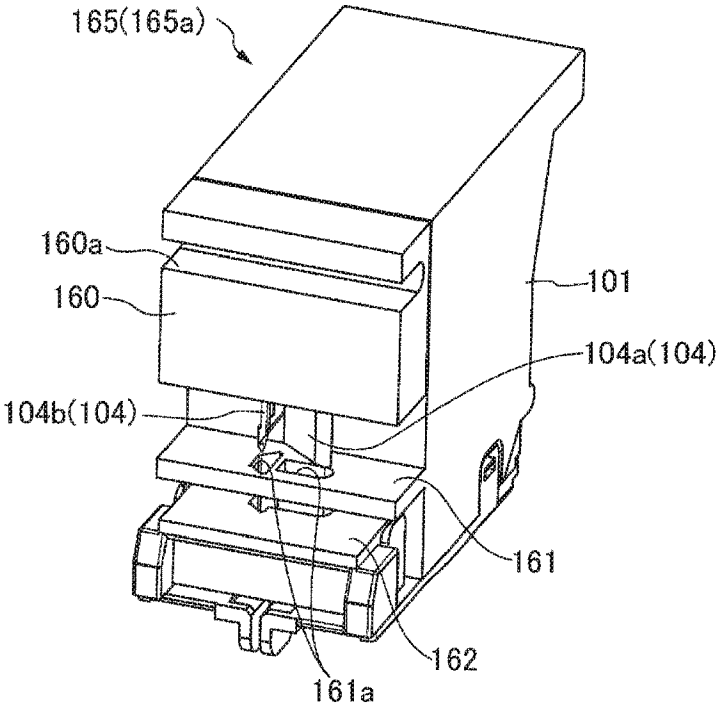

FIGS. 11A and 11B are perspective views illustrating a binding mechanism cartridge not including the slide mechanisms 106 and 121 and the angle adjusting mechanism unit 145. In the binding mechanism cartridge 165 (165*a* and 165*b*), an upward-and-downward moving portion 160 is attached to the front surface of the body portion 101 so as to be movable upward and downward in the vertical direction. The upward-and-downward moving portion 160 is attached to the body portion 101 so as to be movable upward and downward by a slide mechanism such as a rail not illustrated. The upward-and-downward moving portion 160 is elastically supported to be located in an upper part of the front surface of the body portion 101 by an elastic support member such as a spring installed in the slide mechanism. A base portion 161 and a base support portion 162 are formed in a lower part of the front surface of the body portion 101.

When the C-shaped arm portion 202 moves upward and downward in a state in which the connecting shaft 204 engages with a drive connecting portion 160*a* formed in the upper part of the upward-and-downward moving portion 160, the binding edges 104*a* and 104*b* of the binding portion 104 formed on the bottom surface of the upward-and-downward moving portion 160 come in pressure contact with a bundle of sheets via an opening 161*a* of the base portion 161 to perform a binding process.

By changing and adjusting the sizes of the binding edges 104*a* and 104*b* installed in the binding mechanism cartridge 165, the size of the opening 161*a* of the base portion 161, or the height of a gap between the base portion 161 and the base support portion 162, it may be possible to change and adjust the number of sheets or the like which can be subjected to the binding process based on a binding method not using a staple. The size of the binding portion (binding edge) 104 of the binding mechanism cartridge 165*b* illustrated in FIG. 11B is larger than the size of the binding portion (binding edge) 104 of the binding mechanism cartridge 165*a* illustrated in FIG. 11A, and the gap between the base portion 161 and the base support portion 162 illustrated in FIG. 11B is larger than the gap between the base portion 161 and the base support portion 162 illustrated in FIG. 11A. Accordingly, the binding mechanism cartridge 165*b* illustrated in FIG. 11B can bind a larger number of sheets once by stitching than the binding mechanism cartridge 165*a* illustrated in FIG. 11A.

Binding Mechanism Cartridge Including Plural Binding Mechanisms

As described above, by forming the binding portion such as the binding mechanism using the stitching method, the binding mechanism using the half-blanking binding method, the binding mechanism using the concave-convex binding method as the binding portion 104 formed in the upward-and-downward moving portion 160 separately for each binding mechanism cartridge, it is possible to simply change the binding method by replacement of the binding mechanism cartridge. The binding mechanism cartridge is not limited to a configuration in which one binding mechanism is installed in one binding mechanism cartridge, but may have a configuration in which plural types of binding mechanisms are installed in one binding mechanism cartridge.

Figure 12A:
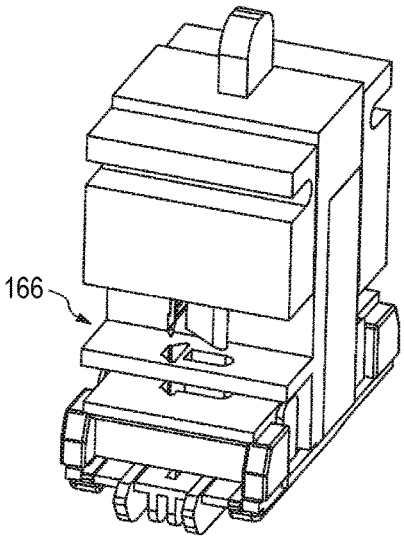
FIGS. 12A to 12D are perspective views of a binding mechanism cartridge including different binding mechanisms in a front part and a rear part.
Figure 12B:
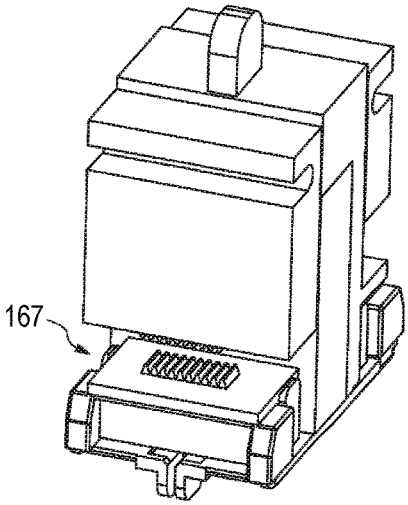

As described above, in the binding mechanism cartridge using the table moving mechanism 210, the binding process is performed by causing the upward-and-downward moving portion 160 connected to the connecting shaft 204 of the C-shaped arm portion 202 to move upward and downward. Accordingly, a binding mechanism 166 based on stitching may be installed on one side (for example, the front side) of the binding mechanism cartridge as illustrated in FIG. 12A and a binding mechanism 167 based concave-convex binding may be installed on the other side (for example, the rear side) as illustrated in FIG. 12B. Even when different binding mechanisms are installed on the front side and the rear side in this way, the binding process based on the respective binding mechanisms can be performed by changing the direction in which the binding mechanism cartridge is inserted into the storage portion 201 of the binding device body 200 to the front side and the rear side. For example, the binding process based on stitching can be performed by attaching the binding mechanism cartridge to the binding device body 200 with the side on which the binding mechanism based on the stitching method is installed as the front side, and the binding process based on concave-convex binding can be performed by attaching the binding mechanism cartridge to the binding device body 200 with the side on which the binding mechanism based on the concave-convex binding is installed as the front side.

Figure 12C:
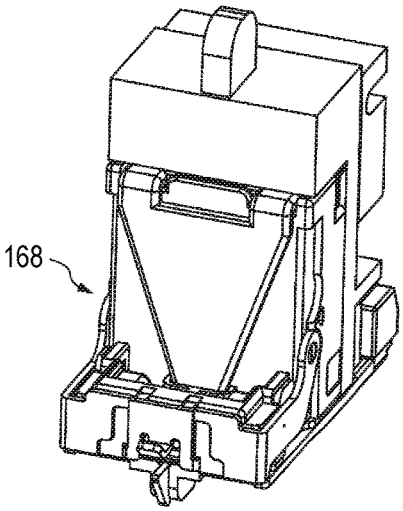
Figure 12D:
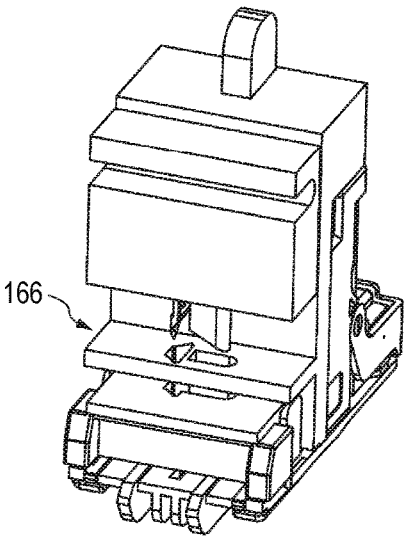

In addition, by installing a staple cartridge 168 illustrated in FIG. 12C on one side and installing a binding mechanism 166 based on stitching illustrated in FIG. 12D on the other side, the binding process using a staple and the binding process based stitching can be selectively performed depending on the attachment direction. In addition, by selecting two binding mechanisms out of the binding mechanism using a staple, the binding mechanism based on stitching, the binding mechanism based on half-blank binding, the binding mechanism based on concave-convex binding, the binding mechanism using a paper needle, the binding mechanism using a clip, and the like and installing different binding mechanisms on the front side and the rear side, it is possible to realize plural binding methods in a single binding mechanism cartridge.

Second Embodiment

In the binding mechanism cartridges 100, 120, 140, and 165 according to the first embodiment, the binding process is performed using the table moving mechanism 210 among the drive mechanisms of the binding device body 200. However, the binding process in the binding mechanism cartridge is not limited to the case in which the binding process is performed by interlocking with the table moving mechanism 210, but the binding process may be performed using another moving mechanism unit. In a binding mechanism cartridge according to a second embodiment of the present invention, the binding portion of the upward-and-downward moving portion is brought into pressure contact with a bundle of sheets by interlocking with a clinching operation of the clinching mechanism 250 as well as the table moving mechanism 210.

Clinching Mechanism of Binding Device Body

Figure 13A:
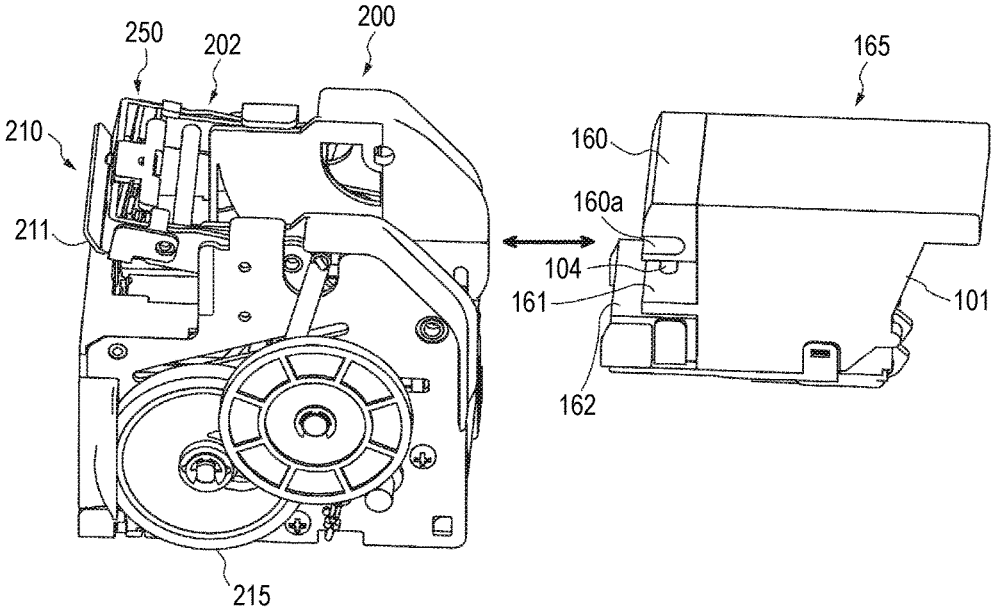
FIGS. 13A to 13C are diagrams illustrating a binding mechanism cartridge and a binding device body according to a second embodiment of the present invention.
Figure 13B:
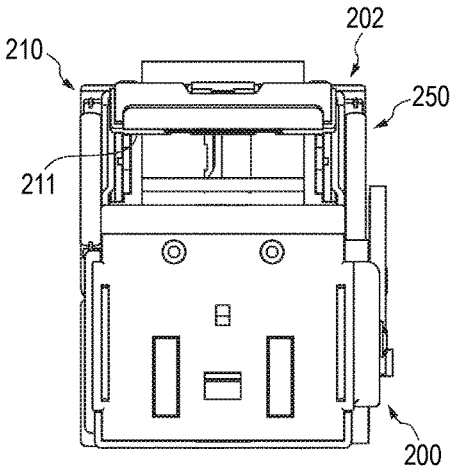
Figure 13C:
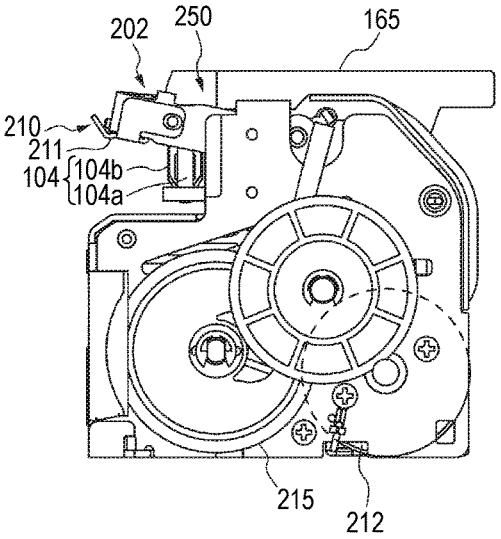
Figure 14A:
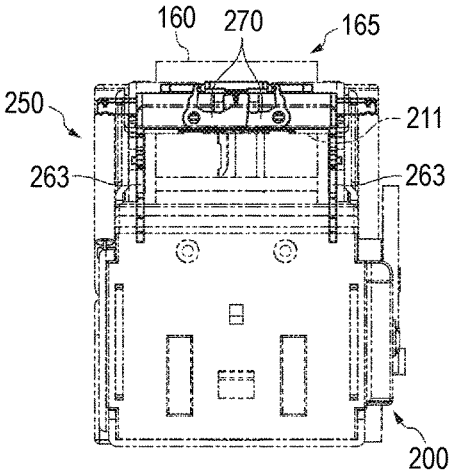
FIGS. 14A to 14F are diagrams illustrating operations of the binding device body and the binding mechanism cartridge according to the second embodiment.
Figure 14B:
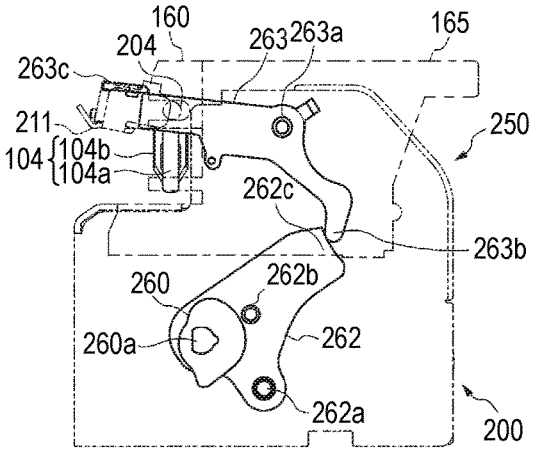
Figure 14C:
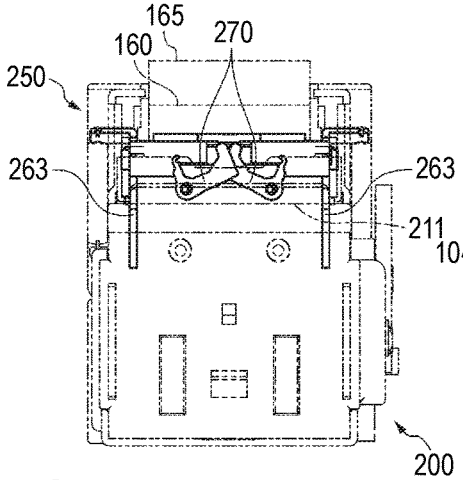
Figure 14D:
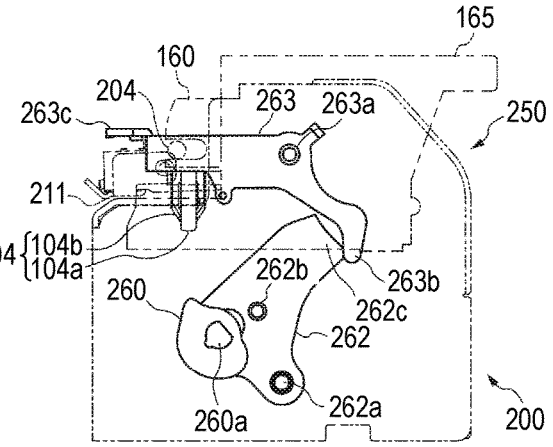
Figure 14E:
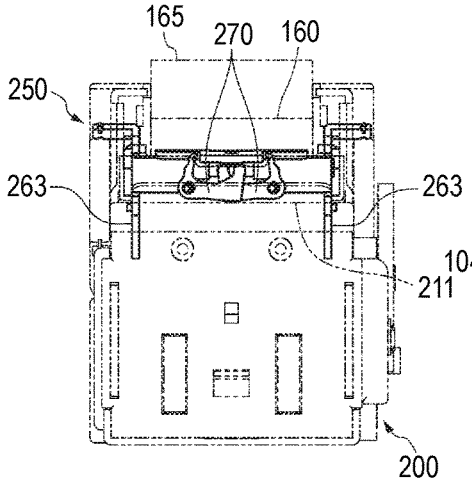
Figure 14F:
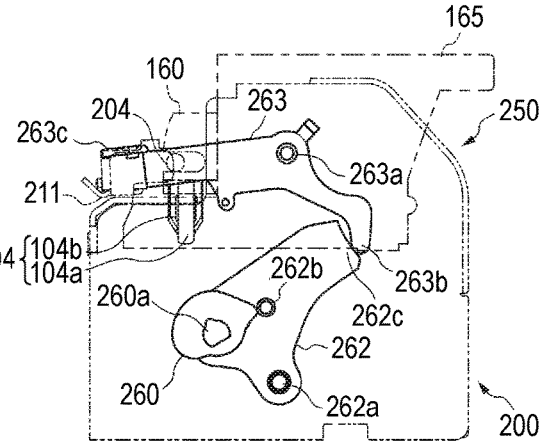

FIG. 13A is a perspective view illustrating a binding device body including a clinching mechanism and a binding mechanism cartridge, FIG. 13B is a front view of the binding device body, and FIG. 13C is a side view thereof. FIGS. 14A to 14F are schematic diagrams illustrating the configuration of the clinching mechanism, where FIGS. 14A and 14B illustrate a state in which the table moving mechanism is not driven, FIGS. 14C and 14D illustrate a state in which the table moving mechanism is driven, and FIGS. 14E and 14F illustrate a state in which the clinching mechanism is driven. The binding mechanism cartridge 165 described above with reference to FIGS. 11A and 11B will be exemplified as the binding mechanism cartridge according to the second embodiment.

The binding device body 200 is provided with a clinching mechanism 250. As illustrated in FIGS. 14A to 14F, the clinching mechanism 250 includes a clinch cam 260, a clinch lever 262, and a clincher arm 263. The clincher cam 260 is formed of a different-diameter disc having a substantially elliptical shape and a rotation shaft 260*a* is formed at a position biased close to the outside from the center of the different-diameter disc. The rotation shaft 260*a* is configured to rotate with the rotation of the drive gear 215. The clinch lever 262 can cause an upper end 262*c* to obliquely swing by a predetermined angle with a shaft portion 262*a* formed in the lower part as a swing axis. A protrusion shaft is formed at the center of the clinch lever 262 and comes in contact with the outer circumference of the clinch cam 260 via a roller 262*b* formed on the protrusion shaft.

The clincher arm 263 is an arm member formed substantially in a ^ shape and is configured to swing with a shaft portion 263*a* formed in the vicinity of a bend portion as a swing axis. A rear end 263*b* of the clincher arm 263 comes in contact with the upper end 262*c* of the clinch lever 262, and when the upper end 262*c* of the clinch lever 262 swings, the rear end 263*b* of the clincher arm 263 swings in the longitudinal direction with the swing, and a front end 263*c* of the clincher arm 263 moves upward and downward with the swing of the rear end 263*b* of the clincher arm 263.

A clincher 270 installed on the front surface of the C-shaped arm portion 202 is connected to the front end 263*c* of the clincher arm 263. In a state in which the table portion 211 moves downward to the lowest by the table moving mechanism 210 (see FIGS. 14C and 14D), the front end 263*c* of the clincher arm 263 moves downward. When the front end 263*c* of the clincher arm 263 moves downward, the clincher 270 presses and bends legs of a staple toward the sheet surface as illustrated in FIGS. 14E and 14F.

here, the clincher arm 263 is provided with a connecting shaft 204, and when the binding mechanism cartridge 165 is stored in the storage portion 201 of the binding device body 200, the connecting shaft 204 is connected to the drive connecting portion 160*a* of the binding mechanism cartridge 165. Accordingly, when the front end 263*c* of the clincher arm 263 moves upward, the upward-and-downward moving portion 160 of the binding mechanism cartridge 165 moves upward and downward by interlocking therewith.

Operation of Binding Mechanism Cartridge Using Clinching Mechanism

In a sheet processing apparatus 10 in which the binding mechanism cartridge 165 is attached to the binding device body 200, when a bundle of sheets is inserted between the base portion 161 and the base support portion 162 of the binding mechanism cartridge 165, the rotational driving of the motor 212 of the binding device body 200 is controlled.

When the motor 212 is driven, as described above with reference to FIGS. 4C and 4D, the table drive cam 220 of the table moving mechanism 210 rotates with the rotational driving of the motor 212, the first table link 222 and the second table link 223 are driven, and the connecting shaft 204 of the clincher arm 263 is pushed down. Via the drive connecting portion 160*a* engaging with the connecting shaft 204, the upward-and-downward moving portion 160 of the binding mechanism cartridge 165 is pushed down to move downward as illustrated in FIGS. 14C and 14D.

When the upward-and-downward moving portion 160 moves downward, the cutting edge 104*a* and the drawing edge 104*b* of the binding portion 104 formed on the bottom surface of the upward-and-downward moving portion 160 move downward to the bundle of sheets inserted between the base portion 161 and the base support portion 162, the bundle of sheets is cut out in a U shape, and an I-shaped cut is formed.

In the state in which the upward-and-downward moving portion 160 moves downward by the clincher arm 263, as illustrated in FIGS. 14E and 14F, the upper end 262*c* of the clinch lever 262 rotates in the clockwise direction with the rotation of the clinch cam 260, the rear end 263*b* of the clincher arm 263 is pushed rearward, and the front end 263*c* of the clincher arm 263 moves downward with the movement of the rear end 263*b* of the clincher arm 263. In this way, when the front end 263*c* of the clincher arm 263 moves downward, the cutting edge 104*a* and the drawing edge 104*b* in the upward-and-downward moving portion 160 are further pressed toward the bundle of sheets and thus the cutting edge 104*a* and the drawing edge 104*b* are further inserted into the bundle of sheets. With the downward movement of the front end 263*c* of the clincher arm 263, the clincher 270 moves.

When the clinch cam 260 rotates with the rotational driving of the motor 212, the upper end 262*c* of the clinch lever 262 rotates in the return direction (in the counterclockwise direction), the rear end 263*b* of the clincher arm 263 is returned forward, and the front end 263*c* of the clincher arm 263 moves upward. In this way, when the front end 263*c* of the clincher arm 263 moves upward, the pressing of the cutting edge 104*a* and the drawing edge 104*b* of the upward-and-downward moving portion 160 toward the bundle of sheets is released and the upward-and-downward moving portion 160 moves upward.

Thereafter, with the rotational driving of the motor 212, the table drive cam 220 of the table moving mechanism 210 rotates, the first table link 222 moves upward, the front end 263*c* of the second table link 223 is pushed upward, and the upward-and-downward moving portion 160 moves upward. When the upward-and-downward moving portion 160 moves upward, the cutting edge 104*a* and the drawing edge 104*b* are drawn out of the bundle of sheets and the tip of a U-shaped sheet piece is pulled from the rear side to the front side in the I-shaped cut, and the bundle of sheets is bound by the U-shaped sheet piece, whereby the process of binding the bundle of sheets based on stitching not using a staple is completed.

As a result, even in a configuration in which the binding process of the binding mechanism cartridge 165 is performed using the clinching mechanism 250, since the upward-and-downward moving portion 160 and the binding portion 104 of the binding mechanism cartridge 165 can be driven to move upward and downward using the clinching mechanism 250 of the binding device body 200, it is not necessary to provide the binding mechanism cartridge 165 itself with a motor or the like for driving the upward-and-downward moving portion 160 and the binding portion 104. Accordingly, it is possible to simplify the structure of the binding mechanism cartridge 165 and to achieve a decrease in cost of the binding mechanism cartridge 165.

Third Embodiment

In the binding mechanism cartridges 100, 120, 140, and 165 according to the first embodiment, the binding process is performed using the table moving mechanism 210 among the drive mechanisms of the binding device body 200. In the binding mechanism cartridge 165 according to the second embodiment, the binding process is performed using the clinching mechanism 250. In a third embodiment of the present invention, a binding mechanism cartridge that performs a binding process using a stapler drive mechanism 280 of the binding device body 200 will be described.

Stapler Drive Mechanism of Binding Device Body

Figure 15A:
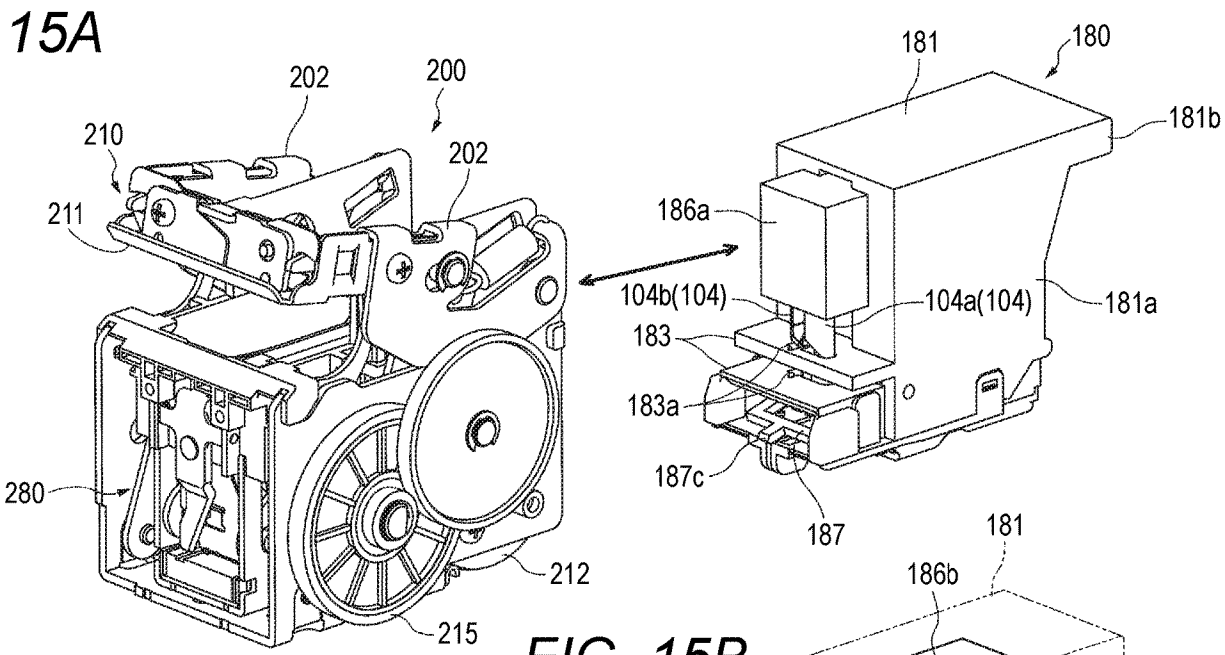
FIGS. 15A and 15B are diagrams illustrating a binding mechanism cartridge and a binding device body according to a third embodiment of the present invention.
Figure 15B:
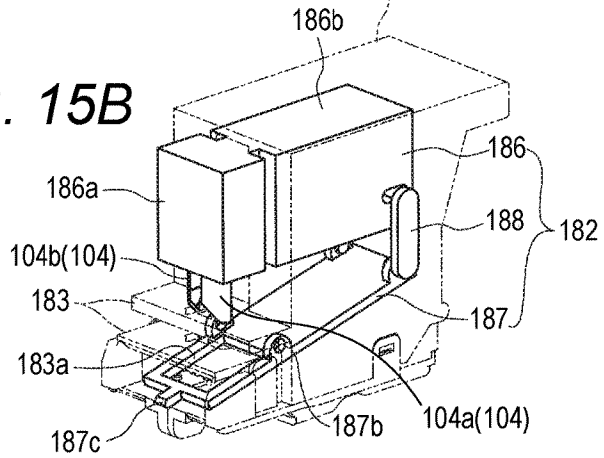
Figure 16A:
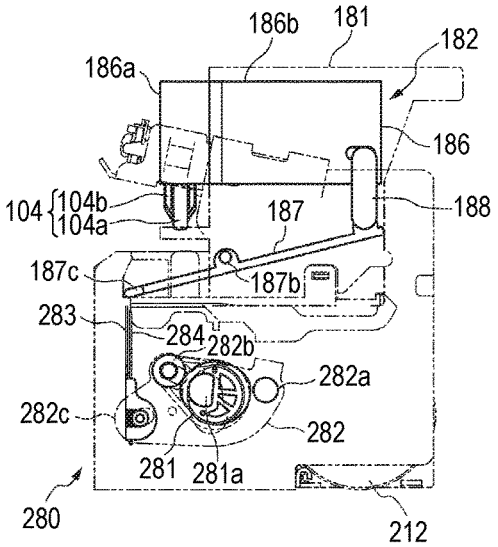
FIGS. 16A to 16D are diagrams illustrating operations of the binding device body and the binding mechanism cartridge according to the third embodiment.
Figure 16B:
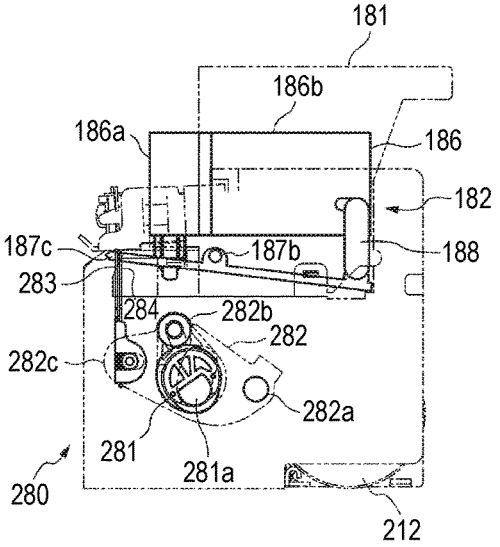
Figure 16C:
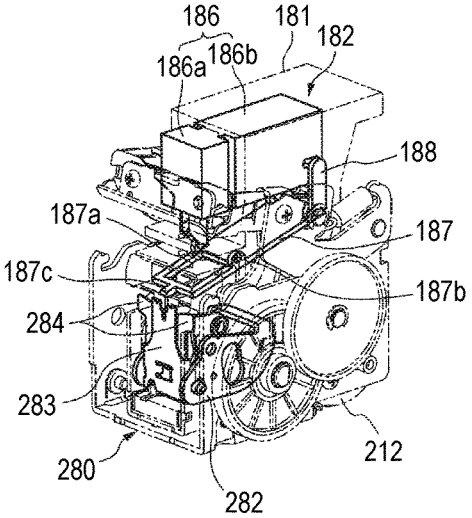
Figure 16D:
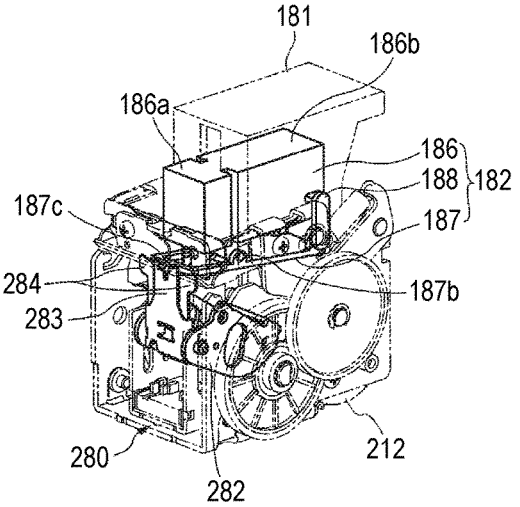

FIGS. 15A and 15B and FIGS. 16A to 16D are schematic diagrams illustrating a configuration of the stapler drive mechanism of the binding device body. FIG. 15A illustrates the binding device body and the binding mechanism cartridge using the stapler drive mechanism, FIG. 15B illustrates the internal structure of the binding mechanism cartridge. FIGS. 16A and 16C illustrate an operation state before the upward-and-downward moving portion moves downward by the stapler drive mechanism and FIGS. 16B and 16D illustrate an operation state when the upward-and-downward moving portion moves downward by the stapler drive mechanism.

The binding device body 200 includes the stapler drive mechanism 280. As illustrated in FIGS. 16A and 16B, the stapler drive mechanism 280 includes a driver cam 281, a drive link 282, a driver 283, and a forming plate (plate) 284. The driver cam 281 is a disc member formed in a substantially elliptical shape and a rotation shaft 281*a* is formed at a position biased from the center thereof. The rotation shaft 281*a* is configured to rotate with the rotation of the drive gear 215. The drive link 282 is formed to be rotatable about a shaft 282*a* formed in the vicinity of the rear end. The drive link 282 is provided with a follower roller 282*b* coming in contact with the circumferential surface of the driver cam 281, and the follower roller 282*b* coming in contact with the circumferential surface of the driver cam 281 swings with the rotation of the driver cam 281, whereby a front end 282*c* of the drive link 292 vertically reciprocates. The front end 282*c* of the drive link 282 is provided with the driver 283 and the forming plate 284, and the driver 283 and the forming plate 284 move upward and downward by causing the front end 282*c* of the drive link 282 to reciprocate in the vertical direction. The stapler drive mechanism 280 may correspond to the upward-and-downward drive mechanism in the claims. The binding mechanism cartridge is driven by a movement of the stapler drive mechanism 280.

Binding Mechanism Cartridge which is Driven by Stapler Drive Mechanism

The binding mechanism cartridge 180 performs a binding process by interlocking with the stapler drive mechanism 280 of the binding device body 200. Binding edges for realizing various binding mechanisms such as a half-blank binding mechanism or a concave-convex binding mechanism can be used as the binding portion 104 of the binding mechanism cartridge 180. In the binding mechanism cartridge 180 according to the third embodiment, for example, a cutting edge 104*a* and a drawing edge 104*b* for realizing the binding mechanism using a stitching method are used as the binding edges.

As illustrated in FIGS. 15A and 15B, the binding mechanism cartridge 180 includes a body portion 181, a slider mechanism unit 182, a base portion 183, and a binding portion 104.

The body portion 181 approximately includes a base 181*a* having a substantially rectangular parallelepiped shape and a grip portion 181*b* formed to protrude rearward from the rear upper part. In the front lower part of the body portion 181, the base portion 183 including two upper and lower plate-like members which are formed to be horizontal is integrally formed with the body portion 181. An opening 183*a* allowing the binding portion 194 to move upward and downward is formed in each of the two plate-like members. A space having a depth in which the tips of the cutting edge 104*a* and the drawing edge 104*b* passing through the lower plate-like member can be received is formed below the lower plate-like member of the base portion 183.

The slider mechanism unit 182 includes an upward-and-downward moving portion body 186 which is arranged to slide in the vertical direction relative to the body portion 181, a driving lever 187 that engages with the tip of the driver 283 to swing by interlocking with the driver 283, and a connection link 188 that connects the rear end of the driving lever 187 and the rear lower part of the upward-and-downward moving portion body 186.

The upward-and-downward moving portion body 186 includes an upward-and-downward moving portion 186*a* that is exposed to the front side on the front side of the body portion 181 and a rear body portion 186*b* that is received in the body portion 181, and the upward-and-downward moving portion 186*a* and the rear body portion 186*b* as a unified body slide upward and downward. The upward-and-downward moving portion body 186 is biased upward by a biasing member such as a spring not illustrated and is normally located on the upper side of the body portion 181 by the slide mechanism. The binding portion 104 including the cutting edge 104*a* and the drawing edge 104*b* is formed as a binding edge on the bottom surface of the upward-and-downward moving portion 186*a*.

The driving lever 187 is a panel-like member in which an opening 187*a* capable of receiving the tips of the cutting edge 104*a* and the drawing edge 104*b* passing through the lower plate-like member of the base portion 183 is formed, and a swing shaft portion 187*b* for causing the front and rear ends of the driving lever 187 to swing is formed substantially at the center thereof. An engagement protrusion 187*c* engaging with the tip of the driver 283 is formed as the drive connecting portion at the front end of the driving lever 187. The connection link 188 is connected to the rear end of the driving lever 187 and is connected to the rear part of the rear body portion 186*b*

Operation of Binding Mechanism Cartridge Using Stapler Drive Mechanism

When the binding mechanism cartridge 180 is stored in the storage portion 201 of the binding device body 200, the engagement protrusion 187*c* of the driving lever 187 is set to a position immediately above the tip of the driver 283 as illustrated in FIGS. 16A and 16C. The sheet processing apparatus 10 including the binding device body 200 performs a rotational driving control of the motor 212 of the binding device body 200 when a bundle of sheets is inserted between two plate-like members of the base portion 183 of the binding mechanism cartridge 180.

When the motor 212 is rotationally driven, the driver cam 281 of the stapler drive mechanism 280 rotates with the rotational driving of the motor 212, the front end 282*c* of the drive link 282 starts moving upward with the rotation of the driver cam 281, and the forming plate 284 and the driver 283 move upward. When the driver 283 moves upward, as illustrated in FIGS. 16B and 16D, the engagement protrusion 187*c* of the driving lever 187 engages with the tip of the driver 283 and is pushed upward. When the front end of the driving lever 187 is pushed upward, the rear part of the driving lever 187 is pushed down via the swing shaft portion 187*b* and thus the rear body portion 186*b* is pushed downward via the connection link 188. When the upward-and-downward moving portion 186*a* moves downward by pushing down the rear body portion 186*b*, the cutting edge 104*a* and the drawing edge 104*b* formed on the bottom surface of the upward-and-downward moving portion 186*a* move downward to the bundle of sheets inserted between the two plate-like members of the base portion 183, the bundle of sheets is cut in a U shape, and an I-shaped cut is formed.

Even when the tips of the cutting edge 104*a* and the drawing edge 104*b* pass through the openings 183*a* formed in the two plate-like members of the base portion 183 and enter the bottom of the base portion 183, the operations of the cutting edge 104*a* and the drawing edge 104*b* are not hindered because the space having a depth capable of receiving the tips of the cutting edge 104 and the drawing edge 104*b* is formed below the base portion 103 and the opening 187*a* capable of receiving the tips of the cutting edge 104*a* and the drawing edge 104*b* passing through the base portion 183 is formed in the driving lever 187.

Thereafter, when the driver cam 281 of the stapler drive mechanism 280 rotates with the rotational driving of the motor 212, the front end 282*c* of the drive link 282 moves downward, and the forming plate 284 and the driver 283 move downward, the front end of the driving lever 187 pushed upward by the driver 283 also move downward via the engagement protrusion 187*c*. When the front end of the driving lever 187 moves downward, as illustrated in FIGS. 16A and 16C, the rear end of the driving lever 187 moves upward by interlocking therewith, the rear body portion 186*b* connected thereto via the connection link 188 slides upward in the body portion 181, and the upward-and-downward moving portion 186*a* moves upward. When the upward-and-downward moving portion 186*a* moves upward, the cutting edge 104*a* and the drawing edge 104*b* are pulled from the bundle of sheets, the tip of the U-shaped sheet piece is drawn from the rear side to the front side in the I-shaped cut, and the bundle of sheets is bound by the U-shaped sheet piece, whereby the process of binding the bundle of sheets using a stitching method is completed.

Even in a configuration in which the binding mechanism cartridge 180 according to the third embodiment is attached to the binding device body 200 to perform the binding process, since the upward-and-downward moving portion 186*a* and the binding portion 104 of the binding mechanism cartridge 180 can be driven to move upward and downward using the stapler drive mechanism 280 of the binding device body 200, it is not necessary to provide the binding mechanism cartridge 180 itself with a motor or the like for driving the upward-and-downward moving portion 186*a* and the binding portion 104. Accordingly, it is possible to simplify the structure of the binding mechanism cartridge 180 and to achieve a decrease in cost of the binding mechanism cartridge 180.

As the binding mechanism cartridge 180 according to the third embodiment, the cartridge having a configuration in which the binding position or the binding angle is not performed is exemplified as illustrated in FIGS. 15A and 15B and FIGS. 16A to 16D. However, the binding mechanism cartridge 180 using the stapler drive mechanism 280 of the binding device body 200 is not limited to the cartridge having a configuration in which the binding position or the binding angle is not performed, but one or two or more mechanisms of the longitudinal slide mechanism unit 106, the lateral slide mechanism unit 121, and the angle adjusting mechanism unit 145 may be combined as described in the first embodiment. In this way, by using the binding mechanism cartridge in which the binding position in the longitudinal direction or the lateral direction can be adjusted or the binding angle can be adjusted as the binding mechanism cartridge using the stapler drive mechanism 280 of the binding device body 200, a user can finely adjust the binding position or the binding angle while visually checking the binding position or the binding angle and it is thus possible to adjust and set the binding position and the binding angle of the binding edge with respect to a bundle of sheets to a binding position and a binding angle at which the user's desire for a binding force of a binding part.

Fourth Embodiment

In the binding mechanism cartridges 100, 120, 140, 165, and 180 according to the first to third embodiments, the binding mechanism cartridge that is detachably attached to the storage portion 201 of the binding device body 200 instead of the stapler cartridge 300 has been described. However, there is a specific binding device body in which a staple cartridge in which a wound and bound staple sheet is stored and a driver mechanism unit including a forming plate and a driver is provided can be detachably held and the drive mechanism unit including the forming plate and the driver is replaced together as well as the staple sheet by replacing the staple cartridge when the staple sheet is used up. In a fourth embodiment of the present invention, a binding mechanism cartridge that can be attached to and detached from the binding device body instead of the staple cartridge provided with the drive mechanism unit will be described.

In the binding mechanism cartridge according to the fourth embodiment, the binding mechanism cartridge can use the binding edges for realizing various binding mechanisms such as a half-blank binding mechanism or a concave-convex binding mechanism as the binding portion, but it is assumed that the cutting edge 104*a* and the drawing edge 104*b* for realizing a binding mechanism using the stitching method are provided as the binding portion (binding edge) 104.

Figure 17:
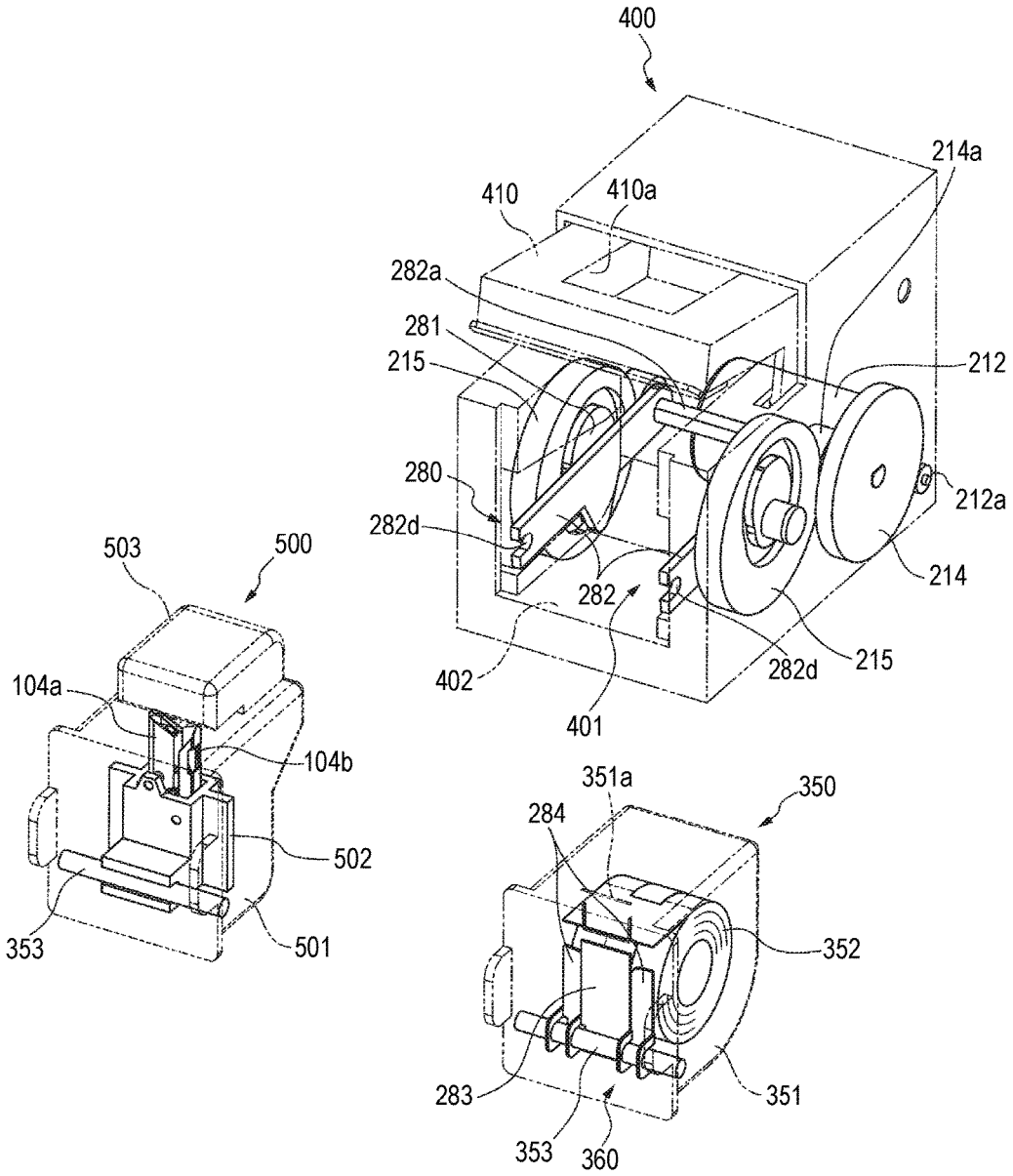
FIG. 17 is a diagram illustrating a binding mechanism cartridge, a staple cartridge, and a binding device body according to a fourth embodiment of the present invention.
Figure 18A:
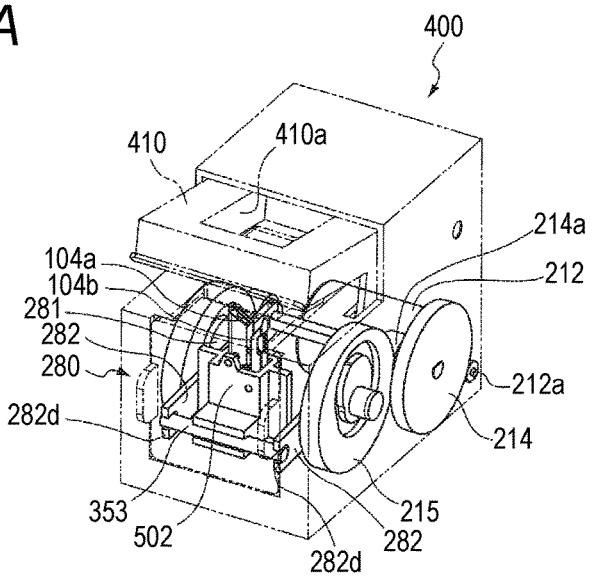
FIGS. 18A to 18E are diagrams illustrating operations of the binding device body and the binding mechanism cartridge according to the fourth embodiment.
Figure 18B:
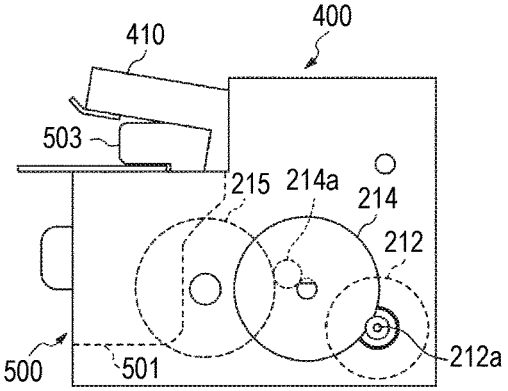

FIGS. 17 and 18A are perspective views illustrating a binding device body according to the fourth embodiment, a staple cartridge that is detachably attached to the storage portion of the binding device body, and a binding mechanism cartridge that can be attached to and detached from the storage portion instead of the staple cartridge. FIGS. 18B and 18D illustrate a state before the binding portion moves upward by the staple drive mechanism and FIGS. 18C and 18E illustrate a state when the binding portion moves upward by the staple drive mechanism.

The binding device body 400 is provided with the stapler drive mechanism 280 as described in the third embodiment. As illustrated in FIG. 17, the stapler drive mechanism 280 includes the driver cam 281 and the drive link 282, and the driver 283 and the forming plate 284 constituting the staple drive mechanism in the third embodiment are arranged in a staple cartridge 350.

Figure 18C:
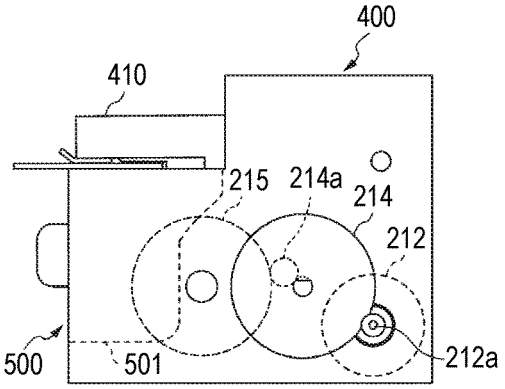
Figure 18D:
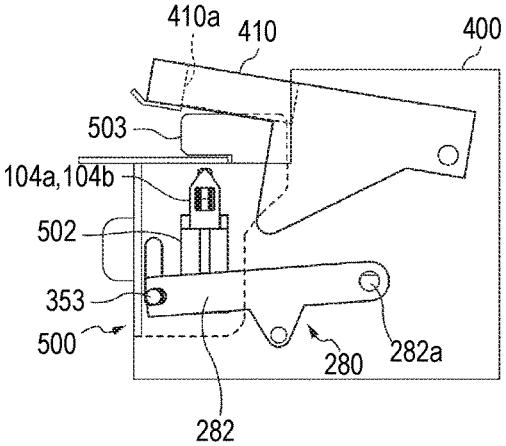
Figure 18E:
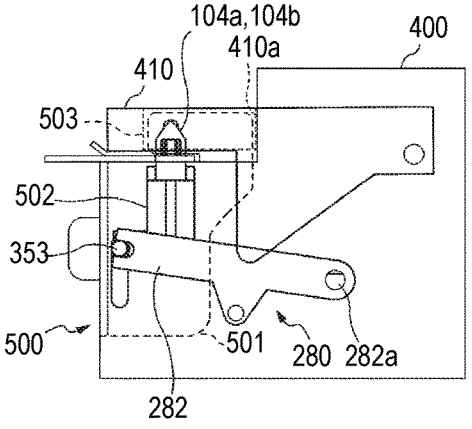

As illustrated in FIGS. 18B and 18C, the binding device body 400 is provided with a motor 212 which is driven under the control of the sheet processing apparatus 10, and the output shaft 212*a* of the motor 212 engages with a reduction gear 214. When the reduction gear 214 rotates with the driving of the motor 212, a drive gear 215 is rotationally driven via a small-diameter gear 214*a* arranged in a drive shaft of the reduction gear 214. A driver cam 281 formed in a substantially elliptical shape is attached to the rotation shaft of the drive gear 215. When the driver cam 281 rotates with the rotation of the drive gear 215, as illustrated in FIGS. 18D and 18E, the drive link 282 swings about a shaft 282*a* formed close to the rear end, and the front end of the drive link 282 reciprocates in the vertical direction. A gripping groove 282*d* engaging with an end of a connecting shaft 353 to be described later is formed in the front end of the drive link 282.

The binding device body 400 is provided with a table moving mechanism 210. By the movement of the table moving mechanism 210, a table portion 410 arranged in the upper part of the binding device body 400 moves downward to a bundle of sheets and the table portion 410 moves upward after the binding process is completed. The front part of the table portion 410 is provided with the clinching mechanism (not illustrated) described in the second embodiment, which performs a process of bending legs of a staple penetrating the bundle of sheet below. On the other hand, an opening 410*a* capable of receiving a base portion 503 to be described later is formed in the central inside part of the table portion 410.

As illustrated in FIG. 17, a storage portion 401 for storing the staple cartridge 350 or the binding mechanism cartridge 500 is formed in the front part of the binding device body 400. A front opening 402 facing the front end of the drive link 282 is formed in the storage portion 401, and the staple cartridge 350 or the binding mechanism cartridge 500 can be received via the front opening 402.

The staple cartridge 350 includes a housing 351, a driver drive unit 360, and a stapler sheet 352. A storage space for storing the staple sheet 352 is formed in the housing 351, and the staple sheet 352 is stored in the storage space. The staple sheet 352 is obtained by connecting staples in a sheet shape and winding the sheet. The tip of the stored staple sheet 352 in the front part of the housing 351 is provided with the driver 283 and the forming plate 284 attached to the connecting shaft 353 in a state in which the staple at the tip of the staple sheet 352 can come out of the lower side. Both ends of the connecting shaft 353 protrude horizontally to the outside of the housing 351 of the staple cartridge 350, and the driver 283 and the forming plate 284 can be brought out toward the tip of the staple sheet 352 or be returned therefrom by causing the connecting shaft 353 to move upward and downward along a vertical long hole formed on right and left side surfaces of the housing 351. Here, the driver drive unit 360 is approximately constituted by the driver 283, the forming plate 284, and the connecting shaft 353. A staple passing hole 351*a* for guiding a staple which is brought out to the bundle of sheets by the forming plate 284 and the driver 283 is formed in the ceiling surface of the housing 351.

The binding mechanism cartridge 500 includes a housing 501, an upward-and-downward moving portion (slider) 502, binding portions 104*a* and 104*b*, a connecting shaft 353, and a base portion 503. Similarly to the staple cartridge 350, a long hole extending in the vertical direction is formed in right and left side surfaces of the housing 501 and the connecting shaft 353 is arranged such that both ends thereof protrude from the long holes. The connecting shaft 353 can move upward and downward along the long holes. The upward-and-downward moving portion 502 is attached to the connecting shaft 353, and the upward-and-downward moving portion 502 can move (move upward and downward) in the vertical direction by interlocking with the upward and downward movement of the connecting shaft 353. A binding edge including a cutting edge 104*a* and a drawing edge 104*b* is attached to the surface of the upward-and-downward moving portion 502. An opening for passing the binding edges 104*a* and 104*b* is formed at a position immediately above the binding edges 104*a* and 104*b* in the ceiling surface of the housing 501, and when the binding edges 104*a* and 104*b* move upward by interlocking with the upward and downward movement of the upward-and-downward moving portion 502, the binding edges 104*a* and 104*b* pass through the opening to expose the tips of the binding edges 104*a* and 104*b* from the top of the housing 501. The base portion 503 is arranged above the housing 501 to face the opening through which the binding edges 104*a* and 104*b* pass. A space capable of receiving the tips of the cutting edge 104*a* and the drawing edge 104*b* is formed in the base portion 503, and an opening through which the cutting edge 104*a* and the drawing edge 104*b* can pass is formed in the bottom surface of the base portion 503. The base portion 503 is attached to the ceiling surface on the rear side of the housing 501 in a state in which a gap into which a bundle of sheets can be inserted is secured between the ceiling surface of the housing 501 and the bottom surface of the base portion 503. When a bundle of sheets is inserted into the gap, the tip of the bundle of sheets comes in contact with a connecting portion of the base portion 503 and the housing 501 and thus the binding position of the binding edges is determined.

When the binding mechanism cartridge 500 having the above-mentioned configuration is received in the storage portion 401 of the binding device body 400, both ends of the connecting shaft 353 are fitted to the gripping groove 282*d* of the drive link 282 and the connecting shaft 353 engages with the drive link 282. A part of the base portion 503 is received in an opening 410*a* formed in the central part of the table portion 410. In this way, when a bundle of sheets is inserted between the base portion 503 and the housing 501 in a state in which the binding mechanism cartridge 500 is attached to the binding device body 400, the controller of the sheet processing apparatus 10 including the binding device body 400 starts the rotational driving control of the motor 212 of the binding device body 400.

When the motor 212 is rotationally driven, the driver cam 281 of the stapler drive mechanism 280 rotates with the rotational driving of the motor 212, and the front end of the drive link 282 starts upward movement with the rotation of the driver cam 281. When the front end of the drive link 282 moves upward, as illustrated in FIGS. 18C and 18E, the connecting shaft 353 engaging with the drive link 282 moves upward and the upward-and-downward moving portion 502 moves upward. When the upward-and-downward moving portion 502 moves upward, the cutting edge 104*a* and the drawing edge 104*b* formed on the surface of the upward-and-downward moving portion 502 pass through the opening formed in the ceiling surface of the housing 501 and moves upward to the bundle of sheets, whereby the bundle of sheets is cut in a U shape and an I-shaped cut is formed.

The cutting edge 104*a* and the drawing edge 104*b* form a U-shaped cut and an I-shaped cut in the bundle of sheets and the tip thereof penetrates the bundle of sheets to the front surface thereof. Since the space capable of receiving the tip thereof is formed in the base portion 503 and the opening through which the cutting edge 104*a* and the drawing edge 104*b* can pass is formed in the bottom surface of the base portion 503, the operations of the cutting edge 104*a* and the drawing edge 104*b* are not hindered.

With the rotation of the motor 212, the table moving mechanism 210 is driven and the table portion 410 moves downward. Since the opening 410*a* capable of receiving the base portion 503 is formed in the central part of the table portion 410, the base portion 503 is received in the opening 410*a* when the table portion 410 moves downward. The base portion 503 is received in the opening 410*a* in this way. Accordingly, even when the binding process is performed using the binding mechanism cartridge 500 using the binding mechanism cartridge 180, the binding process is not hindered depending on the moving state of the table portion 410.

Thereafter, when the driver cam 281 of the stapler drive mechanism 280 rotates with the rotational driving of the motor 212 and the front end of the drive link 282 moves downward, the upward-and-downward moving portion 502 also moves downward by interlocking therewith as illustrated in FIGS. 18B and 18D. When the upward-and-downward moving portion 502 moves downward, the cutting edge 104*a* and the drawing edge 104*b* are pulled out from the bundle of sheets, the tip of the U-shaped sheet piece is drawn from the front side to the rear side in the I-shaped cut, and the bundle of sheets can be bound by the U-shaped sheet piece, whereby the process of binding the bundle of sheets using stitching is completed. Then, with the rotation of the motor 212, the table moving mechanism 210 is driven and the table portion 410 moves upward.

In this way, even when the binding mechanism cartridge 500 which can be attached to and detached from the binding device body 400 is used instead of the stapler cartridge 350 in which the driver drive unit 360 including the forming plate 284 or the driver 283 can be replaced in addition to the stapler sheet 352, the upward-and-downward moving portion 502 and the binding portion 104 of the binding mechanism cartridge 500 can be caused to move upward and downward using the stapler drive mechanism 280 of the binding device body 400. Accordingly, it is not necessary to provide the binding mechanism cartridge 500 itself with a motor or the like for driving the upward-and-downward moving portion 502 and the binding portion 104. As a result, it is possible to simplify the structure of the binding mechanism cartridge 500 and to achieve a decrease in cost of the binding mechanism cartridge 500.

Regarding the binding mechanism cartridge 500 according to the fourth embodiment, the cartridge having a configuration in which the binding position or the binding angle is not adjusted has been described as an example. However, the binding mechanism cartridge 500 using the stapler drive mechanism 280 of the binding device body 400 is not limited to the cartridge having the configuration in which the binding position or the binding angle is not adjusted, but one or two or more mechanisms of the longitudinal slide mechanism unit 106, the lateral slide mechanism unit 121, and the angle adjusting mechanism unit 145 may be combined as described in the first embodiment. In this way, by using the binding mechanism cartridge in which the binding position in the longitudinal direction or the lateral direction is adjusted or the binding angle can be adjusted as the binding mechanism cartridge using the stapler drive mechanism 280 of the binding device body 400, a user can finely adjust the binding position or the binding angle while visually checking the binding position or the binding angle and it is thus possible to adjust and set the binding position and the binding angle of the binding edge with respect to a bundle of sheets to a binding position and a binding angle at which the user's desire for a binding force of a binding part.

Detection of Bundle of Sheets

As described above, when the binding mechanism cartridge 100, 120, 140, 165, 180, or 500 is attached to the binding device body 200 or 400 of the sheet processing apparatus 10, the controller of the sheet processing apparatus 10 detects whether a bundle of sheets is inserted into the base portion of the binding mechanism cartridge, and performs a binding process by starting the rotational driving of the motor 212 when it is detected that the bundle of sheets is inserted into the binding position. In this way, detection of whether a bundle of sheets is inserted into the binding position is performed using several methods.

For example, plural detection sensors corresponding to the sheet positions may be formed in the binding device body and it may be detected when a bundle of sheets is inserted to an optimal binding position depending on the type of the binding mechanism cartridge. By forming a first sheet detecting sensor upstream in the insertion direction of a bundle of sheets and additionally forming a second sheet detecting sensor downstream, the position to which the bundle of sheets is inserted may be detected. When a bundle of sheets is detected by two sheet detecting sensors, the controller of the sheet processing apparatus 10 determines that the tip of the bundle of sheets is inserted to the optimal binding position and performs the rotational driving of the motor 212.

The binding mechanism cartridge may be provided with a member for detecting whether a bundle of sheets is inserted to a predetermined binding position. For example, a bent actuator is formed to swing to the sides of the binding mechanism cartridge. The shape of the actuator or the position of the swing shaft to which the actuator is attached varies depending on the binding mechanism cartridges.

Figure 19A:
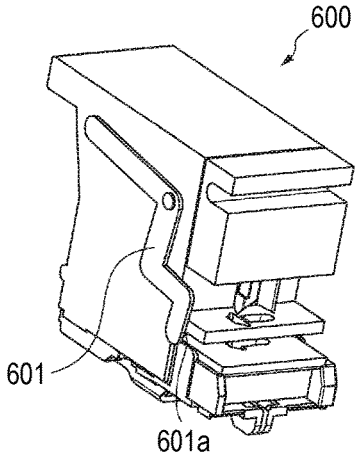
FIGS. 19A to 19F are diagrams illustrating a binding mechanism cartridge provided with an actuator and operations of the actuator.
Figure 19B:
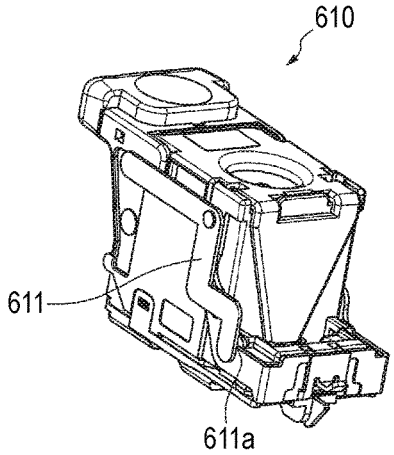
Figure 19C:
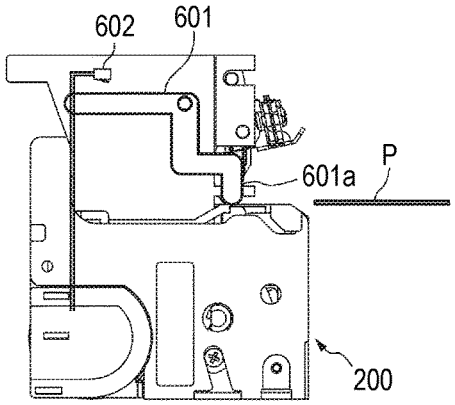
Figure 19D:
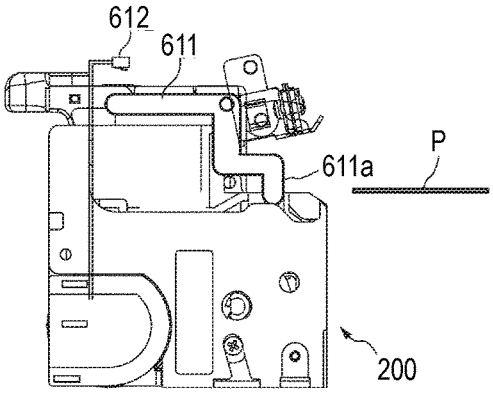
Figure 19E:
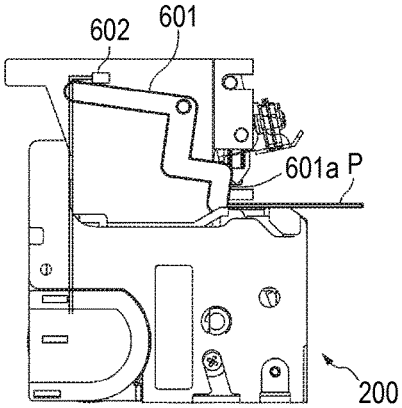
Figure 19F:
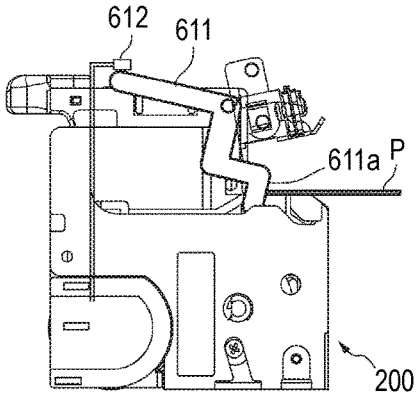

FIGS. 19A, 19C, and 19E illustrate an example of a binding mechanism cartridge 600 using a stitching method and a binding device body 200 having the binding mechanism cartridge 600 attached thereto, and FIGS. 19B, 19D, and 19F illustrate an example of a binding mechanism cartridge (staple cartridge) 610 using a staple method and a binding device body 200 having the binding mechanism cartridge 610 attached thereto. As illustrated in FIGS. 19C and 19D, the position of a front end 611*a* of an actuator 611 is located upstream in the insertion direction of a bundle of sheets P in the binding mechanism cartridge 610 using a staple method, but the position of a front end 601*a* of an actuator 601 is located downstream in the insertion direction of a bundle of sheets P. In the bundle of sheets P subjected to the binding process using a stitching method, since the width of the U-shaped cut (the width of a binding hole) is larger than the width of a staple, it is preferable that a position slightly separated from an end of the bundle of sheets P is stitched. Accordingly, as illustrated in FIGS. 19C to 19F, the actuator 601 in the binding mechanism cartridge 600 based on stitching does not start its swing when a bundle of sheets P is inserted into a deep side (downstream side), in comparison with the actuator 611 in the binding mechanism cartridge 610 based on a staple.

The binding mechanism cartridges 600 and 610 are provided with sensors 602 and 612 for detecting the swing of the actuators 600 and 610, respectively, in the vicinity of the rear ends of the actuators 601 and 611 (in the vicinity of the grip portions of the binding mechanism cartridges). When the rear ends of the actuators 600 and 610 swing to the positions of the sensors 602 and 612, the bundle of sheets is detected by the sensors 602 and 612 (a detection signal is switched from OFF to ON). Accordingly, in the binding mechanism cartridge 600 based on stitching, when the bundle of sheets P is inserted up to a deep side, the bundle of sheets is detected by the sensor 602 and the binding process is started. On the other hand, in the binding mechanism cartridge 610 based on a staple, in a state in which the bundle of sheets P is inserted shallower than that in the binding mechanism cartridge 600 based on stitching, the bundle of sheets is detected by the sensor 612 and the binding process is started.

Binding Mechanism Cartridge of Drive Shaft Connection Drive Type

The binding mechanism cartridges 100, 120, 140, 165, 180, 500, and 600 described in the first to fourth embodiments are detachably attached to the storage portions 201 and 401 of the binding device bodies 200 and 400 instead of the staple cartridges 300, 350, and 610. However, the present invention is not limited to the configuration in which the binding mechanism cartridge is attached to and detached from the storage portion 201 or 401 of the binding device body 200 or 400. For example, as long as the binding process can be performed using the drive mechanism of the motor 212 in the binding device body 200 or 400, similarly to the binding mechanism cartridges 100, 120, 140, 165, 180, 500, and 600, it is not necessary to provide the binding mechanism cartridge itself with a motor or the like for driving. Accordingly, it is possible to simplify the structure of the binding mechanism cartridge and to achieve a decrease in cost of the binding mechanism cartridge.

Figure 20A:
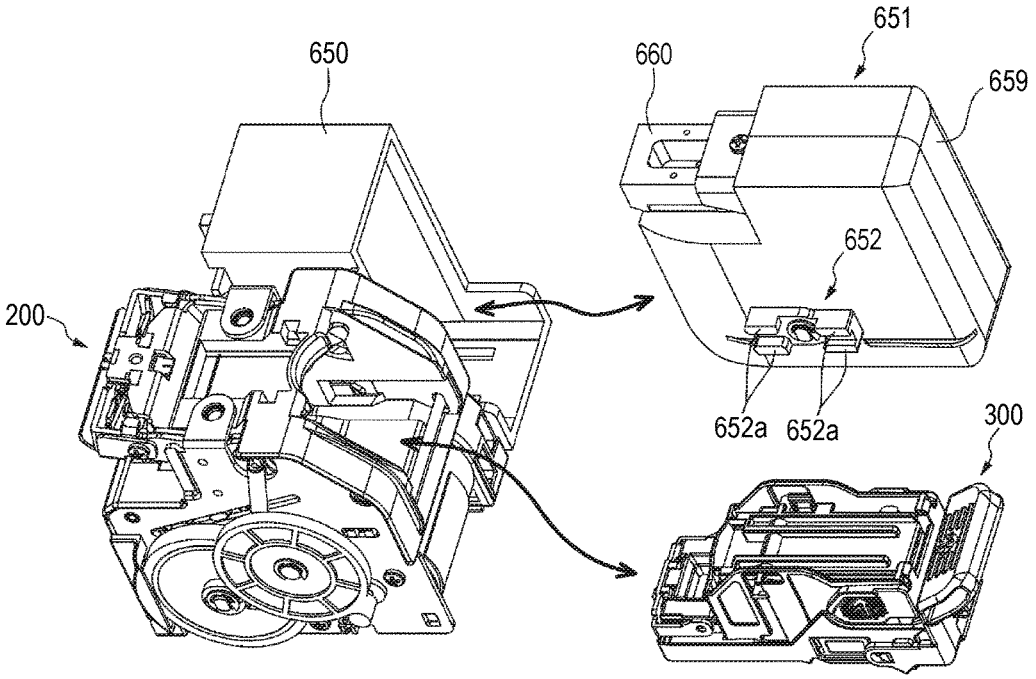
FIGS. 20A and 20B are diagrams illustrating a binding device body provided with a cartridge storage portion on one side and a binding mechanism cartridge which can be stored in the cartridge storage portion.
Figure 20B:
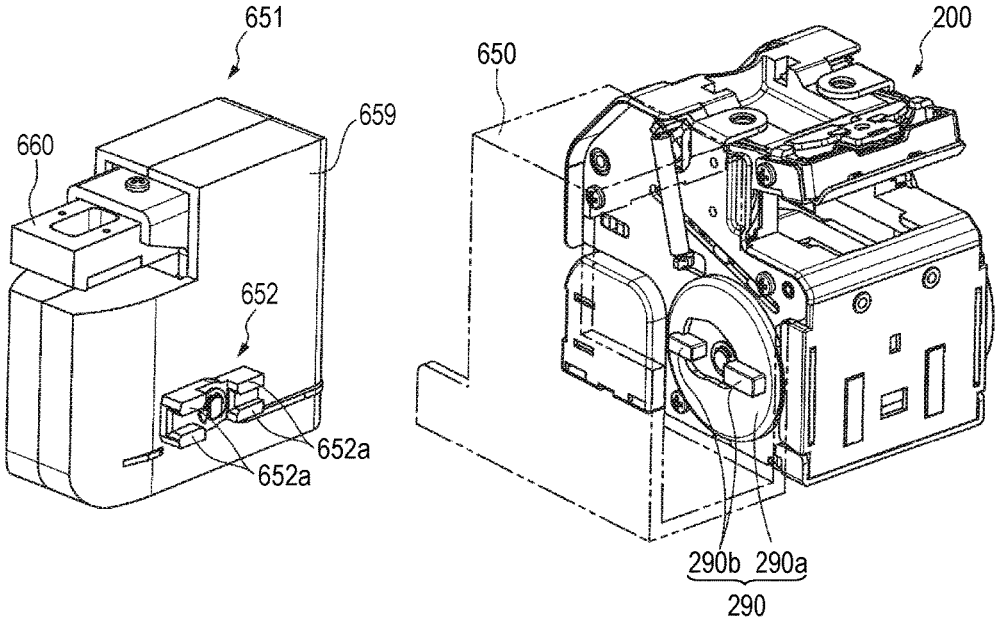

FIGS. 20A and 20B and FIGS. 21A to 21E are diagrams illustrating a configuration in which a binding process is performed using a drive mechanism of the binding device body 200 by providing a cartridge storage portion for storing a binding mechanism cartridge on one side of a binding device body 200 and storing the binding mechanism cartridge in the cartridge storage portion. As illustrated in FIG. 20B, the inner side surface of the cartridge storage portion 650 is provided with a device-side connecting portion 290 for transmitting the rotation of the drive shaft in the drive gear of the binding device body 200. The device-side connecting portion 290 includes a disc member 290*a* that rotates with the rotation of the drive shaft of the binding device body 200 and a convex protruding portion 290*b* that is formed in the central portion of the disc member 290*a*. The drive mechanism of the motor 212 in the binding device body 200 or 400 may correspond to the upward-and-downward drive mechanism in the claims. The device-side connecting portion 290 may correspond to the upward-and-downward drive mechanism in the claims. The binding mechanism cartridge is driven by a rotation of a shaft of a motor in the binding device body.

Figure 21A:
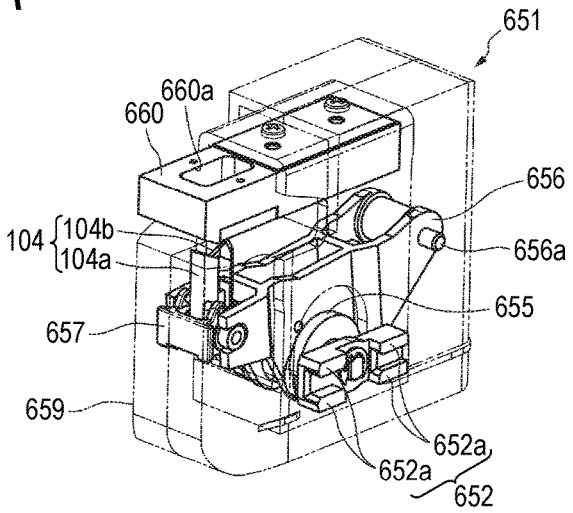
FIGS. 21A to 21E are diagrams illustrating operations of the binding mechanism cartridge and the binding device body illustrated in FIGS. 20A and 20B.

On the other hand, as illustrated in FIGS. 20A and 20B and FIG. 21A, one side surface of a body portion 659 in a binding mechanism cartridge 651 is provided with a cartridge-side connecting portion 652 engaging with the device-side connecting portion 290. The cartridge-side connecting portion 652 is provided with engagement claws 652*a* strongly engaging with the protruding portion 290*b*, and the driving force of the binding device body is satisfactorily transmitted to the binding mechanism cartridge 651 by inserting the side of the protruding portion 290*b* between a pair of engagement claws 652*a* and 652*a*.

Figure 21B:
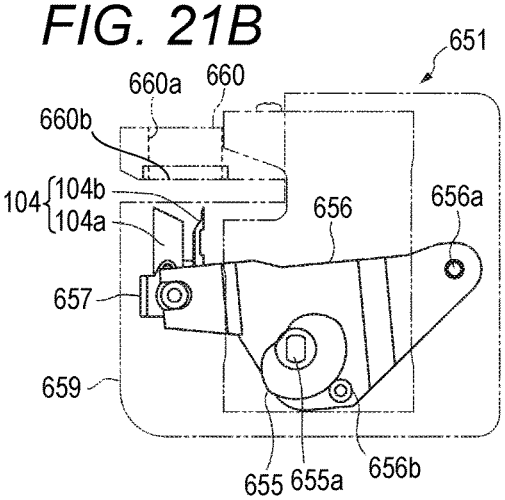
Figure 21C:
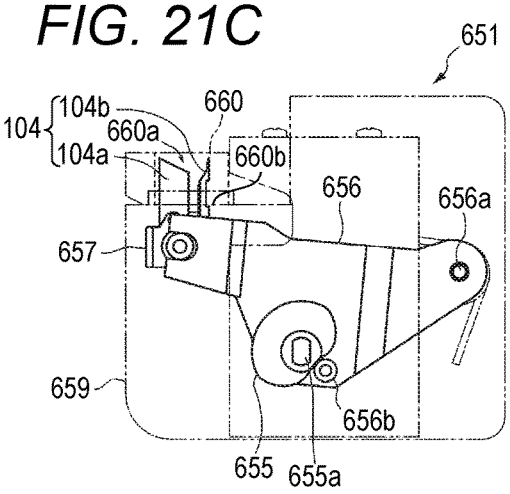

As illustrated in FIGS. 21A, 21B, and 21C, a cam 655 and a link 656 are arranged in the body portion 659 of the binding mechanism cartridge 651, and an upward-and-downward moving portion 657 and a binding portion 104 are arranged therein. The cam 655 is formed in a substantially elliptical shape and a rotation shaft 655*a* is arranged at a position which is biased from the center. The rotation shaft 655*a* of the cam 655 is connected to the rotation shaft of the cartridge-side connecting portion 652 and the cam 655 rotates with the rotation of the cartridge-side connecting portion 652. The link 656 comes in contact with the circumferential surface of the cam 655 via a roller 656*b*, and the front part of the link 656 is caused to move upward and backward depending on the rotation state of the cam 655 with a shaft 656*a* in the rear part as a swing center. The upward-and-downward moving portion 657 is attached to the front part of the link 656 so as to be movable upward and downward and the binding edge of the binding portion 104 is formed on the surface of the upward-and-downward moving portion 657. The binding portion 104 can be provided with various types of binding edges depending on the binding mechanism, and the cutting edge 104*a* and the drawing edge 104*b* used to the binding process using a stitching method are formed in the example illustrated in FIGS. 21A to 21E.

A table portion 660 is arranged to face the binding edge above the upward-and-downward moving portion 657 and the binding edge (the binding portion 104) in the front upper part of the binding mechanism cartridge 651. A space 660*a* capable of receiving the tips of the cutting edge 104*a* and the drawing edge 104*b* is formed in the table portion 660, and an opening 660*b* through which the cutting edge 104*a* and the drawing edge 104*b* can pass is formed in the bottom surface of the table portion 660. The table portion 660 can be caused to move upward and downward by a table moving mechanism not illustrated. The table portion 660 has a function of pressing the surface of a bundle of sheets at the time of downward movement and also serve as a base portion.

Figure 21D:
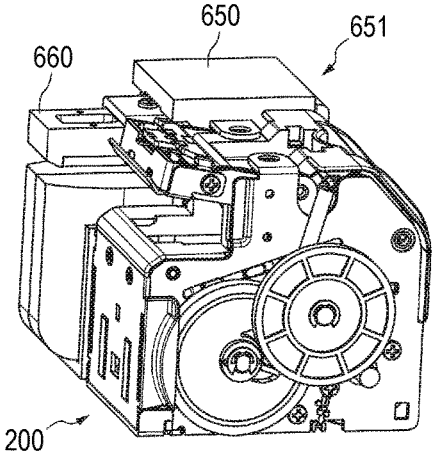
Figure 21E:
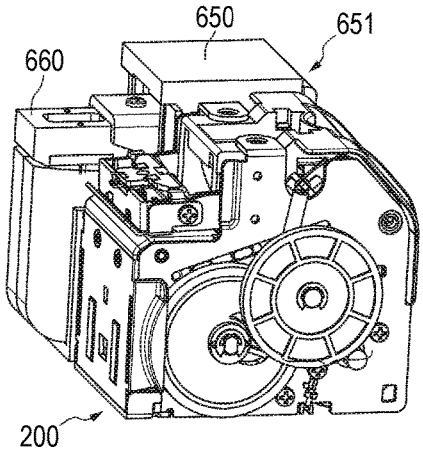

By setting the binding mechanism cartridge 651 having the above-mentioned configuration into the cartridge storage portion 650 arranged in the binding device body 200 and causing the protruding portion 290*b* of the device-side connecting portion 290 to engage with the engagement claws 652*a* of the cartridge-side connecting portion 652, as illustrated in FIGS. 21D and 21E, the upward-and-downward moving portion 657 and the binding edge 104 of the binding mechanism cartridge 651 can be driven to move upward and downward by interlocking with the rotational driving of the motor 212 of the binding device body 200 so as to drive the table portion 660 to move upward and downward, thereby performing a binding process using a binding mechanism.

Stitching Binding Mechanism Cartridge Used for Saddle Stitching Mechanism

In the binding mechanism cartridges 100, 120, 140, 165, 180, 500, 600, and 651 according to the first to fourth embodiments, when a bundle of sheets is inserted into a gap between the base portion and the binding edge or a gap between two plate-like members in the base portion, an end portion of the bundle of sheets is bound by a binding mechanism using a stitching method or the like. However, by changing the structures of the binding mechanism cartridge and the binding device body, it is possible to saddle-stitch a bundle of sheets using a binding mechanism cartridge that can be attached to and detached from the binding device body.

Figure 22A:
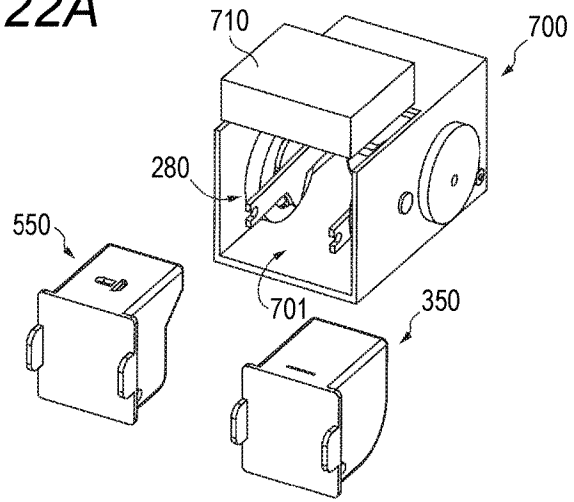
FIGS. 22A to 22C are diagrams illustrating a binding device body, a binding mechanism cartridge, and a staple cartridge that perform a binding process using a saddle stitching method.

FIG. 22A is a perspective view illustrating a binding device body performing a saddle stitching process, a stitching binding mechanism cartridge that is detachably attached to the binding device body, and a staple cartridge. FIG. 22B shows a schematic cross-sectional view of the binding device body that performs a binding process using the stitching binding mechanism cartridge and a schematic plan view of a region of a clincher unit facing the sheet surface, and FIG. 22C shows a schematic cross-sectional view of the binding device body that performs a binding process using the staple cartridge and a schematic plan view of a region of a clincher unit facing the sheet surface.

Figure 22C:
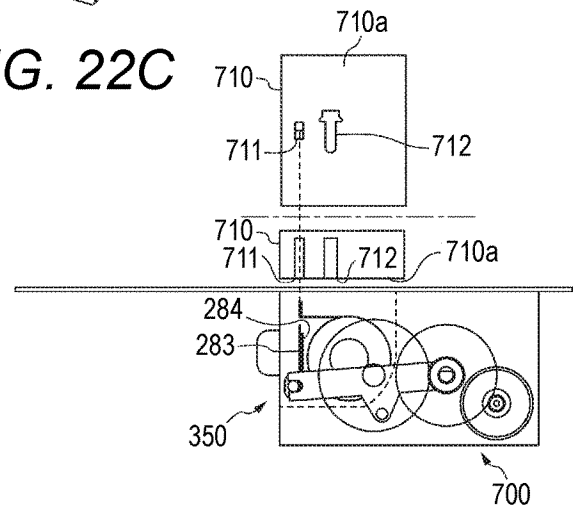
Figure 22B:
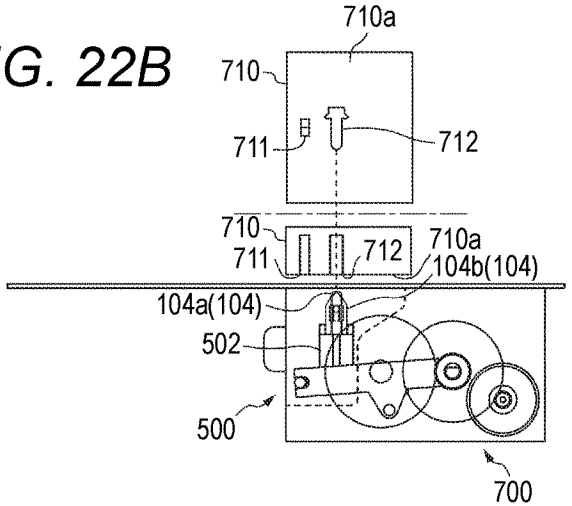

The stapler cartridge 350 illustrated in FIGS. 22A to 22C has the same structure as the staple cartridge described in the fourth embodiment. The binding mechanism cartridge 550 illustrated in FIGS. 22A to 22C has the same structure as the binding mechanism cartridge 500 described in the fourth embodiment, except that the base portion 503 is not formed. The staple drive mechanism 280 in the binding device body has the same structure as the staple drive mechanism described in the fourth embodiment. Accordingly, the same elements as in the structures will be referenced by the same reference numerals or signs and description thereof will not be repeated. For example, it is assumed that the binding portion 104 of the binding mechanism cartridge 550 is provided with a cutting edge 104*a* and a drawing edge 104*b* for performing a binding process using a stitching method.

At a position above the binding mechanism cartridge 550 stored in a storage portion 701 of a binding device body 700 or at a position above the staple cartridge 350 stored in the storage portion 701, the clincher unit 710 is arranged at a position separated by a predetermined gap from the ceiling surface of the binding mechanism cartridge 550 or the ceiling surface of the staple cartridge 350. The clincher unit 710 is not attached directly to the binding device body 700, but is arranged in the sheet processing apparatus 10 to which the binding device body 700 is attached so as to form a gap from the binding device body 700.

The front end of the clincher unit 710 is provided with a staple clincher (not illustrated) for bending legs of a staple to the sheet surface as described in the second embodiment. In this example, a recessed place capable of receiving the tips of the cutting edge 104*a* and the drawing edge 104*b* is formed as a stitching clincher downstream in the insertion direction of a bundle of sheets in the clincher unit 710 (at a position closer to the rear end of the clincher unit 710 than the position 711 of the stapler clincher).

When the staple cartridge 350 is attached to the binding device body 700, the forming plate 284 and the driver 283 are driven to move upward and downward and a process of hammering out a staple is performed at a position of the clincher unit 710 facing the position 711 of the staple clincher as illustrated in FIG. 22C. On the other hand, when the binding mechanism cartridge 550 using a stitching method is attached to the binding device body 700, the upward-and-downward moving portion 502 and he binding portion 104 (the cutting edge 104*a* and the drawing edge 104*b*) are driven to move upward and downward at a position of the clincher unit 710 facing the position 712 of the stitching clincher as illustrated in FIG. 22B.

Figure 23A:
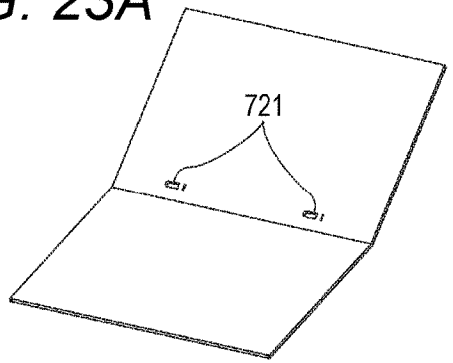
FIGS. 23A to 23E are diagrams illustrating a bundle of sheets in which binding holes are formed by a saddle stitching process and a bundle of sheets in which binding holes corresponding to a binding pitch of a fastener of a file are formed.
Figure 23B:
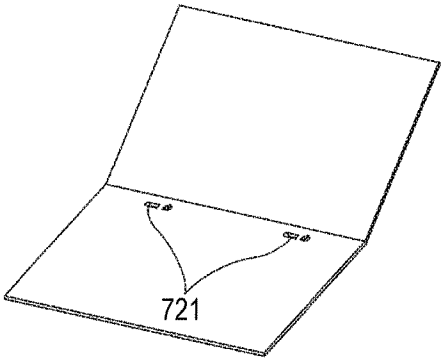
Figure 23C:
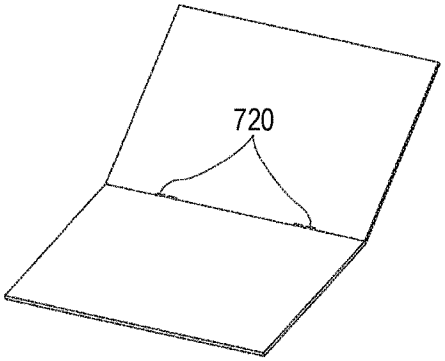

In this way, the binding position 712 when the saddle stitching process is performed using a stitching is slightly deviated from the binding position 711 when the saddle stitching process is performed using a staple. By deviating the binding positions in this way, when a bundle of sheets is saddle-stitched by a staple, the binding process can be performed such that the staple 720 is located in a folded portion on the back cover side when the bundle of sheets is folded as illustrated in FIG. 23C. Similarly, when the binding process is performed using stitching, the binding process can be performed such that the binding position 721 using the stitching is a position (offset position) slightly deviated from the folded portion on the back cover side as illustrated in FIGS. 23A and 23B. Whether the binding position 721 using the stitching should be offset to the front cover side as illustrated in FIG. 23A or should be offset to the back cover side as illustrated in FIG. 23B can be adjusted depending on whether a bundle of sheets should be inserted into a gap between the binding device body 700 and the clincher unit 710 such that the front cover part is a front half of the bundle of sheets and the back cover part is the rear half of the bundle of sheets or the bundle of sheets should be reversely inserted.

Figure 23D:
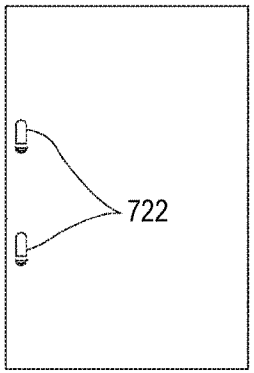
Figure 23E:
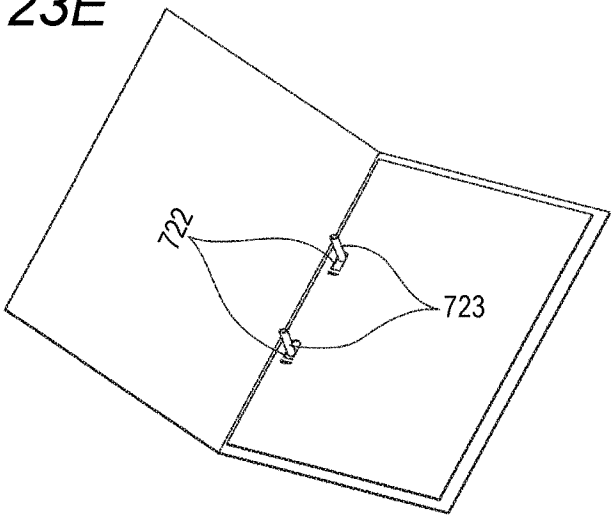

When a binding hole 722 based on the stitching is formed at two positions in an end portion of a bundle of sheets as illustrated in FIG. 23D, a method of forming two binding mechanism cartridges using the stitching in the sheet processing apparatus 10 and simultaneously performing the binding process using the stitching at two positions or a method of forming one stitching binding mechanism cartridge and sequentially forming the binding positions based on the stitching at two positions by causing the bundle of sheets to slide in the lateral direction is generally used. When the binding process using the stitching is performed in this way, the gap between two binding holes 722 (binding pitch) based on the stitching can be set to the gap (pitch) of a fastener 723 of a file for filing the bundle of sheets as illustrated in FIG. 23E. In this way, by forming the binding holes 722 based on the stitching to correspond to the gap (pitch) of the fastener 723 of a file, the binding holes (punch holes) for filing can be used as the binding holes 722 based on the stitching. By only performing the binding process using the stitching, the binding holes for filing can be formed.

Process of Identifying Binding Mechanism Cartridge in Sheet Processing Apparatus A method of identifying a type of a binding mechanism cartridge in the sheet processing apparatus 10 will be described below. In the sheet processing apparatus 10, the method of identifying the type of the binding mechanism cartridge by forming the protrusion 108 on the bottom surface of the binding mechanism cartridge 100 and causing the binding device body 200 to detect the position of the protrusion 108 using the sensor 203 as described already with reference to FIGS. 3A to 3C is used as the method of identifying the type of the binding mechanism cartridge attached to the binding device body. By transmitting information on the identified type to the controller of the sheet processing apparatus 10 after the type of the binding mechanism cartridge 100 is identified by the binding device body 200 in this way, it is possible to determine the binding method (the type of the binding mechanism) which is performed by the binding mechanism cartridge 100.

On the other hand, instead of the configuration in which the sheet processing apparatus 10 identifies the type of the binding mechanism cartridge via the binding device body, a configuration in which the sheet processing apparatus 10 identifies the type of the binding mechanism cartridge by directly checking the type of the binding mechanism cartridge using a sensor or the like may be employed.

Figure 24A:
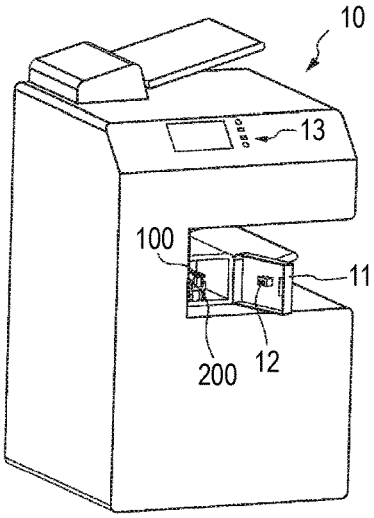
FIGS. 24A to 24F are diagrams illustrating a sheet processing apparatus in which a binding mechanism cartridge and a binding device body are installed and diagrams illustrating a binding mechanism cartridge and a staple cartridge in which an identification mark or the like for identifying a type of the binding mechanism cartridge or the like is installed.
Figure 24B:
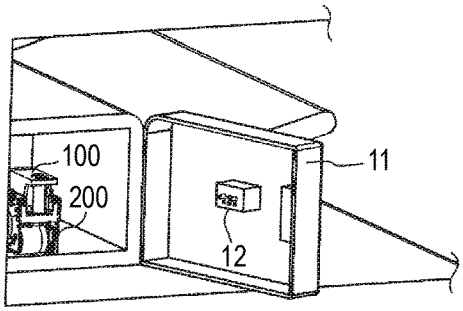

FIGS. 24A and 24B are diagrams illustrating a state in which the binding mechanism cartridge 100 is attached to the binding device body 200 installed in the sheet processing apparatus 10. The binding device body 200 is installed in the sheet processing apparatus 10, and a storage door 11 for attaching and detaching and replacing the binding mechanism cartridge 100 is arranged at the installation position of the binding device body 200. When the storage door 11 is opened, the binding device body 200 in the sheet processing apparatus 10 can be easily accessed. A user can replace the binding mechanism cartridge 100 by detaching or attaching the binding mechanism cartridge 100 from and to the binding device body 200 via the storage door 11.

As an example in which the sheet processing apparatus 10 identifies the type of the binding mechanism cartridge 100, the sensor 12 for identifying the type of the binding mechanism cartridge 100 attached to the binding device body 200 may be formed in the storage door 11.

Figure 24C:
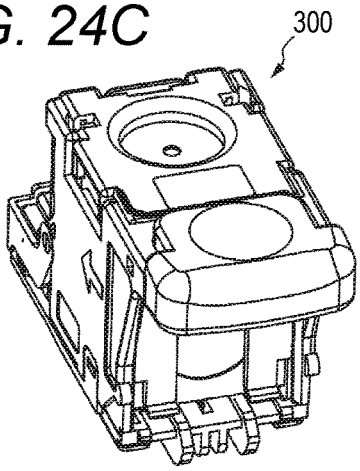
Figure 24D:
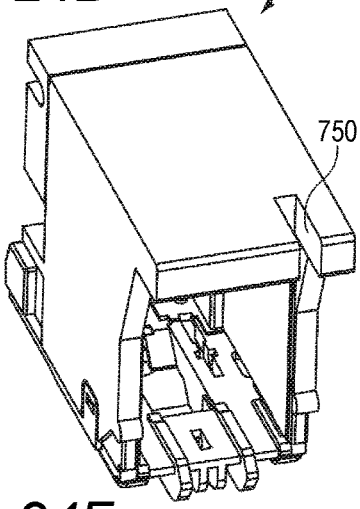

In the binding mechanism cartridge 100, as illustrated in FIG. 24D, a notched portion 750 is formed at a position varying depending on the binding mechanism (binding method) in a grip portion of the body portion (a portion protruding rearward from the rear upper part of the body portion). The staple cartridge 300 is not provided with a notched portion as illustrated in FIG. 24C. The sensor 12 arranged in the storage door 11 can identify the type of the binding mechanism cartridge 100 by detecting the presence or absence of the notched portion 750 in the grip portion, the position at which the notched portion 750 is formed, or the like.

The type of the binding mechanism cartridge 100 may be identified by forming an identification mark such as a barcode and reading the identification mark using the sensor 12 instead of forming the notched portion 750 in the grip portion. Whenever a user attaches the binding mechanism cartridge 100 to the binding device body 200, the user may set and input the type of the binding mechanism cartridge 100 using an input unit 13 such as a touch panel installed in the sheet processing apparatus 10. For example, the controller of the sheet processing apparatus 10 may reset information on the type of the binding mechanism cartridge 100 when the binding mechanism cartridge 100 is detached from the binding device body 200, and may display an error message and may not start the process in the sheet processing apparatus 10 unless a user does not input the type of the binding mechanism cartridge using the input unit 13 when a new binding mechanism cartridge is attached.

Figure 24E:
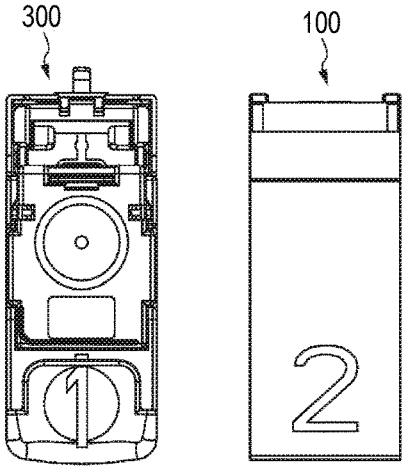
Figure 24F:
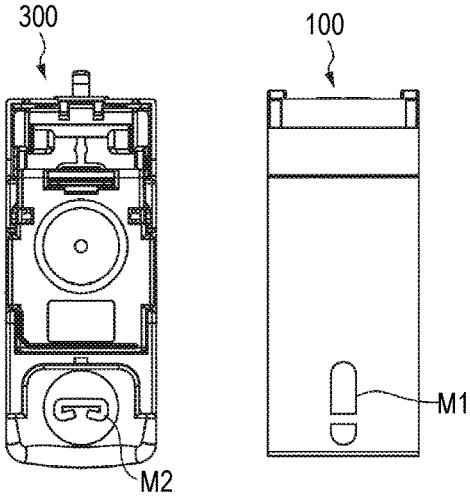

As illustrated in FIG. 24F, by forming a schematic mark (identification mark: a mark M1 imitating a U-shaped cut in case of the binding mechanism cartridge using the stitching method, a mark M2 of a bound staple in case of the staple cartridge, or the like) indicating the type of the binding mechanism on a ceiling surface or a side surface of the binding mechanism cartridge 100, a user can be caused to intuitively recognize the type of the binding mechanism cartridge 100. As illustrated in FIG. 24E, by forming a numeral or a symbol for identifying the type of the binding mechanism cartridge 100 on a ceiling surface or a side surface of the binding mechanism cartridge 100, a user can be caused to recognize that the type of the binding mechanism cartridge 100 varies depending on the numeral or the symbol. By forming three-dimensional unevenness in the identification mark, the numeral, or the symbol formed in the binding mechanism cartridge 100, a blind user can be allowed to easily identify the type of the binding mechanism cartridge 100.

Control of Binding Device Body in Sheet Processing Apparatus

The controller of the sheet processing apparatus 10 may change the method of controlling the motor 212 in the binding device body 200, the timing of discharging a bundle of sheets (booklet) subjected to a binding process, or the like depending on the type of the binding mechanism cartridge 100.

For example, as illustrated in FIG. 25A, the maximum number of sheets of a bundle of sheets which can be subjected to a binding process may be set or changed depending on the type (binding method) of the binding mechanism cartridge or the type of sheets (basis weight ($g/m^2$)) to be bound. As illustrated in FIG. 25B, the amount of power supplied (supply ratio) which is used to control the motor of the binding device body or the like may be controlled depending on the type (binding method) of the binding mechanism cartridge and the number of sheets of the bundle of sheets (booklet). In the table illustrated in FIG. 25B, when the binding process using a staple is performed, a force required for an operation increases with an increase in the number of sheets of the bundle of sheets (basis weight 80 $g/m^2$) and thus the amount of power supply (percentage value of power) increases in proportion to the number of sheets. However, when the binding process using a concave-convex binding method is performed, a concave-convex pattern needs to be formed on the sheet surface and thus 100% power is always supplied. When the binding process using a half-blanking binding method is performed or the binding process using a stitching method is performed, a larger force than that in binding the same number of sheets of the bundle of sheets using a staple is required and thus the amount of power supplied to the motor is set to a value (75% power) higher than that in case of a staple (50% power).

The processing timing in the sheet processing apparatus 10 may be adjusted depending on the type of the binding mechanism cartridge 100. For example, when a staple cartridge is used, the controller of the sheet processing apparatus 10 starts an operation of discharging a bundle of sheets (bound booklet) subjected to the binding process immediately before the binding process is completed (immediately before one cycle of binding process is completed, immediately before the binding mechanism is returned to a home position) using the motor of the binding device body. On the other hand, when a stitching method, a paper needle method, or the like is used, the controller of the sheet processing apparatus 10 starts the operation of discharging the bundle of sheets subjected to the binding process after the binding process in the binding device body is completed (after one cycle of binding process is completed and the binding mechanism is returned to the home position). When the stitching method or the paper needle method is used, the binding edge penetrates the bundle of sheets immediately before the operation of the binding device body is completed and thus the process of discharging the bundle of sheets (bound booklet) cannot be smoothly performed unless the operation of the binding device body ends (the upward-and-downward moving portion of the binding mechanism cartridge moves upward and the binding edge is completely pulled out of the bundle of sheets) and the operation of the binding device body stops. Accordingly, the controller of the sheet processing apparatus 10 can achieve optimization of the discharging timing depending on the binding method.

When failure occurs in the binding process, the controller of the sheet processing apparatus 10 may change the time of detecting binding failure, the method of driving the motor of the binding device body after the binding failure is detected, or the like.

For example, when a binding process is performed using the staple cartridge or when a binding process is performed using the binding mechanism cartridge based on the stitching method, the controller of the sheet processing apparatus 10 determines that binding failure (binding error) occurs when the binding process is not completed when the binding process is not completed, for example, even in 400 ms (0.4 seconds) after the binding process is performed. On the other hand, when a binding process is performed using the binding mechanism cartridge based on the concave-convex biding method, the controller of the sheet processing apparatus 10 determines that binding failure (binding error) occurs when the binding process is not completed, for example, even in 500 ms (0.5 seconds) after the binding process is performed. In the concave-convex binding method, since a binding burden in the binding device body or the binding mechanism cartridge is large, it is possible to appropriately detect binding failure by setting an error detection time of binding failure to be longer than that when the binding process is performed using a staple or stitching.

When binding failure occurs and when the binding process is performed using a staple cartridge and the binding process is performed using the binding mechanism cartridge based on the concave-convex binding method, the controller of the sheet processing apparatus 10 causes the motor or the like of the binding device body to reversely rotate and then performs an error notification process. However, when the binding process is performed using the binding mechanism cartridge based on the stitching method, the controller of the sheet processing apparatus 10 does not cause the motor or the like of the binding device body to reversely rotate but performs an error notification process.

In case of the staple binding method, even when failure occurs during the binding process, a staple is often driven into a sheet (legs remain in the sheet). Accordingly, since the motor of the binding device body can be caused to reversely rotate to return to the home position, the controller of the sheet processing apparatus 10 performs a reverse rotation process. In case of the convex-concave binding method, even when failure occurs during the binding process, the binding portion (binding edge) of the concave-convex binding is not intertwined in the bundle of sheets and thus the controller of the sheet processing apparatus 10 can cause the motor of the binding device body to reversely rotate to return to the home position, similarly to the staple binding method. On the other hand, in case of the stitching method, when failure occurs during the binding process, the cutting edge and the drawing edge arranged in the upward-and-downward moving portion often penetrate the bundle of sheets. Here, in the binding process based on the stitching, a process of catching the tip of a U shape (tongue part) cut out by the cutting edge by the tip of the drawing edge penetrating the bundle of sheets and drawing the tip of the U shape from the rear side to the front side of the bundle of sheets is performed. Accordingly, when failure occurs during the binding process, the motor of the binding device body may not be caused to reversely rotate. Therefore, when the binding process is performed using the binding mechanism cartridge based on the stitching method, the controller of the sheet processing apparatus 10 can smoothly cope with the binding failure by performing the error notification process without performing the reverse rotation process.

While the binding mechanism cartridge, the binding device body, and the sheet processing apparatus according to the present invention have been described in various embodiments, the binding mechanism cartridge, the binding device body, and the sheet processing apparatus according to the present invention are not limited to the above-mentioned configurations described in the embodiments. The binding mechanism cartridge, the binding device body, and the sheet processing apparatus according to the present invention may be modified and improved in various forms based on the configurations described in the embodiments or configurations other than the configurations described in the embodiments.

What is claimed is:

1. A binding mechanism cartridge being storable in a storage portion of a binding device body instead of a staple cartridge, the staple cartridge being storable in the storage portion of the binding device body, the binding mechanism cartridge comprising:

a body portion having an outer width set to a size corresponding to an inner width of the storage portion and being detachably held in the storage portion, wherein the body portion includes a gripping portion protruding reward from a rear top portion;

a longitudinal slide mechanism unit provided on a front surface of the body portion and being slidable to the body portion in a longitudinal direction, the longitudinal slide mechanism unit comprising:

a base portion protruding from a lower part of a front surface of the longitudinal slide mechanism unit, and configured to support a bundle of sheets from a bottom surface of the bundle of sheets; and an upward-and-downward moving portion attached to the front surface of the longitudinal slide mechanism unit and positioned on an upper side of the base portion, the upward-and-downward moving portion being movable upward and downward along the front surface of the longitudinal slide mechanism unit, wherein the upward-and-downward moving portion moves close to or away from the bundle of sheets supported on the base portion by moving upward and downward, the upward-and-downward moving portion comprising:

a binding portion provided on a lower end side of the upward-and-downward moving portion and configured to bind the bundle of sheets, wherein the binding portion is configured to bind the bundle of sheets by being in contact with the bundle of sheets according to a downward-movement of the upward-and-downward moving portion.

2. A binding mechanism cartridge according to claim 1, wherein the upward-and-downward moving portion includes a recessed portion engageable with a connecting shaft of the binding device body movable upward-and-downward.

3. A binding mechanism cartridge according to claim 1, wherein the longitudinal slide mechanism unit is slidable to the body portion in a lateral direction.

4. A binding mechanism cartridge according to claim 1, wherein the longitudinal slide mechanism unit is rotatable about an axis extending to the body portion in the longitudinal direction.

5. A binding mechanism cartridge according to claim 3, wherein the longitudinal slide mechanism unit is rotatable about an axis extending to the body portion in the longitudinal direction.

6. A binding mechanism cartridge being storable in a storage portion of a binding device body instead of a staple cartridge, the staple cartridge being storable in the storage portion of the binding device body, the binding mechanism cartridge comprising:

a body portion having an outer width set to a size corresponding to an inner width of the storage portion and being detachably held by the storage portion;

a lateral slide mechanism unit provided on a front surface of the body portion and being slidable to the body portion in a lateral direction, the lateral slide mechanism unit comprising:

a base portion protruding from a lower part of a front surface of the lateral slide mechanism unit and configured to support a bundle of sheets from a bottom surface of the bundle of sheets; and an upward-and-downward moving portion attached to the front surface of the lateral slide mechanism unit and positioned on an upper side of the base portion, the upward-and-downward moving portion being movable upward and downward along the front surface of the lateral slide mechanism unit, wherein the upward-and-downward moving portion moves close to or away from the bundle of sheets supported on the base portion by moving upward and downward, the upward-and-downward moving portion comprising:

a binding portion provided on a lower end side of the upward-and-downward moving portion and configured to bind the bundle of sheets, wherein the binding portion is configured to bind the bundle of sheets by being in contact with the bundle of sheets according to a downward-movement of the upward-and-downward moving portion.

7. A binding mechanism cartridge being storable in a storage portion of a binding device body instead of a staple cartridge, the staple cartridge being storable in the storage portion of the binding device body, the binding mechanism cartridge comprising:

a body portion having an outer width set to a size corresponding to an inner width of the storage portion and being detachably held by the storage portion, wherein the body portion includes a gripping portion protruding reward from a rear top portion;

an angle adjusting mechanism unit provided on a front surface of the body portion and being rotatable about an axis extending to the body portion in a longitudinal direction, wherein the angle adjusting mechanism unit comprises:

a base portion configured to support a bundle of sheets from a bottom surface of the bundle of sheets; and an upward-and-downward moving portion attached to an upper side of the base portion, the upward-and-downward moving portion being movable upward and downward, wherein the upward-and-downward moving portion has a binding portion configured to bind a bundle of sheets on a bottom surface of the upward-and-downward moving portion which faces the base portion, wherein the binding portion is configured to bind the bundle of sheets by being in contact with the bundle of sheets according to a downward-movement of the upward-and-downward moving portion.

* * * * *